US006042952A

United States Patent [19]

Aratani et al.

[11] Patent Number: 6,042,952

[45] Date of Patent: Mar. 28, 2000

[54] EXTREMELY-THIN STEEL SHEETS AND METHOD OF PRODUCING THE SAME

[75] Inventors: Makoto Aratani; Naotoshi Ryu; Hideo Kuguminato; Akio Tosaka; Kaneharu Okuda; Masatoshi Aratani, all of Chiba; Susumu Okada, Tokyo, all of Japan

[73] Assignee: Kawasaki Steel Corporation, Kobe, Japan

[21] Appl. No.: 08/952,013

[22] PCT Filed: Mar. 14, 1997

[86] PCT No.: PCT/JP97/00826

§ 371 Date: Nov. 12, 1997

§ 102(e) Date: Nov. 12, 1997

[87] PCT Pub. No.: WO97/33706

PCT Pub. Date: Sep. 18, 1997

[30] Foreign Application Priority Data

Mar. 15, 1996 [JP] Japan ..... 8-059666
Apr. 10, 1996 [JP] Japan ..... 8-112182

[51] Int. Cl.[7] ..... C21D 8/02

[52] U.S. Cl. ..... 428/648; 428/667; 428/684; 148/320; 148/643; 148/650; 148/651

[58] Field of Search ..... 148/320, 330, 148/643, 645, 650, 651; 428/648, 667, 684

[56] References Cited

U.S. PATENT DOCUMENTS 4,897,316 1/1990 Kagechika et al. ..... 428/648
4,931,106 6/1990 Tosaka et al. ..... 148/320
5,042,564 8/1991 Van Perlstein et al. ..... 148/541
5,390,518 2/1995 Morimoto et al. ..... 72/366.2
5,534,089 7/1996 Fujinaga et al. ..... 148/651
5,636,544 6/1997 Tomizawa et al. ..... 72/366.2
5,686,144 11/1997 Shimizu et al. ..... 428/667
5,704,997 1/1998 Ouvrard et al. ..... 148/651

*Primary Examiner*—George Wyszomierski
*Attorney, Agent, or Firm*—Oliff & Berridge, PLC

[57] ABSTRACT

A steel slab is rough-rolled into a sheet bar and butt-joined onto a preceding sheet bar and a widthwise end portion of the sheet bar is heated by means of an edge heater and then subjected to a continuous finish rolling through pair-cross rolls rolling on at least 3 stands to provide a hot rolled steel strip having a width of not less than 950 mm, a thickness of 0.5–2 mm and a crown within ±40 $\mu$m, and the hot rolled steel strip is subjected to cold rolling, continuous annealing, temper rolling and, if necessary, plating treatment on the surface of the cold rolled steel strip, whereby there is obtained a steel sheet having an average thickness of not more than 0.20 mm and a width of not less than 950 mm, a thickness variation quantity in a widthwise direction is within ±4% of the average thickness in a region corresponding to not less than 95% of the width of the steel sheet as cold rolled and a hardness (HR30T) variation in the widthwise direction is within ±3 of an average hardness.

8 Claims, 6 Drawing Sheets

WIDTHWISE END PORTION OF STEEL STRIP : POSITION CORRESPONDING TO 5mm FROM WIDTHWISE END PORTION OF HOT ROLLED STEEL STRIP

FIG. 4

◎ : PAIR-CROSS HOT ROLLING OF ALL STANDS → CROSS SHIFT COLD ROLLING OF ONE-SIDE TRAPEZOIDAL WORK ROLL

○ : USUAL HOT ROLLING → CROSS SHIFT COLD ROLLING OF ONE-SIDE TRAPEZOIDAL WORK ROLL

WHITE OFF PAINT : GOOD FLATNESS OF COLD ROLLED STEEL STRIP, HIGH-SPEED PASSING IN CONTINUOUS ANNEALING

BLACK PAINTED : POOR FLATNESS OF COLD STEEL ROLLED STRIP, NO HIGH-SPEED PASSING IN CONTINUOUS ANNEALING

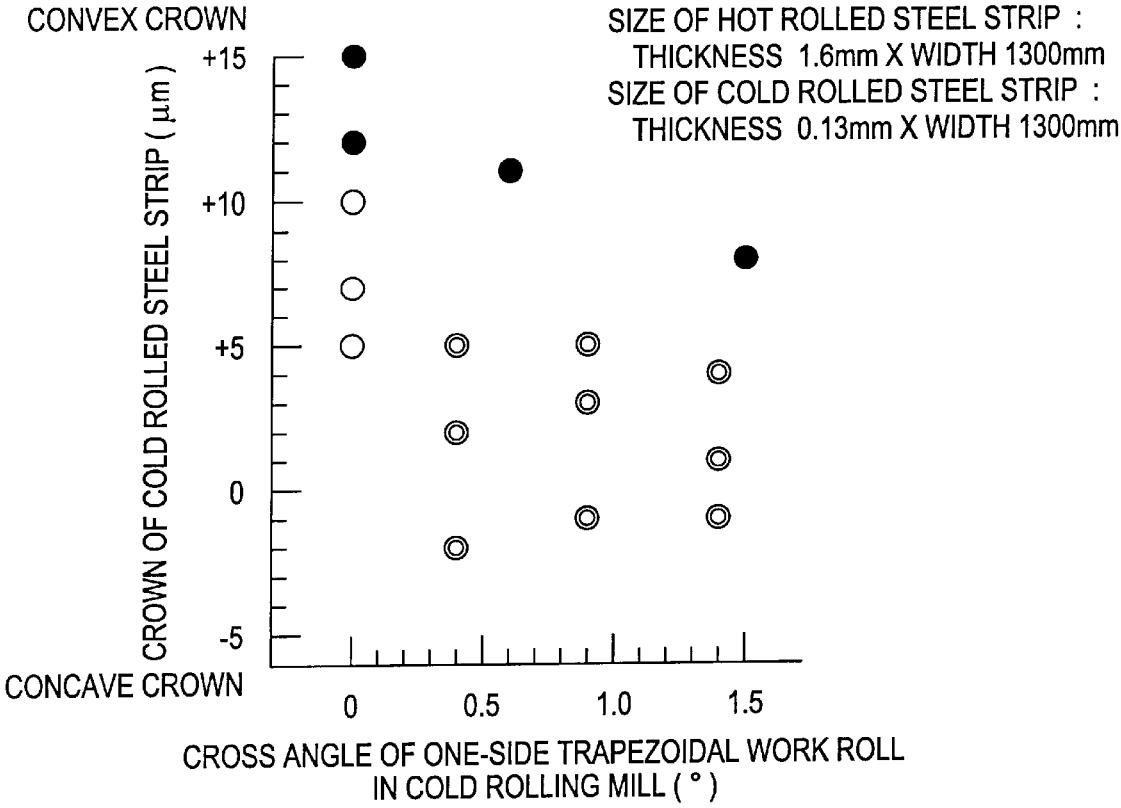

CROWN OF COLD ROLLED STEEL STRIP : THICKNESS OF MIDDLE PORTION OF STEEL STRIP - THICKNESS AT POSITION CORRESPONDING TO 10mm FROM WIDTHWISE END OF HOT ROLLED STEEL STRIP

FIG. 5

◎ : GOOD FLATNESS (WITHIN ±4%), PASSING IN CONTINUOUS ANNEALING FURNACE; NOT LESS THAN 1000m/min ○ : GOOD FLATNESS (WITHIN ±4%), PASSING SPEED IN CONTINUOUS ANNEALING FURNACE; NOT LESS THAN 700m/min △ : GOOD FLATNESS (WITHIN ±4%), LARGE FREQUENCY IN OCCURRENCE OF BREAKAGE THROUGH PASSING IN CONTINUOUS ANNEALING FURNACE ◇ : POOR FLATNESS (OVER ±4%), LARGE FREQUENCY IN OCCURRENCE OF BREAKAGE THROUGH PASSING IN CONTINUOUS ANNEALING FURNACE

× : POOR FLATNESS (OVER ±4%), NO PASSING IN CONTINUOUS ANNEALING FURNACE

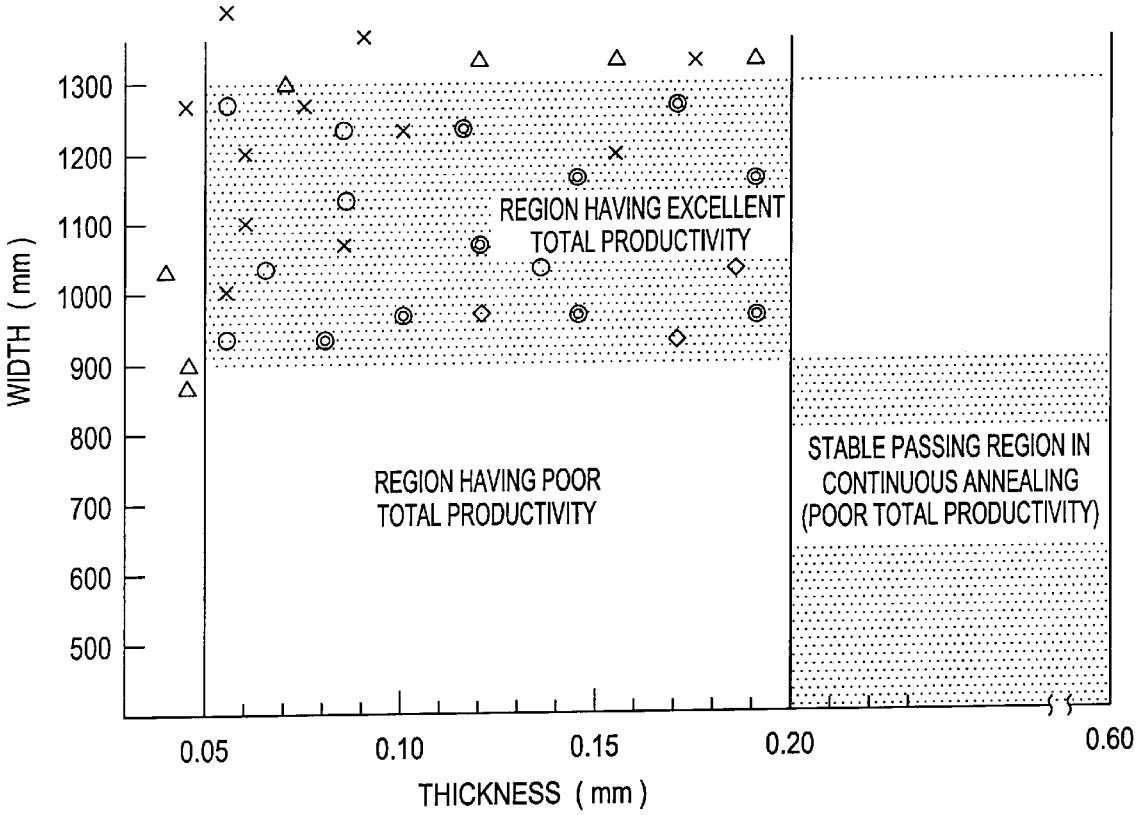

EXTREMELY-THIN STEEL SHEETS AND METHOD OF PRODUCING THE SAME

BACKGROUND OF THE INVENTION

1. Technical Field

This invention relates to an extremely-thin steel sheet which can adopt all temper grades of T1~T6 and DR8~DR10 and is suitable for use in various two-piece cans (SDC: Shallow-Drawn Can, DRDC: Drawn & Redrawn Can, DTRC: Drawn & Thin Redrawn Can, DWIC: Drawing & Wall Ironing Can) or three-piece cans (Side Seam Soldered Can, Side seam Welded Can, Thermoplastic Bonded Side Seam Can) and has uniform material properties and thickness accuracy in spite of extremely-thin thickness and wide-width and is excellent in economy as well as a method of producing the same.

In the invention, the term "extremely-thin steel sheet" means both of a blackplate for surface treatment and a surface treated steel sheet.

2. Background Art

The steel sheet for the can is subjected to various platings of Sn [including a tin plated steel having an Sn plated quantity of not less than 2.8 g/m$^2$ and a thin tin plated steel sheet LTS (Lightly Tin Coated Steel) having an Sn plated quantity of less than 2.8 g/m$^2$], Ni, Cr and the like and thereafter used in a drink can, a food can and the like.

The material property of the steel sheet for the can is defined by the temper grade. The temper grade is represented by a target value of Rockwell T hardness (HR30T), which is classified into T1–T6 in case of single-rolled products and into DR8–DR10 in case of double-rolled products represented by a target value of hardness (HR30T) and a target value of proof stress measured in a rolling direction.

Recently, the high-speed operation for can formation was progressed with the consumption of greater amount of drink cans and hence it became demanded to develop steel sheets suitable for the high-speed can formation. In the steel sheet for can, therefore, it was required to severely control not only the accuracy of the hardness but also dimensional precision and flatness of the steel sheet, lateral bending of steel strip and the like as compared with steel sheets for automobile.

On the other hand, a rationalization based on the reduction of can weight using a steel sheet of a thin thickness became recently a large tendency with the advance of the can formation technique even in can bodies such as 3-piece can and 2-piece can.

When the thickness is made thin, it is naturally impossible to avoid the lowering of the can strength. For this end, it is attempted to improve the can strength by changing a shape of a can through neck-in work, multistage neck-in work, smooth drastic neck-in work or the like or further to conduct the strengthening through deep drawing work, stretch work, bulging work, bottom doom work or the like after painting and baking.

In the production of 2-piece can, it tends to make the can height higher (i.e. increase of drawing ratio) for the increase of the content in addition to the can weight reduction.

From these recent situations, it is demanded to possess properties being conflicting in the conventional thought, which are high strength, very thin thickness, and excellent can formation workability and deep drawing workability as a steel sheet for the can. And also, in order to establish these properties, it is more important to improve the thickness precision and control the change of workability.

Furthermore, the painting of coil or lamination of film on the coil was recently put into practice, so that in order to efficiently conduct lamination operation for a body plate of, for example, 3-piece can, there was adopted a method of continuously laminating a film on a steel strip in a longitudinal direction and cutting out into a body plate per can unit through shearing or slitting. In this method, the film was laminated so as to render weld portion of the can body into the rolling direction (the height direction of the can is the rolling direction of the steel sheet), but in order to laminate the soft film at given set position with a high accuracy while rewinding the steel sheet, the demand of lateral bending accuracy and flatness of the steel strip became further severer. Because, when the film is laminated to the weld portion at a state of slightly shifting from the given set position, poor welding is caused to bring about large damage.

Thus, the lateral bending and flatness of the steel strip as a steel sheet for the can become demanded to be considerably excellent as compared with the conventional ones.

At the present, there is established a reasonable method for the can production in which approximately a full width of the steel strip for the can is rendered into a can except for few millimeters at a widthwise end portion, so that it is required that the material properties and thickness are uniform and dimensional precision such as tolerance of width and length, displacement of rectangle, lateral bending precision of steel strip or the like is excellent over the full width of the steel sheet for the can. Furthermore, the steel sheet having an excellent flatness is required for preventing the print displacement as previously mentioned. The ununiformity of the material properties largely exerts as a factor of the blackplate degrading the flatness, so that it is required to use an extremely-thin steel sheet having uniform material properties.

The uniformity of the thickness, particularly the uniformity of the thickness in the widthwise direction is important as mentioned above. In the conventional steel sheet for the can, the uniformity of the thickness was insufficient, so that when it was used in the production of the can, it was considered to design a large blank size so as to correspond a thickness of a raw material with the thickness result at the end portion in the widthwise direction being apt to be thinned in the punching out of circular blank to thereby provide a necessary can height. Therefore, the can height became unnecessarily higher in the widthwise central portion of the plate width being apt to be thickened to thereby decrease the yield, but also when the can body was taken off from a press machine, an upper portion of the can body was engaged with the press machine to prevent the removal from the machine and a new can body was charged in the machine before the removal and hence jamming phenomenon that plural can bodies were pressed several times was caused to largely damage the productivity.

In the 3-piece can, the can body was apt to become flat even if it was wound in form of a cylinder after flexor and hence the cylindrical body having a higher true circle was not obtained and there were problems that the thickness was locally thinner and the can strength was lacking even when using an extremely-thin and wide-width steel sheet for can having a high strength.

Furthermore, it is very important that the hardness in the widthwise direction of the steel strip is uniform. If a hard portion and a soft portion are mixedly existent in the widthwise direction of the steel strip, even when the rolling is carried out under the same rolling directions, the elongation of the soft portion is large and the elongation of the hard portion is small and hence the flatness becomes poor. Even if the poor flatness resulting from such a material property is apparently corrected by mechanical correction such as tension leveler or the like, when small blanks are subsequently formed by slit-cutting every can unit, local warping is again caused and hence there is caused a new problem that high-speed can formation becomes difficult.

Now, the conventional steel sheet for can was as narrow as 3 feet in an upper limit of formable width through a printing machine or coating machine, so that it was produced at a narrow width from the old time. However, when a line is newly arranged in accordance with the advance of the can formation method, the formation width became enlarged to not less than 4 feet (about 1220 mm) for the purpose of total rationalization from the production of steel sheet for can to finishing of can and high productivity. For this end, a wide-width steel strip having excellent productivity became demanded as a raw material for can.

As mentioned above, the thickness is extremely thin from a viewpoint of can weight reduction and the width is wider from a viewpoint of the productivity, so that it is newly required to totally use extremely-thin and wide-width steel sheets even in the field of the steel sheet for the can.

In the conventional technique, however, it was possible to merely produce the wide-width steel strip in view of the installation, but it was difficult to rationally correspond with the requirements as previously mentioned and there were, for example, problems that the thickness was thinned from the set value and the material properties were missed and the dimensional precision was poor. Particularly, these qualities were degraded in widthwise end portion and longitudinal end portion of the steel strip, so that there was a problem that these end portions were cut out and removed at the production step of the steel sheet to considerably lower the yield.

In the conventional technique, therefore, it was difficult to produce an extremely-thin and wide-width steel strip having uniform thickness and material properties over a full width of the steel sheet, and hence the size of the rationally producible steel strip was critical to be 0.20 mm in the thickness and about 950 mm in the width from a viewpoint of the sheet passing property in the continuous annealing (for example, described in "Brass and Tin-free Steel" (second edition), page 4 by Toyo Kohan Kabushiki Kaisha, published by Kabushiki Kaisha Agne). Even if steel strips having a width wider than the above were manufactured, it was difficult to provide substantially uniform thickness and material properties over not less than 95% of the width.

As a large factor obstructing the uniformity of the material properties, there are considered segregation of steel components and ununiformity of temperature in hot rolling and annealing. Among them, it can be said that the segregation of the steel components is substantially solved by the continuous casting and the annealing is solved by the advance of continuous annealing technique. Therefore, the remaining problem in the operation is considered to mainly lie in the hot rolling.

In the hot rolling, when using a hot rolling machine comprised of the conventional 4-stand rolling mill, there is no means for effectively controlling the plate crown, so that the variation of plate crown of about 100 $\mu$m was caused by the change of roll profile with the lapse of time accompanied with thermal expansion and wearing of the work roll and the change of roll deflection deformation accompanied with the thickness and width of rolled material in a period ranging just from rearrangement of roll to next rearrangement.

In such a control of crown quantity was used 4 stage work roll shift, 6 stage HC roll or the like. In the extremely-thin and wide-width steel sheet, however, a variation of plate crown of not less than about 40 $\mu$m was caused, so that the above control was insufficient from a viewpoint of ensuring the uniformity of material properties.

In any case, the conventional technique had a problem that the widthwise end portion and longitudinal end portion were cut out and removed by trimming operation or the like until the finish of a product as a steel sheet for can to largely lower the yield.

As mentioned above, it is strongly demanded to develop steel sheets for can having an excellent quality and being extremely thin and wider in width from a viewpoint of the reduction of production cost in the can body through can weight reduction and the improvement of productivity through width widening of coil.

However, when such a steel sheet was produced by the conventional production technique, there was a problem that the thickness and material properties (particularly hardness) were obliged to be ununiform in the widthwise direction. For this end, there were brought about not only the lowering of the yield through the trimming of widthwise end portion but also the lowering of high-speed passing property in the continuous annealing step, the lateral bending, the lowering of the flatness and the like. Furthermore, the lowering of product yield resulted from the poor shape of the can body and poor strength was brought about even in the production of the can body using such a steel sheet and hence new can forming method based on film laminated coil, coat coil or the like could not effectively be applied.

It is, therefore, an object of the invention to provide extremely-thin steel sheets for can having uniform material properties (particularly hardness) and uniform thickness in spite of extremely-thin and wide-width in light of the aforementioned problems of the conventional technique as well as a method of producing the same.

It is another object of the invention to provide an extremely-thin steel sheet for can capable of tempering to soft temper degree T1 or further harder temper grades T2–T6 and temper grade DR8–DR10 and being suitable for new can forming method and having uniform material properties (particularly hardness) and uniform thickness in spite of extremely-thin and wide-width as well as a method of producing the same.

Furthermore, a concrete object of the invention is to provide a high-quality, extremely-thin steel sheet having extremely-thin and wide-width of thickness: not more than 0.20 mm and width: not less than 950 mm and a thickness variation quantity within ±4% in a region other than both widthwise end portions of the steel sheet as cold rolled (provided that a ratio to width is not more than 5% in total of both side ends) and a hardness (HR30T) variation quantity within ±3.

SUMMARY OF INVENTION

The extremely-thin steel sheet according to the invention is characterized in that in a steel sheet having an average thickness of not more than 0.20 mm and a width of not less than 950 mm, a thickness variation quantity in a widthwise direction is within ±4% of the average thickness in a region corresponding to not less than 95% of the width of the steel sheet as cold rolled and a hardness (HR30T) variation in the widthwise direction is within ±3 of an average hardness.

Here, a chemical composition of the steel is preferable to have C: not more than 0.1 wt %, Si: not more than 0.03 wt %, Mn: 0.05–0.60 wt %, P: not more than 0.02 wt %, S: not more than 0.02 wt %, Al: 0.02–0.20 wt %, N: not more than 0.015 wt %, O: not more than 0.01 wt %, and the balance being Fe and inevitable impurities.

Furthermore, a chemical composition of the steel is preferable to have C: not more than 0.1 wt %, Si: not more than 0.03 wt %, Mn: 0.05–0.60 wt %, P: not more than 0.02 wt %, S: not more than 0.02 wt %, Al: 0.02–0.20 wt %, N: not more than 0.015 wt %, O: not more than 0.01 wt %, one or more of Cu: 0.001–0.5 wt %, Ni: 0.01–0.5 wt %, Cr: 0.01–0.5 wt %, Mo: 0.001–0.5 wt %, Ca: not more than 0.005 wt %, Nb: not more than 0.10 wt %, Ti: not more than 0.20 wt % and B: not more than 0.005 wt %, and the balance being Fe and inevitable impurities.

Moreover, the C content is favorable to be more than 0.004 but not more than 0.05 wt % for improving the workability after welding, or to be not more than 0.004 wt % for improving the deep drawability.

These steel sheets include a steel sheet provided on at least one-side surface with a surface treated layer.

Further, the surface treated layer is favorable to be subjected to tin plating or chromium plating.

And also, the surface treated layer is favorable to be comprised of a tin plated layer having a total Sn quantity of 0.56–11.2 g/m$^2$ and a metallic Cr of 1–30 mg/m$^2$ formed on the surface of the tin plated layer and a chromate layer formed thereon and containing a chromium hydrated oxide of 1–30 mg/m$^2$ as a Cr conversion.

Alternatively, the surface treated layer is favorable to be comprised of a chromium plated layer containing a metallic Cr of 30–150 mg/m$^2$ and a chromate layer formed thereon and containing a chromium hydrated oxide of 1–30 mg/m$^2$ as a Cr conversion.

Moreover, the surface treated layer is favorable to be comprised of Fe—Ni alloy layer having a weight ratio of Ni/(Fe+Ni) of 0.01–0.3 and a thickness of 10–4000 Å, a tin plated layer formed on the surface of the alloy layer and having many convex portions on its surface and a total Sn quantity of 0.56–5.6 g/m$^2$ and a convex area ratio of 10–70%, a metallic Cr of 1–30 mg/m$^2$ formed on the surface of the tin plated layer and a chromate layer formed thereon and containing a chromium hydrated oxide of 1–30 mg/m$^2$ as a Cr conversion.

The method of producing the extremely-thin steel sheet according to the invention comprises rendering a steel slab, mainly continuous cast slab into a sheet bar having a width of not less than 950 mm through rough rolling, butt-welding this sheet bar onto a preceding sheet bar, raising a temperature of a widthwise end portion of such a sheet bar by means of an edge heater, and then subjecting to a continuous finish rolling through rolling with pair-cross rolls on at least 3 stands to obtain a hot rolled steel sheet having a width of not less than 950 mm, a thickness of 0.5–2 mm and a crown within ±40 μm and further cold rolling the hot rolled steel sheet to obtain a steel sheet having an average thickness of not more than 0.20 mm and a width of not less than 950 mm.

And also, continuous annealing and temper rolling are further carried out after the above cold rolling.

In this case, the cold rolling is preferable to be cross shift rolling on 1 or more stands at front stage side.

In the pair-cross rolling, a pair-cross angle is favorable to be not less than 0.2°, and it is favorable to use a tapered crown work roll in the cross shift rolling.

Further, the hot rolled steel sheet according to the invention is a steel sheet having a thickness of not more than 2 mm, a width of not less than 950 mm and a crown within ±40 μm.

The above hot rolled steel sheet is suitable for an extremely-thin steel sheet.

Further, the method of producing the hot rolled steel sheet according to the invention comprises rendering a steel slab into a sheet bar having a width of not less than 950 mm through rough rolling, butt-joining this sheet bar onto a preceding sheet bar, raising a temperature of a widthwise end portion of such a sheet bar by means of an edge heater, and then subjecting to a continuous finish rolling through rolling with pair-cross rolls on at least 3 stands.

At first, a size of the steel sheet aiming at the invention is an average thickness of not more than 0.20 mm and a width of not less than 950 mm. Because they are to reduce the production cost for the can body through the can weight reduction and improve the productivity through the width widening as previously mentioned. Further, the reason why the thickness variation quantity is within ±4% of an average thickness in the widthwise direction and the hardness (HR30T) variation quantity is within ±3 of an average hardness in the widthwise direction over a full width of the steel sheet is due to the fact that it is necessary to control the scattering in the widthwise direction for ensuring the high-speed passing property at the step of continuous annealing or the like and the dimensional accuracy and strength of the shaped product. It is desirable to control the variation quantity to a given level over the full width, so that it is practically sufficient to ensure not more than the desired variation quantity within 95% of the full width.

Moreover, wide-width and extremely-thin steel sheets of the above size having the thickness and hardness with the high accuracy in the widthwise direction were not existent up to the present time.

The inventors have realized that it is essential to produce extremely-thin and wide-width hot rolled steel sheets having a good shape accuracy in order to produce the above extremely-thin and wide-width steel sheet. Further, it has been noticed that since a sheet bar after the rough rolling is passed per one bar through a finish rolling mill in the conventional hot rolling, the biting-in of the front end and the biting-out of the rear end in the sheet bar are repeated in every passing in the rolls of the finish rolling mill and it is obliged to run the front end portion and rear end portion of the sheet bar inside the finish rolling mill and from a final stand of the finish rolling mill to a coiling machine without being restrained by rolls and hence the sufficient shape accuracy is not obtained. That is, the front end portion and the rear end portion in the sheet bar can not be rolled at a constant tension state as in the central portion in the rolling direction through the conventional technique, so that there are the following problems.

(1) Since the disorder in the shape of the steel strip is generated, the full width of the hot rolled steel strip can not be finished uniformly.

(2) As the thickness of the hot rolled steel strip becomes thinner, the passing becomes unstable and there is caused a trouble that the steel strip after the passing out from the final stand of the finish rolling mill is meandered and is not arrived at the coiling machine. In order to prevent this trouble, it is obliged to largely decrease the rolling rates of the front end portion and rear end portion of the sheet bar as compared with that of the central portion and hence it is difficult to control the temperature and thickness in not only the end portion of the hot rolled steel strip in the rolling direction but also in the widthwise direction and the uniform material properties and thickness can not be finished.

(3) As the variation of the thickness and material properties in the longitudinal direction and the widthwise direction becomes large, the variation after the cold rolling becomes also large and hence the large lowering of the yield is brought about by cutting down.

From the above, the thinning of the thickness is critical in the conventional technique and the thickness as the hot rolled steel strip is 1.8 mm at most ignoring the economical reasons.

Therefore, it is required to develop a technique capable of stably producing extremely-thin hot rolled steel strips having a thickness of not more than 2.0 mm in a high productivity.

Furthermore, it was very difficult to produce extremely-thin and wide-width steel sheets by continuous annealing in the conventional technique. Because, the steel strip was suffered with a temperature change of heating, soaking and cooling while passing in the continuous annealing method and passed at various combinations of various sizes such as narrow-width, wide-width, thin thickness and thick thickness in accordance with the plan of the production steps, so that the temperature difference is caused in correspondence with the specification of the passing steel strip in the widthwise direction of rolls in the furnace and hence the passing trouble is caused. For example, when the temperature difference is caused in the widthwise direction of the rolls in the furnace, the deformation is created through thermal expansion difference and hence the steel strip is meandered and the breakage is caused unless the meandering is not corrected. Therefore, the production of steel sheets for can such as extremely-thin steel sheet having an extremely thin thickness or extremely-wide steel sheet was naturally critical.

Moreover, when the high-speed passing is carried out for rationally producing the extremely-thin steel strip, heat buckling is liable to be caused. If it is intended to prevent the heat buckling, the meandering is liable to be caused. Even in the reverse case, the stable passable region is very narrow, which was difficult to rationally produce the extremely-thin and wide-width steel sheets.

In order to solve this problem, the inventors have first found that it is possible to conduct stable sheet passing by joining sheet bars in hot rolling to conduct continuous rolling and adjusting a crown of the steel strip.

That is, it was a common sense that the crown of the hot rolled steel strip for can was set to a convex shape. On the contrary, the inventors have noticed that it is important to prevent the heat buckling for passing the extremely-thin and wide-width steel sheet at a high speed and it is necessary to improve the flatness of the passing cold rolled steel strip and therefore it is important to make the crown of the hot rolled steel sheet small to improve the flatness in the widthwise central zone being apt to cause buckling of the coil in the passing through a continuous annealing furnace.

As a result of investigations, troubles of heat buckling and breakage were solved by finishing a good flatness so as not to create center buckle (Center Buckle ISIJ TR009-1980) with a slight edge wave (Edge Wave ISIJ TR009-1980) after the cold rolling, more accurately without creating the center buckle and edge wave.

As the concretely solving method, it has been found that it is important to use cross rolls in the hot finish rolling, more preferably use the cross rolls in the cold rolling.

Moreover, the inventors have found that in order to rationally produce the extremely-thin and wide-width steel sheets for can, it is effective to continue the hot rolling and use the cross rolls in the hot rolling or further cold rolling, and raise a widthwise end portion of the sheet bar obtained the rough hot rolling that lowers the temperature during the rolling by means of an edge heater to finish into a steel strip having less degradation of the flatness and a small crown.

The chemical composition of steel will be described together with its restricting reasons below.

A solid soluted quantity of C in ferrite phase is about 1/10–1/100 of N. In this point, strain aging of steel sheet slowly cooled as in box annealing method is mainly controlled by behavior of N atom. Since the cooling rate is very large in the continuous annealing method, however, C is insufficiently precipitated and a greater quantity of solid soluted C is retained to badly affect the strain aging.

And also, C is an important element controlling the recrystallization temperature to control the growth of recrystallization grain size. In case of the box annealing, the crystal grain size becomes small to be hardened with the increase of C quantity, while in case of the continuous annealing, there is not seen a simple tendency of conducting the hardening with the increase of C quantity.

When the C quantity is as very slight as not more than about 0.004 wt %, the softening is caused, while as the C quantity increases, a peak showing a highest hardness is observed at about 0.01 wt %, and when the C quantity is further increased, the hardness inversely lowers and a peak becomes valley within a range of C quantity: 0.02–0.07 wt % and when the C quantity becomes further large, the hardness becomes high. The reason why the softening is caused at the C quantity of not more than about 0.004 wt % is considered due to the fact that an absolute value of C dissolution quantity is less at the dissolution temperature in the annealing and strain aging curing through C becomes small.

In the invention, steel sheets can be produced at a low-carbon steel containing C in accordance with necessary hardness without being particularly subjected to vacuum degassing treatment. However, C is necessary to be not more than 0.1 wt % in order to produce steel sheets suitable for cans through the continuous annealing while avoiding the excessive curing and degradation of rolling property.

When the C quantity is as very slight as not more than about 0.004 wt %, the softening is caused, so that it is required to use the vacuum degassing treatment in the steel making step, which becomes slightly disadvantageous in economical reason.

Now, in order to economically and rationally produce temper grade of T3 or more occupying not less than about 85% in the steel sheet for can in the continuous annealing method by utilizing the fact that steel containing a certain quantity of C exceeding 0.004 wt % is effective in the softening, it is favorable that the C quantity is adjusted to exceeds about 0.004 but is not more than 0.05 wt %. When it is within this range, HAZ cured quantity through welding can be suppressed to a small level. Moreover, the quantity of not less than 0.02 wt % is further favorable because the softening is caused and the vacuum degassing treatment is useless.

The inventors have systematically investigated the relationship between solid soluted C, N exerting upon hardness of tin plate and crystal grain size and found that the softening can be caused even in the continuous annealing method by reducing solid soluted C, N and making the crystal grain size large. Based on this acknowledge, in order to decrease the solid soluted C after the annealing, it is effective to reduce C in the continuously cast slab as a starting material.

In general, when cans are formed by press working of tin plate, it is important to make r-value high, while it is also important to make Δr low. The inventors have found that it is effective to make the quantity of carbon as a nucleus of crystal grain very slight to coarsen the crystal grain size as a result of examining a method of further decreasing Δr of tin blackplate.

Under the above knowledges, the inventors have further made studies and found that steel sheets of T1-DR10 can be individually produced by subjecting extremely-low carbon steel to continuous annealing and changing a rolling reduction of subsequent temper rolling.

From this viewpoint, in order to produce soft tin blackplate having a temper grade of not more than T1 through the continuous annealing method while seriously taking the workability, particularly deep drawability, C is favorable to be not more than 0.004 wt %.

On the other hand, the can-forming technique remarkably advances and arrives at a level that a steel sheet having an elongation of 0% as measured by a tensile test can be pressed into a deep can such as drink can at the present time. Further, in order to more rationally produce steel sheets for can, it will be epoch-making if steel sheets are used for can without being subjected to the continuous annealing.

Because, the blackplate of the steel sheet for can is thin in the thickness passing through a continuous annealing furnace and is liable to create troubles in passing due to heat buckle or cooling buckle and hence it is obliged to restrict the passing speed to a small value and particularly the production of high-strength and extremely-thin steel sheet through the continuous annealing becomes uneconomical.

As a means for attaining such an omission of annealing, it is usable to reduce the C quantity as far as possible for attaining the hardness after the cold rolling to not more than a target hardness, and concretely it is favorable to not more than 0.002 wt %.

Si is an element degrading the corrosion resistance of the tin plate and extremely hardening the material property, so that it should be avoided to excessively include it. Particularly, when the Si quantity exceeds 0.03 wt %, the steel is hardened and the blackplate for soft tin plate can not be produced, so that it is required to restrict to be not more than 0.03 wt %.

Therefore, it is important to decrease the Si quantity at the steel-making stage as far as possible, so that it is required to take care of using zircon refractory instead of the conventionally used chamotte refractory or the like for controlling the reduction of $SiO_2$ in the refractory through Al in molten steel.

Mn is an element required for preventing the occurrence of edge breakage in hot rolled steel strip through S. If the S quantity is small, it is not required to add Mn, but since S is inevitably included in steel, the addition of Mn is necessary. When the Mn quantity is less than 0.05 wt %, the occurrence of edge breakage can not be prevented, while when the Mn quantity exceeds 0.60 wt %, the crystal grain size becomes finer and the strengthening through solid solution is added to conduct the curing, so that it is necessary to restrict the addition quantity to a range of 0.05–0.60 wt %.

P is an element curing the material property and degrading the corrosion resistance of the tin plate, so that the excessive inclusion is unfavorable and it is required to restrict to not more than 0.02 wt %.

When S is excessively included, S solid-soluted at a high temperature γ zone in the hot rolling is supersaturated with the lowering of temperature to precipitate in γ zone as (Fe, Mn)S, which causes the edge breakage of the hot rolled steel strip through red brittleness. And also, it causes press defect as S-based inclusion. Therefore, the S quantity is required to be not more than 0.02 wt %. Particularly, when Mn/S ratio is less than 8, the edge breakage and press defect are liable to be caused, so that Mn/S ratio is favorable to be not less than 8.

Al has a function of a deoxidizing agent in the production step of steel and is an element required for enhancing the cleanness. However, the excessive addition is not only uneconomical but also controls the growth of the recrystallized grain size, so that the quantity is required to be not more than 0.20 wt %. On the other hand, when the Al quantity is extremely decreased, the cleanness of the tin plate is degraded. And also, Al is usable for providing soft tin plate and plays a role for fixing solid soluted N to reduce its remaining quantity. Therefore, Al is restricted to a range of 0.02–0.20 wt %.

When N in air is incorporated into steel in the steel production to form solid solution in steel, soft steel sheet can not be obtained. Therefore, when soft sheet is produced, it is necessary that N is restricted to not more than 0.015 wt % by controlling the incorporation of N from air at the steel-making step as far as possible. Moreover, N is a very effective component for easily and cheaply producing hard sheet, so that the N quantity in accordance with the target hardness (HR30T) can be attained by blowing N gas into molten steel in the refining.

O results in the breakage in press working or degradation of corrosion resistance as an oxide formed with Al, Mn in steel, Si in refractory, Ca, Na, F in flux or the like, so that it is necessary to decrease the quantity as far as possible. Therefore, the upper limit of O quantity is 0.01 wt %. In order to reduce the O quantity, there are effective a method of deoxidation strengthening through vacuum degassing treatment, a method of adjusting a dam shape of a tundish, a shape of a nozzle, a pouring rate or the like. In these refining stages, the cleanness is improved by adding a proper quantity of Al.

Cu, Ni, Cr and Mo can increase the strength without degrading the ductility of steel and are added in accordance with the level of strength of the target steel sheet (hardness (HR30T)). And also, these elements have an effect of improving the corrosion resistance of the steel sheet. In order to develop this effect, it is necessary to add Cu, Mo in at least 0.001 wt %, and Ni, Cr in at least 0.01 wt %. However, when they are added exceeding 0.5 wt %, the effect is saturated and the rise of the cost is brought about, so that the upper limit of the addition quantity is 0.5 wt % in each element. Moreover, the effect of these elements can be developed by the single addition or by the composite addition.

Ca, Nb and Ti are elements usable for improving the cleanness of steel, respectively. However, the excessive addition of Ca becomes uneconomical and also the resulting non-metallic inclusion lowers the melting point and causes softening and lengthy elongation at the rolling step to bring about poor can-forming work, so that the upper limit is 0.005 wt %.

Moreover, when Al-killed steel is subjected to Ca treatment, the following reactions are considered as deoxidation reaction:

$$Ca+O \rightarrow CaO \quad (1)$$

$$3Ca+Al_2O_3 \rightarrow 3CaO+2Al \quad (2)$$

In general, a quantity of $O_{total}$ (oxide) is considerably larger than a dissolved oxygen in Al-killed steel, so that the deoxidation reaction (2) is main.

Further, Ca oxide becomes a molten state in molten steel owing to its composition and also fine Ca oxide is liable to be aggregated, united, floated and separated, so that the remaining non-metallic inclusion is as small as not more than 5 μm. The inclusion having such a small particle size is uniformly diffused in the continuous casting method having a fast solidification. Therefore, the defect produced from the old time due to the non-metallic inclusion can be solved.

As means for using Ca, it is effective to utilize Ca by diluting with Ba or the like to industrially develop a strong deoxidation ability of Ca. As a concrete method of adding Ca, it is economically effective that after Al-killed molten steel is sufficiently deoxidized in the vacuum degassing treatment, Al—Ca—Ba wire is added to molten steel for a short time while agitating with an inert gas from a lower portion of a ladle.

Nb is an element having a action for the improvement of the cleanness and a function of forming carbide and nitride to decrease remaining quantity of solid soluted C and solid soluted N. However, when it is excessively added, the recrystallization temperature is raised by a pinning effect of crystal grain boundary through Nb-based precipitate to degrade the sheet passing operability in the continuous annealing furnace and the grain size becomes finer, so that the Nb addition quantity is not more than 0.1 wt %. Moreover, the lower limit is favorable to be 0.001 wt % required for developing the effect.

Ti is an element having a action for the improvement of the cleanness and a function of forming carbide and nitride to decrease remaining quantity of solid soluted C and solid soluted N. However, when it is excessively added, sharp and hard precipitates are created to degrade the corrosion resistance and result in the occurrence of scratch flaw in the press working. Therefore, the Ti addition quantity is not more than 0.2 wt %. The lower limit of the Ti addition quantity is favorable to be 0.001 wt % required for developing the effect.

B is an element effective for improving the grain boundary brittleness. That is, when a carbide-forming element is added to an extremely-low carbon steel to considerably decrease solid soluted C, the strength of recrystallized grain boundary becomes weak and hence it is considered that a fear of brittle breakage is caused if a can is stored at a low temperature or the like. In order to obtain a good quality even in such an application, it is effective to add B.

The action of improving the grain boundary brittleness through B is explained below. If solid soluted C is existent in the grain boundary, the segregation of P becomes small and the grain boundary strength becomes large and hence poor brittle can be controlled. However, if the solid soluted C becomes small, P is segregated in the grain boundary to cause brittleness. In this case, if B is existent, B itself or acting as the solid soluted C increase the grain boundary strength and hence the poor brittleness can be solved.

And also, B is an element effective for forming the carbide or nitride to conduct softening, but segregates in the recrystallized grain boundary during the continuous annealing to delay the recrystallization, so that the addition quantity is not more than 0.005 wt %. Moreover, the lower limit of the B addition quantity is favorable to be 0.0001 wt % required for developing the effect.

Next, a further concrete method of producing the extremely-thin and wide-width steel sheet in the invention will be described.

The continuously cast slab used in the invention is obtained by subjecting molten steel from a converter to vacuum degassing treatment if necessary and then continuously casting it.

In order to produce an extremely-thin and wide-width steel sheet for can having a target value of not more than 0.20 mm, it is necessary to produce an extremely-thin hot rolled steel strip of not more than 2.0 mm having a small crown quantity. When the thickness exceeds 2.0 mm, the rolling reduction at cold rolling for extremely thinning becomes large and cold rolling property is degraded and it is difficult to ensure a good shape. Moreover, the lower limit of the thickness of the hot rolled steel strip is 0.5 mm considering a mill power from a limit capable of producing hot rolled steel strip having uniform material properties while preventing the temperature lowering of a sheet bar in the rolling from a slab having a large section thickness of about 260 mm.

In order to produce the above extremely-thin hot rolled steel strip of not more than 2.0 mm while maintaining the high productivity, it is first preferable to conduct continuous rolling.

In FIG. 1 is shown an influence of a hot rolling method upon a widthwise hardness of an extremely-thin and wide-width steel sheet having a thickness of 0.130 mm, a width of 1250 mm and a temper grade of DR9 (target hardness is HR30T of 76). As shown in FIG. 1, the hardness (HR30T) lowers by 12 with respect to the target value at the position corresponding to 5 mm from the widthwise end portion of the hot rolled steel strip in the conventional method, but hardly lowers even at the end portion in the method according to the invention adopting the continuous rolling and hence the extremely-thin and wide-width steel sheet can be produced.

As a result, it is not necessary to conduct the edge cut removal after hot rolling, cold rolling or further surface treatment. Furthermore, the rolling can be continued at a high speed and a constant rate over a full length of the hot rolled steel strip, so that the productivity is considerably improved. And also, a constant tension is applied to the full length of the hot rolled steel strip, so that the thickness, shape and material properties become uniform and the yield is improved and hence the extremely-thin hot rolled steel strip can be produced in a high productivity. Moreover, the rolling is carried out under a constant tension, so that it is possible to forcedly conduct the coiling and the range of controlling the crystal grain size becomes large.

It is desirable that the coiling temperature after the above hot finish rolling is basically not lower than 550° C., preferably not lower than 600° C. except for the case of omitting the continuous annealing as mentioned later. When the coiling temperature is lower than 550° C., the recrystallization is not sufficiently carried out and the crystal grain size of the hot rolled sheet becomes small, and even when the continuous annealing is carried out after the cold rolling, the crystal grain of the cold rolled sheet is small in correspondence with the crystal grain size of the hot rolled sheet and it is difficult to obtain steel sheets for soft can having Ti or the like.

Moreover, sheet bar joining in a short time in the continuous rolling is favorable for obtaining the effect aimed at the invention.

An example of butt joining method for a short time will be described below. At first, sheet bars are joined to each other for a short time of not more than 20 seconds while moving a joining device itself in correspondence with a speed of the sheet bar in accordance with a timing of sheet bar joining. Thereafter, the joint portion is pressed by heating through an electromagnetic induction method and continuously rolled in a finish rolling mill without a break, and then a steel strip is divided by a shearing machine just before a coiling machine and coiled.

On the other hand, in order to make a crown of a widthwise central portion after the cold rolling small, since the crown is similar to a crown of the hot rolled steel strip, it has been found out that the crown of the hot rolled sheet is fundamentally necessary to be made small and further it is preferable to reduce at a front-stage stand roll of thick thickness in the cold rolling.

As to edge drop, a roll flattening deformation under rolling load is transcribed onto a sheet end portion, so that the shape corresponds to the rolling load distribution. Therefore, in order to improve the edge drop, the load is fundamentally decreased to make the flattening deformation quantity small. In this connection, there are mentioned the following concrete systems and problems:

(1) As a work roll diameter becomes large, the load increases and the reduction of thickness in the vicinity of the widthwise end portion becomes remarkable and also the edge drop quantity becomes large, so that the work roll diameter is required to be made small. As the work roll diameter becomes small, the deflection of the work roll in the vicinity of the widthwise end portion rapidly changes and the edge drop quantity becomes small. However, this system is unfavorable when the extremely-thin steel sheet is rolled at a high speed.

(2) Tensions at entry side and delivery side are made large. However, this system is liable to break the steel strip in the rolling. Particularly, it is apparent to be unsuitable as a method of producing extremely-thin and wide-width steel sheet for can.

(3) The rolling reduction is made small. However, this system is apparent to be disadvantageous in the rolling of the extremely-thin steel sheet.

(4) The thickness at the delivery side is made large. As the thickness becomes large, metal flow in the widthwise direction is apt to be caused and the load and the widthwise distribution of the thickness at the delivery side can uniformly be improved. However, this system is clear to be not suitable in the subject matter of the invention using the extremely-thin hot rolled steel strip.

(5) There is used a raw material having a small deformation resistance. The magnitude of the deformation resistance forms the magnitude of edge drop as it is. Therefore, it is advantageous in the extremely-low carbon steel having C quantity considerably reduced as compared with the low carbon steel, but can not be said to be best in the cost.

And also, the other method of controlling the edge drop and its problem are mentioned as follows:

(1) There is a method of rolling with a tapered work roll having a roll profile changed at the widthwise end portion. In this system, however, the aiming width capable of developing the effect is specified, so that it is difficult to cope with steel strips having different widths in the production steps.

(2) There is a method of changing a sheet profile of the widthwise end portion by width-reducing through an edger between hot finish rolling stands under a tension of the steel strip. In this system, the installation is complicated and troublesome in the maintenance when appearance defect is caused and also the productivity is poor.

(3) There is a method of bending a small-size roll in the horizontal direction to change metal flow of the material in the widthwise direction. In this system, the productivity is poor.

As mentioned above, there have been proposed various systems of previously thickening the thickness of the widthwise end portion (edge up) to conduct horizontal rolling, but the extremely-thin and wide-width hot rolled steel strip for can was not rationally produced.

It has been known from the old time that there is an effect of considerably improving the sheet crown by applying a cross angle between work rolls of usual rolling mill as a method of producing hot rolled steel strip having a small crown, but thrust force was excessive and could not be put into practical use.

This was improved by adopting a pair cross mill (pair-crossed roll system) formed by crossing a pair of work roll and buck-up roll. This mill has a structure that thrust force is not caused between the work roll and the buck-up roll and thrust force is caused only between rolled material and work roll. For this end, crown control and edge drop control can effectively be carried out according to the pair cross mill.

The pair-cross system is a system in which up and down roll groups are crossed while holding work roll shaft (WR shaft) and buck-up roll shaft (BUR shaft) in parallel to each other. The principle of crown control through the pair-cross system lies in that a minimum gap between rolls produced when up and down WR shafts are crossed changes in a parabolic form in the widthwise direction and is equivalent to a case of applying a roll crown of a parabolic form in convex direction to WR.

That is, even when a strong reduction is applied in the usual system, the roll bends and expands at the widthwise central portion (convex crown), so that it is difficult to make the crown small and particularly it is very difficult to roll the extremely-thin and wide-width steel sheet for can. On the other hand, it has been found that when the rolls are crossed, the crown of the hot rolled steel strip can be made considerably small.

As shown in FIG. 2, the crown control and edge drop control are enabled by adjusting a cross angle of roll shafts to preferably not less than 0.2°, more particularly not less than 0.4°. Further, it has been found that as the cross angle becomes large, the edge profile largely changes from edge drop to edge up and hence the edge drop can considerably be improved. And also, the zone of edge drop is 20–30 mm from the widthwise end, while the zone of edge up is made larger by several times of the edge drop zone and contributes to the improvement of the sheet crown and the thickness is substantially possible to be dead flat or concave crown. Moreover, the strip shape changes from edge wave to center buckle as the cross angle becomes excessive, but it has been found that when the cross angle is not more than 1.5°, there is no problem in the quality but when it exceeds this value, the sheet passing property is degraded due to the center buckle shape.

From the above results, the crown quantity of the hot rolled steel strip can be put within ±40 μm by controlling the cross angle to not less than 0.2°, more preferably 0.4°~1.5°. When the crown quantity exceeds +40 μm to form a large convex crown, the convex crown is held even after the cold rolling and also a poor shape of largely elongating the widthwise central portion as compared with the end portion or so-called "center buckle" is caused and the high-speed passing becomes difficult in the continuous annealing. On the other hand, when it forms a large concave crown exceeding −40 μm, the concave crown is held even after the cold rolling and also the poor shape opposite to the above phenomenon of largely elongating the widthwise end portions or so-called "edge wave" is caused and the high-speed passing become difficult in the continuous annealing. Moreover, it is difficult to correct the poor shape of the center buckle and edge wave and such strips can not be used in the high-speed can formation and is rejected to lower the yield.

As mentioned above, the crown can be improved by rendering the hot rolling mill into the pair-cross rolls. In order to effectively utilize this system, it is required to be applied to at least 3 stands and also it has been confirmed that there is caused no problem even when this system is applied to all stands.

Further, in order to solve ununiformity of shape and material properties (structure) due to the lowering of the temperature at the widthwise end portion usually and necessarily produced in the hot rolling, it is effective to heat the widthwise end portion by means of an edge heater (concretely the temperature of the widthwise end portion is set to 50–110° C. higher than that of the central portion and then heated). By combining with the aforementioned rolling method, there can be obtained extremely-thin hot rolled steel strip having uniform thickness and material properties in which the crown of ±40 μm is existent over 95% of a full width. In this case, U.S. Pat. No. 5,531,089 is advantageously adaptable as a method of controlling the sheet crown.

The role of the edge heater will be described. In the environment of the hot rolling are mixedly existent working heat, recovered heat, water cooling, air cooling and the like under conditions that portions other than heating furnace are exposed to air and are high in the temperature and it is obliged to conduct the rolling while removing surface scale produced in the rolling through spraying of a high pressure water and further the working is carried out at a high reduction quantity from slab of about 260 mm in thickness to 2 mm in thickness as in the invention and the like.

Therefore, when the treating time in the hot rolling becomes long, the temperature difference in full widthwise direction and full longitudinal direction is large and the material properties become ununiform. On the other hand, the thickness of cast slab becomes large with the advance of continuous casting technique and hence the slab width to be required becomes large. Furthermore, in order to mitigate loading of the cold rolling accompanied with the provision of high strength, wide width and extremely-thin thickness in the steel sheet for can, it is required to use hot rolled steel strip having thinner thickness and it tends to make the temperature difference of the hot rolling large.

As a result, the crystal grain size in the end portion in which the finish rolling temperature is largely lowered is coarsened as compared with the central portion and also the texture unsuitable for deep drawing work develops. Particularly, the dropping of the temperature in the side end zones of succeeding portion in the rolling direction having a long waiting time before rough rolling mill is large and hence the temperature dropping even at the finish rolling mill becomes large.

As a countermeasure, it has been attempted to take means for accelerating the rolling rate to increase work heat for heat compensation and the like, but these means were insufficient in the production of extremely-thin and wide-width steel sheet for can.

On the contrary, the inventors have confirmed that the above problem can be solved when soaking may be conducted before the finish rolling mill corresponding to middle of hot rolling step and practical use is attained.

Moreover, it is necessary that the finish rolling temperature (FDT) is a usual range or not lower than 860° C. and the coiling temperature (CT) is not lower than 550° C. for conducting the sufficient recrystallization. However, when CT is too high, the surface scale layer of the steel sheet becomes thick and hence the descaling property through pickling at subsequent step is degraded, so that the upper limit is favorable to be 750° C.

Then, when using a simply flat work roll usually practiced in cold rolling step, the effect of improving the crown of the hot rolled steel strip as mentioned above is lost by the edge drop produced in the cold rolling but also there is a possibility of largely degrading it. As to such a phenomenon, it has been confirmed that the sheet crown control in the cold rolling is effective for producing extremely-thin and wide-width steel sheet for can having a more desirable quality.

In FIG. 3 are shown results examined on an optimum cold rolling method by the inventors. That is, FIG. 3 shows results measured when the widthwise thickness of extremely-thin and wide^width steel sheet (thickness: 0.130 mm, width: 1250 mm) rolled by changing a combination of hot rolling method and a cold rolling method is opposed to the widthwise direction of the hot rolled steel strip.

As shown in FIG. 3, the thickness can be uniformized by using pair-cross rolls in the finish rolling mill for hot rolling and a cross shift mill for cold rolling in at least one stand of a front stage. In this case, it is preferable to use a one-side trapezoidal work roll as a work roll in the cross shift mill for cold rolling. Moreover, it has been found that there is no problem even when such a sold rolling method is applied to plural stands.

In this way, the edge drop in the hot rolled steel strip is made small and then the thickness of widthwise end portion can be previously thickened at the front stage so as not to cause edge drop in the cold rolling, and hence subsequent horizontal rolling can be conducted.

Even in the combination of hot rolling and cold rolling as mentioned above, a simple one-side trapezoidal work roll can not continuously cope with different widths. This problem could be solved by shifting the work roll to a barrel direction.

In FIG. 4 are shown the results. FIG. 4 shows results investigated on the influence of cross angles of hot rolling method (use of 0.6° pair-cross rolls or conventional 0° roll in all stands of the finish rolling mill) and the cold rolling upon crown (thickness in widthwise central portion of the steel strip—thickness corresponding to a position of 10 mm from widthwise end of the hot rolled steel strip), flatness, sheet passing property of the cold rolled steel strip.

As shown in FIG. 4, it has been found that in order to produce the cold rolled steel strip from the hot rolled steel strip finished in the cross rolls while maintaining the flatness, it is very effective to use cross rolls even in the cold rolling mill.

It is possible to rationally produce extremely-thin and wide-width steel sheets for can having excellent distributions of thickness in widthwise direction and material properties and various sizes by adopting the aforementioned producing conditions.

Moreover, when the flatness after the cold rolling is poor even if the hot rolled steel strip having a high thickness accuracy is produced, it is difficult to pass at a high speed in the continuous annealing and also it can not be used in view of the quality as the steel sheet for can. Therefore, in order to obtain the cold rolled steel strip having a high thickness accuracy and an excellent flatness by using the hot rolled steel strip having a small crown, it is favorable that the small crown is finished even in the work roll of the cold rolling mill because the similar section rolling is basic. If the rolling reduction is relatively large, the widthwise end portion is elongated, while if the rolling reduction is small, the widthwise central portion is elongated. That is, if the cross rolls are used in the hot rolling mill as shown in FIG. 4, it is favorable to use the cross rolls in the cold rolling mill.

In FIG. 5 is shown results investigated on the influence of the flatness upon CAL passing speed and breaking trouble of steel strip in relation to thickness and width of the steel strip. As seen from FIG. 5, the frequency of causing breakage in the high-speed passing becomes large as the thickness becomes thin and the width becomes large. However, if the flatness is improved, the risk of breakage can be avoided.

In the invention, the annealing and temper rolling are fundamentally carried out after the cold rolling. When the annealing is carried out by continuous annealing, an averaging treatment may be conducted under conditions in accordance with usual manner, concretely 400–600° C. and 20–3 minutes. Moreover, in the applications that the sheet is rendered into a cylinder by welding and then enlarged to conduct deformation for can, the very severe aging resistance is required. In such applications, the coil may be subjected to box annealing after the continuous annealing.

However, in steels containing C≦0.002%, if the recrystallization after the hot finish rolling is sufficient, it is possible to omit the annealing and temper rolling after the cold rolling. In this case, the recrystallization after the hot finish rolling can be realized by coiling above 650° C., preferably above 700° C. to conduct self-annealing, but the hot rolled sheet may be annealed by reheating to 550–600° C. after the coiling. In case of the reheating and annealing, the coiling temperature is not particularly restricted but it is favorable to be not lower than 550° C. from a viewpoint of the productivity.

Moreover, in case of omitting the annealing and temper rolling after the cold rolling, the sheet may be subjected to a heat treatment (recovery treatment) heating and holding at 200–400° C. for not less than 10 seconds after the cold rolling in order to compensate the lowering of the workability such as elongation flange property or the like. The reason why the upper limit is 400° C. is to prevent the lacking of strength through recrystallization. Such a heating treatment may be carried out before a plating treatment and a chromate treatment, or it is possible to simultaneously conduct with a paint baking or laminating step in the can formation line after these treatments.

In order to provide temper grades of T1–T6, DR8–DR10 from low-carbon and extremely-low carbon steels (including Fe—Ni alloy layer in its surface layer as mentioned later) finished by the continuous annealing, temper rolling may be carried out at a rolling reduction properly selected within a range of several %—40%.

According to the method mentioned above, there can be produced cold rolled steel strip having excellent thickness distribution and hardness distribution in the widthwise direction and adjusted to a desirable temper grade. When the surface of the cold rolled steel strip is subjected to a plating of Sn, Cr, Ni or the like and, if necessary, to chromate treatment, there can be produced extremely-thin and wide-width surface-treated steel sheets having excellent rust resistance and corrosion resistance. In case of tin plating, reflow treatment may be carried out after the plating and before the chromate treatment, if necessary. Moreover, in case of producing a convex-shaped tin plated steel sheet, it is required to previously form Fe—Ni alloy layer having a weight ratio of Ni/(Ni+Fe) of 0.01–0.3 and a thickness of 10–4000 Å before the plating.

These surface treatments will be described below.

The inventors have made investigations with respect to the weldability of LTS for high-speed seam-welded can and found that a remaining metallic tin quantity just before the welding considerably improves the weldability.

That is, the metallic tin is soft and a low melting point metal (232° C.), so that it is easily deformed or further fused by a welding pressure force in a contact portion with a welding electrode or a contact portion between the steel sheets to enlarge the contact area, whereby a strong welded nugget is easily formed without generating "expulsion and surface flash" caused by local concentration of welding current. As a result, an adequate welding current range becomes wide.

In order to obtain such an effect, it has been found that the remaining metallic tin quantity just before the welding is preferably not less than 0.05 ($g/m^2$). As a result of further investigations, it has been found that an area percentage of the convex portion is favorably 10–70%.

Moreover, when the conventional tin-plated blackplate is subjected to a plating having a decreased quantity of expensive tin, the metallic tin is considerably reduced from a side of base matrix through Fn—Se alloying by heat treatments such as reflow treatment, painting-printing baking and the like until the welding, and as a result, the weldability is lowered but also so-called metallic tone printing utilizing the gloss of the metallic tin can not be attained.

In order to render the metallic tin layer into a convex shape (land shape), it has been found that it is effective to use a steel sheet subjected to Ni diffusion treatment as an inactivation treatment to wetting of fused tin at its surface as a steel sheet for tin plating. That is, Fe—Ni alloy layer having a weight ratio of Ni/(Fe+Ni) of 0.01–0.3 and a thickness of 10–4000 Å is formed by subjecting at least one-side surface of the steel sheet to Ni plating at a plating quantity of 0.02–0.5 $g/m^2$ and to diffusion treatment annealing.

The formation of convex-shaped tin plated layer using such Ni diffusion treated steel sheet can be attained by subjecting a surface of the base matrix after the diffusion treatment to a flat electric tin plating and further to a reflow treatment to agglomerate and aggregate tin. Further, it has been found that the convex shape can more effectively be formed by conducting the reflow treatment after a flux (aqueous solution of $ZnCl_2$, $NH_4Cl$ or the like) is applied onto the surface after the electric tin plating.

In FIG. 6 is shown a typical example of tin distribution in the convex-shaped tin plated layer as SEM image (1000 magnification) through EPMA analysis. A white portion in FIG. 6 corresponds to the convex portion and a black portion corresponds to a concave portion of flat Fe—Sn alloy layer. FIG. 6(a) is a case of fine convex portion, and (b) is a case of relatively large convex portion. Such a size of the convex portion can be controlled by voltage between current flowing rolls at the reflow treating step, current flowing time, cooling rate up to water cooling after fusion, tin plated quantity and the like.

Moreover, the convex-shaped metal tin layer can more effectively be formed by the reflow treatment after the flux (aqueous solution of $ZnCl_2$, $NH_4Cl$ or the like) is applied onto the surface after the electric tin plating.

In order most effectively conduct the above Ni diffusion treatment, it is favorable that Ni plating equipment is arranged before the continuous annealing line and a temper rolling equipment is arranged at a delivery side of the annealing line. Thus, Ni plating, annealing and temper rolling are connected as a single line to finish into a base matrix at once, whereby it is possible to largely reduce the cost by continuity. Furthermore, the steps of Ni plating→annealing→temper rolling can continuously be carried out without stopping time and hence the formation of Fe oxide or the like can be prevented and the effect of improving the weldability and corrosion resistance becomes more larger.

The continuous annealing method according to the invention is less in the surface concentration of impurity as compared with the box annealing method, so that it is advantageous in view of the rust resistance and corrosion resistance. And also, this method is possible to be used together with the reheating recrystallization treatment in the continuous annealing line of the hot rolled steel strip.

As the surface treatment, when the chromate treatment is carried out after the usual tin plating, the tin plated layer contains a metallic Sn quantity of 0.56–11.2 g/m$^2$, and the chromate layer contains a chromium hydrated oxide of 1–30 mg/m$^2$ as converted into Cr and a metallic Cr of 1–30 mg/m$^2$.

When the tin quantity is less than 0.56 g/m$^2$, Fe—Sn alloying is promoted by the reflow treatment or the baking after the painting and printing to considerably decrease the remaining metallic Sn quantity just before the welding. On the other hand, when it exceeds 11.2 g/m$^2$, the remaining metallic Sn quantity just before the welding is too large and heat generation is consumed by dissolution of Sn through electric-resistant heating seam welding and the dissolution of Fe is not sufficiently promoted and the satisfactory joint strength is not obtained and hence it is obliged to uneconomically drop down the welding rate. Further, Sn is an expensive and finite resource.

When the chromium hydrated oxide in the chromate layer is less than 1 mg/m$^2$ as converted into Cr, the paint adhering force and print adhering force of sheet coat are small, or the film adhesion force is not sufficiently increase. While, when it exceeds 30 mg/m$^2$, the current flowing property is poor and the weldability lowers.

Further, when the metallic Cr is less than 1 mg/m$^2$, the adhesion property of painted film, printed film to the film lowers and also the corrosion resistance and rust resistance lower. While, when it exceeds 30 mg/m$^2$, cracks are caused in the metallic Cr film in the can formation due to the super-hardness of the metallic Cr to inversely degrade the adhesion property.

When the chromate treatment is carried out as the surface treatment, the metallic Cr of 30–150 mg/m$^2$ is formed, and thereafter chromium hydrated oxide layer is formed thereon at a finishing quantity of 1–30 mg/m$^2$ as converted into Cr.

When the metallic Cr quantity in the chromium plated layer is less than 30 mg/m$^2$, the Cr covering property is insufficient and the corrosion resistance and rust resistance as a food can are insufficient. While, when it exceeds 150 mg/m$^2$, the can forming workability is degraded. Further, when the chromium hydrated oxide is less than 1 mg/m$^2$ as converted into Cr, the adhesion force of painted film, printed film to the film is not sufficiently increased, while when it exceeds 30 mg/m$^2$, the can forming workability is degraded.

As the surface treatment, the surface of the Fe—Sn alloy layer is subjected to a tin plating and to the reflow treatment (usually charged into a water tank of 50–80° C. within 1 second after temperature is raised to 230–280° C.) to form a tin plated layer having many convex portions in its surface at a convex area ratio of 10–70% and then the chromate treatment may be conducted.

In this case, the tin played layer contains a metallic Sn quantity of 0.56–5.6 g/m$^2$, and the chromate layer contains a chromium hydrated oxide of 1–30 mg/m$^2$ as converted into Cr and a metallic Cr of 1–30 mg/m$^2$.

When the Sn quantity is less than 0.56 g/m$^2$, the Fe—Sn alloying is promoted by the reflow treatment or the baking after the painting or printing to considerably decrease the remaining metallic Sn quantity just before the welding. While when it exceeds 5.6 g/m$^2$, the metallic Sn quantity is too large and the land-shaped tin can not be formed even if it is subjected to the reflow treatment and hence flat or simple uneven shape is formed and the economic signification is lost. Further, the reason of limiting the composition of the chromate layer is similar to the case of being subjected to the usual tin plating.

Moreover, the reason why the convex area ratio of the convex-shaped tin plating obtained by the reflow treatment is limited to 10–70% is due to the fact that the effect of widening the contact area in the welding is insufficient at less than 10% and the effect of improving the weldability is not obtained and the economic signification of convex formation is lost at more than 70%.

And also, the reason why the weight ratio of Ni/(Fe+Ni) and the thickness in Fe—Ni alloy layer are limited to 0.01–0.3 and 10–4000 Å is due to the fact that when the weight ratio of Ni/(Fe+Ni) is less than 0.01, the effect of improving the corrosion resistance and rust resistance is not obtained, while when it exceeds 0.3, the Fe—Sn—Ni alloy layer after the reflow treatment becomes coarse and the covering ratio becomes small to degrade the corrosion resistance and rust resistance. And also, when the thickness is less than 10 Å, the effect of improving the corrosion resistance and rust resistance is small, while when it exceeds 4000 Å, cracks are created in the hard and brittle Fe—Ni alloy to degrade the corrosion resistance and rust resistance.

BRIEF DESCRIPTION OF THE DRAWINGS

FIG. 4 is a graph showing influences of pair-cross hot finish rolling and cross shift cold rolling upon crown and flatness of a cold rolled steel strip.

FIG. 5 is a graph showing influences of thickness and flatness of a cold rolled strip upon a high-speed sheet passing property in continuous annealing.

PREFERRED EMBODIMENTS OF THE INVENTION

EXAMPLE 1

Figure 1:
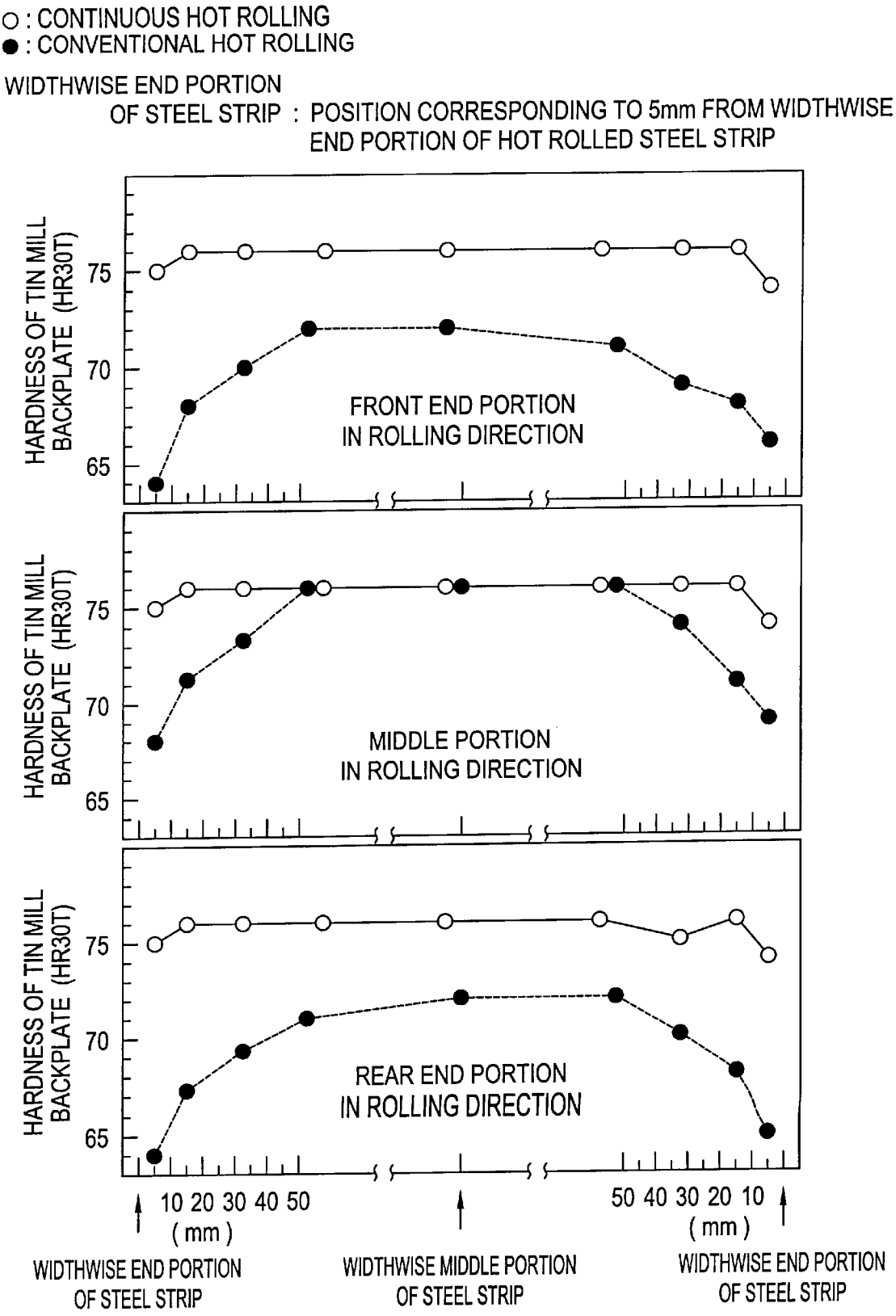
FIG. 1 is a graph showing an influence of a hot finish rolling method upon a hardness (HR30T) distribution of a cold rolled steel strip.
Figure 2:
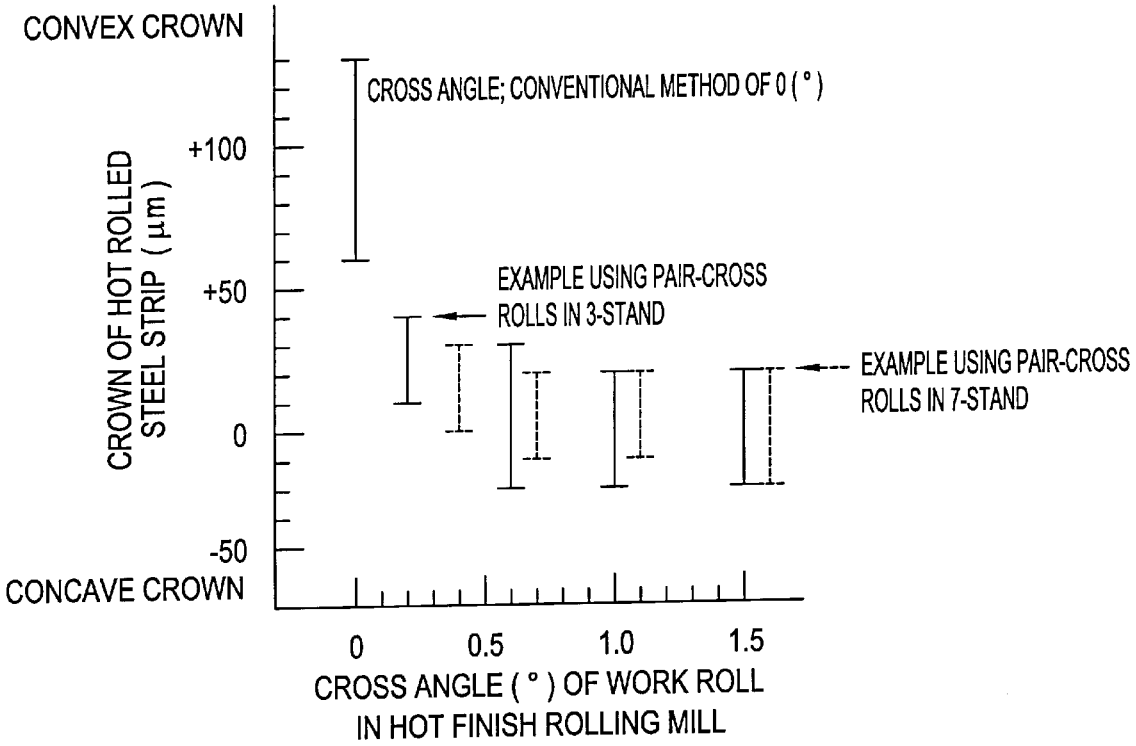
FIG. 2 is a graph showing an influence of a cross angle of a work roll in a hot finish rolling mill upon a crown of a hot rolled steel strip.
Figure 3:
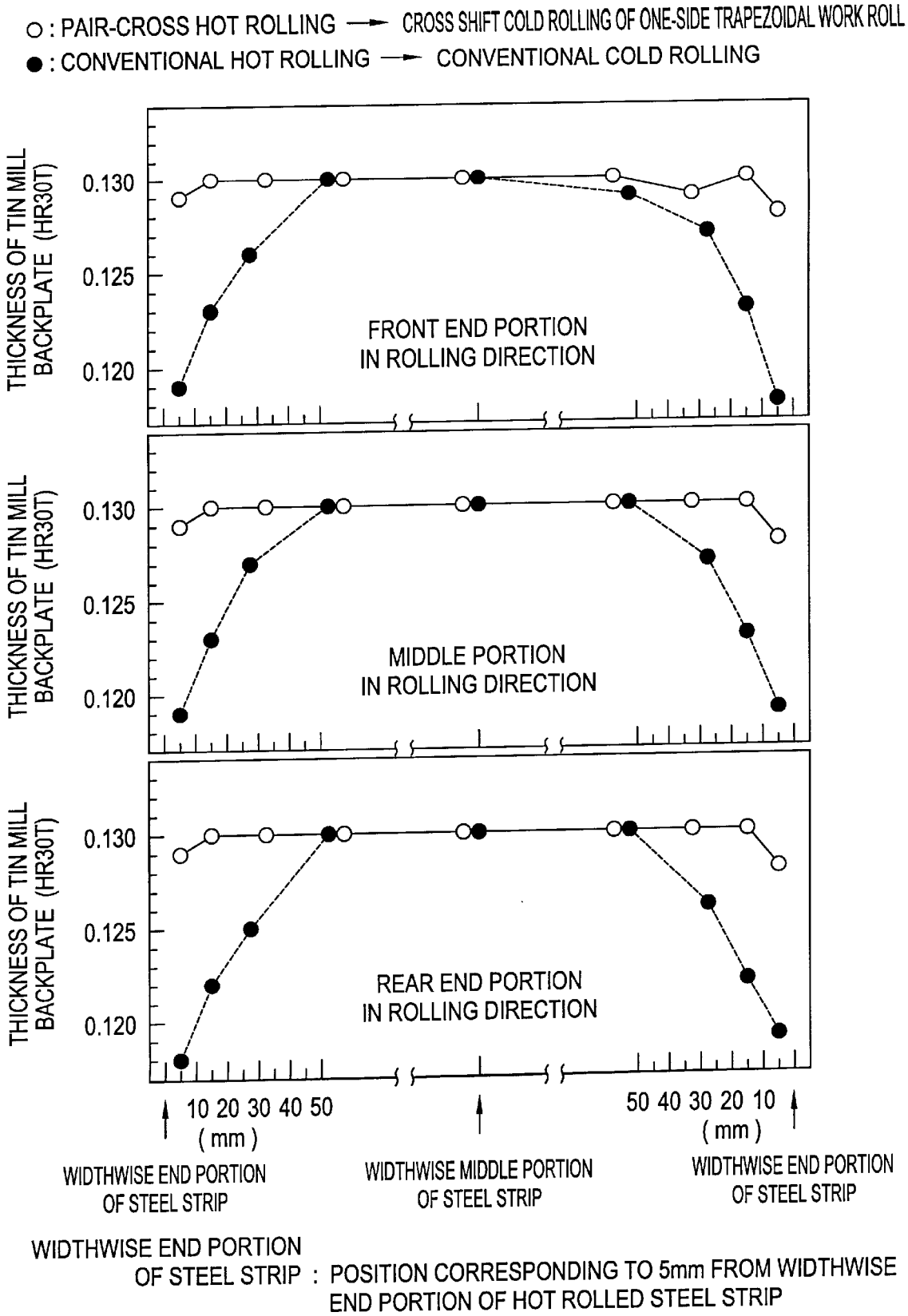
FIG. 3 is a graph showing influences of hot rolling method and cold rolling method upon a thickness distribution of a cold rolled steel strip.
Figure 6A:
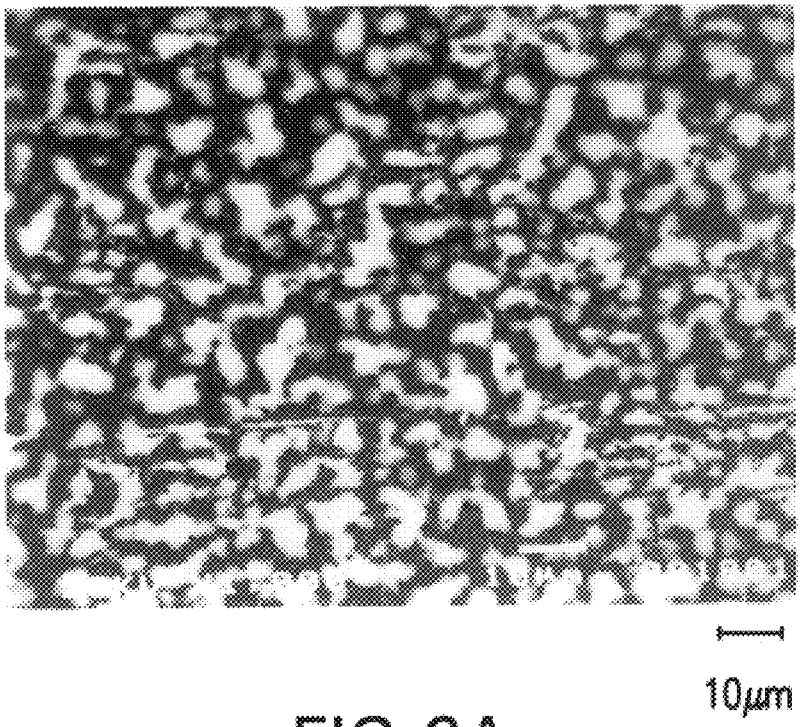
FIGS. 6A and 6B is a microphotograph of a metal structure showing SEM image of land-shaped tin.
Figure 6B:
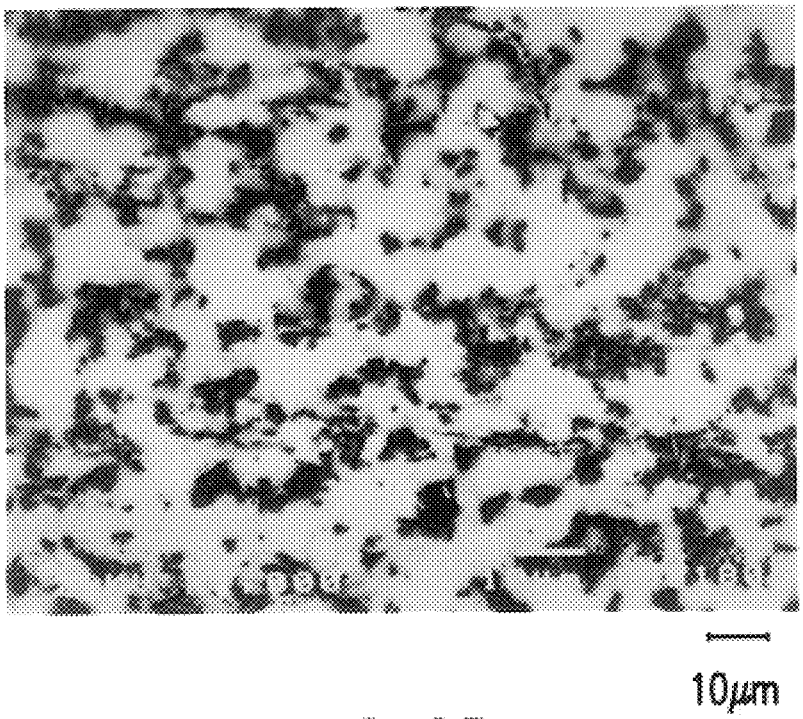

Steel having a chemical composition shown in Table 1 was melted in a bottom-blowing converter of 270t and cast by means of a continuous casting machine to obtain a cast slab.

These cast slabs were rough rolled and th e resulting sheet bars were joined to a preceding sheet bar and heated at their widthwise end portio by means of a of an edge heater and continuously rolled by means of a hot finish rolling mill using pair-cross rolls with a changed cross angle at front 3 stands or all 7 stands to form an extremely-thin hot rolled steel strip having a width of 950–1300 mm, which was coiled. Thereafter, it was pickled, descaled and then rolled in a 6 stand tandem continuously cold rolling mill including a cross shift machine using a one-side trapezoidal work roll as a work roll of No. 1 stand to obtain an extremely-thin cold rolled steel strip.

For the comparison, the cast slab was subjected to a hot finish rolling (single rolling) at the conventional cast slab unit and further to a cold rolling not using a pair cross machine and a cross shift machine with a one-side trapezoidal work roll.

The above producing conditions are shown in Table 2 and Table 3.

Moreover, a part of the cold rolled steel strips was subjected to Ni plating and continuously annealed likewise the other cold rolled steel strips (Ni plating material corresponded to Ni diffusion treatment). The annealing conditions of the diffusion treatment were 660–690° C. and 10 seconds. Subsequently, steel sheets having various temper grades were produced by adjusting a rolling reduction of temper rolling.

TABLE 1

| | Chemical composition (wt %) | | | | | | | | | | | | |
|---|---|---|---|---|---|---|---|---|---|---|---|---|---|
| No. | C | Si | Mn | P | S | Al | N | O | Ca | Cu | Ni | Cr | Mo |
| 1 | 0.050 | 0.02 | 0.14 | 0.018 | 0.013 | 0.054 | 0.0091 | 0.0037 | 0.001 | 0.002 | 0.01 | 0.01 | 0.001 |
| 2 | 0.072 | 0.02 | 0.18 | 0.012 | 0.017 | 0.032 | 0.0032 | 0.0021 | 0.001 | 0.001 | 0.02 | 0.01 | 0.001 |
| 3 | 0.090 | 0.02 | 0.16 | 0.016 | 0.014 | 0.053 | 0.0038 | 0.0040 | 0.001 | 0.001 | 0.01 | 0.03 | 0.001 |
| 4 | 0.033 | 0.03 | 0.38 | 0.012 | 0.006 | 0.044 | 0.0019 | 0.0025 | 0.003 | 0.010 | 0.03 | 0.13 | 0.010 |
| 5 | 0.050 | 0.02 | 0.15 | 0.006 | 0.019 | 0.056 | 0.0120 | 0.0100 | 0.002 | 0.210 | 0.27 | 0.24 | 0.210 |
| 6 | 0.078 | 0.03 | 0.08 | 0.012 | 0.014 | 0.158 | 0.0030 | 0.0032 | 0.001 | 0.420 | 0.38 | 0.39 | 0 420 |
| 7 | 0.066 | 0.04 | 0.65 | 0.616 | 0.015 | 0.082 | 0.0196 | 0.0011 | 0.007 | 0.680 | 0.72 | 0.71 | 0.630 |
| 3 | 0.080 | 0.04 | 0.70 | 0.016 | 0.015 | 0.084 | 0.0096 | 0.0021 | 0.004 | 0.544 | 0.64 | 0.58 | 0.520 |
| 9 | 0.012 | 0.04 | 0.73 | 0.022 | 0.011 | 0.114 | 0.0065 | 0.0008 | 0.002 | 0.410 | 0.37 | 0.53 | 0.510 |
| 10 | 0.070 | 0.03 | 0.65 | 0.027 | 0.009 | 0.108 | 0.0112 | 0.0005 | 0.008 | 0.520 | 0.59 | 0.56 | 0.520 |
| 11 | 0.090 | 0.03 | 0.70 | 0.024 | 0.005 | 0.107 | 0.0073 | 0.0009 | 0.004 | 0.007 | 0.07 | 0.04 | 0.003 |
| 12 | 0.011 | 0.03 | 0.64 | 0.024 | 0.005 | 0.215 | 0.0169 | 0.004I | 0.006 | 0.006 | 0.05 | 0.05 | 0.006 |

TABLE 2

| | | Hot rolling conditions | | | | | | | | |
|---|---|---|---|---|---|---|---|---|---|---|
| | | | sheet bar | finish rolling mill | | | | shape of hot rolled steel sheet | | |
| No. | Remarks | rolling system | edge heater | stand using pair-cross | pair-cross angle (°) | FDT (° C.) | CT (° C.) | thickness (mm) | width (mm) | crown (μm) |
| 1 | Inven- | | | 1, 2, 3 | 0.2 | 940 | 560 | 1.8 | 1300 | +35 |
| 2 | tion | | | 1, 2, 3 | 0.4 | 890 | 600 | 1.6 | 1200 | +21 |
| 3 | Example | contin- | used | 1, 2, 3 | 0.8 | 860 | 650 | 1.4 | 1200 | +5 |
| 4 | | uous | | all stands | 1.0 | 930 | 580 | 1.0 | 1100 | −10 |
| 5 | | rolling | | all stands | 1.2 | 880 | 650 | 0.8 | 1100 | −20 |
| 6 | | | | all stands | 1.2 | 860 | 720 | 0.6 | 990 | −30 |
| 7 | Compara- | | | 1, 2, 3 | 0.1 | 940 | 560 | 2.2 | 1100 | +50 |
| 8 | tive | | | 1, 2 | 0.1 | 890 | 600 | 2.2 | 1100 | +55 |
| 9 | Example | single | not | not used | — | 860 | 650 | 2.2 | 1100 | +60 |
| 10 | | rolling | used | not used | — | 930 | 580 | 2.1 | 1100 | +71 |
| 11 | | | | not used | — | 880 | 650 | 2.1 | 1100 | +90 |
| 12 | | | | not used | — | 860 | 720 | 2.1 | 1100 | +106 |

TABLE 3

| | | Continuous cold rolling conditions | | | | | Continuous annealing/ Ni diffusion treatment | | | | Temper rolling | |
|---|---|---|---|---|---|---|---|---|---|---|---|---|
| No. | Remarks | one-side trapezodial work roll · cross angle of cross shift machine (°) | thickness at entry side (mm) | thickness at delivery side (mm) | cold rolling reduction (%) | width (mm) | Ni plating (g/m²) | annealing temperature (° C.) | weight ratio of Ni/(Ni + Fe) | thickness of Fe + Ni alloy (Å) | thickness at delivery side (mm) | rolling reduction (%) |
| 1 | Inven- | 0.2 | 1.8 | 0.182 | 89.9 | 1300 | — | 680 | — | — | 0.180 | 1 |
| 2 | tion | 0.4 | 1.6 | 0.162 | 89.9 | 1200 | — | 680 | — | — | 0.160 | 1 |
| 3 | Example | 0.6 | 1.4 | 0.133 | 90.5 | 1200 | 0.07 | 660 | 0.30 | 1000 | 0.130 | 2 |
| 4 | | 0.8 | 1.0 | 0.125 | 87.5 | 1100 | 0.07 | 690 | 0.05 | 1000 | 0.100 | 20 |
| 5 | | 0.8 | 0.8 | 0.107 | 86.6 | 1100 | 0.07 | 670 | 0.26 | 1000 | 0.080 | 25 |
| 6 | | 0.8 | 0.6 | 0.086 | 85.7 | 990 | — | 660 | — | — | 0.060 | 30 |
| 7 | Compara- | not used | 2.2 | 0.182 | 91.7 | 1100 | — | 690 | — | — | 0.180 | 1 |
| 8 | tive | not used | 2.2 | 0.162 | 92.6 | 1100 | — | 680 | — | — | 0.160 | 1 |
| 9 | Example | not used | 2.2 | 0.133 | 94.0 | 1100 | — | 660 | — | — | 0.130 | 2 |
| 10 | | not used | 2.1 | 0.125 | 94.0 | 1100 | — | 670 | — | — | 0.100 | 20 |
| 11 | | not used | 2.1 | 0.107 | 94.9 | 1100 | — | 660 | — | — | 0.080 | 25 |
| 12 | | not used | 2.1 | 0.086 | 95.9 | 1100 | — | 660 | — | — | 0.060 | 30 |

Moreover, Ni plating bath used and annealing conditions were as follows:

| | |
|---|---|
| Ni plating bath Composition: | |
| nickel sulfate | 250 g/l |
| nickel chloride | 45 g/l |
| boric acid | 30 g/l |
| Bath temperature | 65° C. |
| Current density | 5 A/dm$^2$ |
| Annealing conditions Atmosphere: | |
| NHX gas atmosphere | (10% $H_2$ + 90% $N_2$) |

A test specimen was taken out from the thus treated steel sheet to measure hardness (HR30T) distribution and thickness (mm) distribution in the widthwise direction.

Further, Ni plated quantity, and ratio of Ni/(Ni+Fe) in a surface layer were measured by the following methods with respect to the test specimen subjected to the Ni diffusion treatment.

Ni plated quantity: measured by using a fluorescent X-ray

Ni/(Ni+Fe) ratio: measured as weight ratio in depth direction by using GDS

These measure results are shown in Tables 4~6.

TABLE 4

| | | Thickness distribution (mm) | | | | | Distribution of hardness (HR30T) of tin mill blackplate | | | | |
|---|---|---|---|---|---|---|---|---|---|---|---|
| | | hot rolled steel strip | | cold rolled steel strip | | | | | position of front end of hot rolled steel strip | | |
| No. | Remarks | middle portion | 25 mm from width-wise end | middle portion | position of 10 mm from widthwise end of hot rolled steel strip | region within ±4% of average thick-ness | temper grade | aver-age hard-ness | of 5 mm from width-wise end | width-wise middle position | region of vari-ation quantity ≦±3 (%) |
| 1 | Inven- | 1.8 | 1.79 | 0.180 | 0.179 | 96 | T4 | 61 | 60 | 61 | 99 |
| 2 | tion | 1.6 | 1.58 | 0.160 | 0.158 | 97 | T5 | 65 | 64 | 65 | 98 |
| 3 | Example | 1.4 | 1.37 | 0.130 | 0.128 | 98 | T6 | 70 | 70 | 70 | 99 |
| 4 | | 1.0 | 0.98 | 0.100 | 0.100 | 98 | DR8 | 73 | 72 | 73 | 98 |
| 5 | | 0.8 | 0.81 | 0.080 | 0.081 | 99 | DR9 | 76 | 74 | 76 | 98 |
| 6 | | 0.6 | 0.62 | 0.060 | 0.062 | 99 | DR10 | 80 | 79 | 80 | 99 |
| 7 | Compara- | 2.2 | 2.10 | 0.180 | 0.161 | 84 | T5 | 65 | 56 | 63 | 84 |
| 8 | tive | 2.2 | 2.09 | 0.160 | 0.150 | 83 | T6 | 70 | 60 | 68 | 81 |
| 9 | Example | 2.2 | 2.07 | 0.130 | 0.121 | 81 | DR8 | 73 | 63 | 73 | 78 |
| 10 | | 2.1 | 1.90 | 0.100 | 0.088 | 79 | DR10 | 80 | 69 | 82 | 84 |
| 11 | | 2.1 | 1.91 | 0.080 | 0.061 | 82 | DR10 | 80 | 71 | 80 | 73 |
| 12 | | 2.1 | 1.87 | 0.060 | 0.042 | 83 | DR10 | 80 | 75 | 84 | 71 |

| | | Distribution of hardness (HR30T) of tin mill blackplate | | | | | |
|---|---|---|---|---|---|---|---|
| | | position of middle portion of hot rolled steel strip | | | position of rear end of hot rolled steel strip | | |
| No. | Remarks | position of 5 mm from width-wise end | width-wise middle position | region of vari-ation quantity ≦±3 (%) | position of 5 mm from width-wise end | width-wise middle position | region of vari-ation quantity ≦±3 (%) |
| 1 | Inven- | 60 | 61 | 99 | 59 | 61 | 98 |
| 2 | tion | 64 | 65 | 99 | 63 | 65 | 98 |
| 3 | Example | 70 | 70 | 99 | 70 | 70 | 98 |
| 4 | | 72 | 73 | 99 | 71 | 73 | 98 |
| 5 | | 75 | 76 | 98 | 74 | 76 | 98 |
| 6 | | 79 | 80 | 99 | 79 | 80 | 99 |
| 7 | Compara- | 60 | 66 | 85 | 53 | 62 | 82 |
| 8 | tive | 63 | 70 | 83 | 59 | 67 | 78 |
| 9 | Example | 66 | 75 | 79 | 62 | 71 | 77 |
| 10 | | 72 | 80 | 86 | 67 | 81 | 81 |
| 11 | | 75 | 84 | 79 | 70 | 80 | 71 |
| 12 | | 78 | 85 | 78 | 72 | 82 | 70 |

TABLE 5

| No. | Remarks | Flatness of cold rolled steel strip as measured on platen (mm) height of edge wave | height of center buckle | Passing property in continuous annealing passing speed and status (mpm) | Lateral bending of tin plate steel strip and accuracy of adhesion position of film laminate bending per 1 m of lateral bending (mm) | accuracy of adhesion postion |
|---|---|---|---|---|---|---|
| 1 | Inven- | 0 | 0 | 1200 | 0 | Weld cans were produced |
| 2 | tion | 0 | 0 | 1100 | 0 | in a high rate because |
| 3 | Example | 0 | 0 | 1050 | 0 | film was adhered with a |
| 4 | | 0 | 0 | 1000 | 0 | good accuracy |
| 5 | | 0 | 0 | 950 | 0 | |
| 6 | | 0 | 0 | 850 | 0 | |
| 7 | Compara- | 1 | 4 | 450 | 0.1 | Welding could not be |
| 8 | tive | 1 | 3 | 400 | 0.4 | conducted because film |
| 9 | Example | 4 | 2 | 300 | 0.7 | remained in weld can · |
| 10 | | 4 | 3 | 300 } partly | 0.0 | weld portion |
| 11 | | 6 | 1 | 300 } breakage | 1 | |
| 12 | | 7 | 1 | 300 } | 1 | |

TABLE 6

| No. | Remarks | Can formability fruiting property of 3-piece can | ragging resistance of wall in 2-piece can | Corrosion resistance and high-speed weldability of painted steel sheet kind | corrosion resistance evalu-ation | corroded state | high-speed weldability | Total evalu-ation |
|---|---|---|---|---|---|---|---|---|
| 1 | Inven- | ○ | ○ | tin plate | ○ | uniform | ○ | ○ |
| 2 | tion | ○ | ○ | tin plate | ○ | uniform | ○ | ○ |
| 3 | Example | ○ | ○ | thin tin plate | ○ | uniform | ○ | ○ |
| 4 | | ○ | ○ | thin tin plate | ○ | uniform | ○ | ○ |
| 5 | | ○ | ○ | thin tin plate | ○ | uniform | ○ | ○ |
| 6 | | ○ | ○ | TFS | ○ | uniform | ○ | ○ |
| 7 | Compara- | X | X | tin plate | X | slightly ununiform | ○ | X |
| 8 | tive | X | X | tin plate | Δ | slightly ununiform | ○ | X |
| 9 | Example | X | X | thin tin plate | Δ | slightly ununiform | X | X |
| 10 | | X | X | thin tin plate | ○ | slightly ununiform | X | X |
| 11 | | X | X | thin tin plate | ○ | uniform | ○ | X |
| 12 | | X | X | TFS | X | ununiform | X | X |

EXAMPLE 2

A cold rolled steel sheet was produced from steel having a chemical composition shown in Table 7 in the same manner as in Example 1. A surface-treated steel sheet was produced by subjecting the surface of the steel sheet to plating and, if necessary, reflow treatment and then to a chromate treatment.

The above producing conditions are shown in Table 8 and Table 9. Moreover, steel No. 2 was subjected to an averaging treatment of 500° C., 30 seconds in the continuous annealing.

The surface treating conditions were as follows.

As the usual tin plating not subjected to Ni diffusion treatment, tin plating or thin tin plating was carried out in a halogen type electric tin plating step, which was continuously subjected to reflow treatment and chromate treatment to obtain tin plate.

A tin-free steel sheet (TFS) was subjected to a plating in a chromate solution containing $CrO_3$: 180 g/l, $H_2SO_4$: 0.8 g/l at a metallic chromium quantity of 30–120 mg/m$^2$ and subsequently to a plating of a chromium hydrated oxide (1–30 mg/m$^2$ as converted into chromium) in a chromate solution containing $CrO_3$: 60 g/l, $H_2SO_4$: 0.2 g/l through an electric plating line.

Furthermore, the sheet subjected to the Ni diffusion treatment was tin plating at a halogen type electric tin plating step and thereafter continuously subjected to the reflow treatment and the chromate treatment to provide a tin plate.

And also, Sn plating bath used and reflow and chromate treating conditions were as follows.

| Sn plating bath | | |
|---|---|---|
| stannous chloride | | 75 g/l |
| sodium fluoride | | 25 g/l |
| potassium hydrogen fluoride | | 50 g/l |
| sodium chloride | | 45 g/l |
| $Sn^{2+}$ | | 36 g/l |
| $Sn^{4+}$ | | 1 g/l |
| pH | | 2.7 |
| bath temperature | | 65° C. |
| current density | | 48 A/dm$^2$ |
| Reflow condition | Heating under current | (280° C.) |
| Chromate solution | chromic anhydride | 15 g/l |
| | sulfuric acid | 0.13 g/l |

Electrolytic treatment on cathode 40° C., 10 A/dm$^2$

As to the steel sheet subjected to the Ni diffusion treatment by the above method prior to the plating, the Ni plated quantity and Ni/(Ni+Fe) ratio in the surface layer were measured by the following methods.

Ni plated quantity: measured by using a fluorescent X-ray

Ni/(Ni+Fe) ratio: measured as weight ratio in depth direction by using GDS

As to the cold rolled steel strips produced by the above method, the flatness and sheet passing property in the continuous annealing were measured.

A test specimen was taken out from the surface-treated steel sheet subjected to plating and chromate treatment to measure hardness (HR30T) distribution and thickness (mm) distribution in the widthwise direction.

Furthermore, the can forming property was examined by the following method. As to 3-piece can, a test for resistance to fruiting was carried out by subjecting to bending work corresponding to the can body. The evaluation of the fruiting test was carried out by classifying the result after the bending work corresponding to the formation of can body into a case that the folding created in the can body is substantially unacceptable as a commercial product and the designed true circle is not obtained and becomes flat (shown by mark X) and a case that the folding is not created (shown by mark ○). On the other hand, the flawing property of can wall was evaluated with respect to 2-piece can and classified into a case that flaw was not observed visually (shown by mark ○) and a case that the flaw was observed and will anticipate the degradation of corrosion resistance (shown by mark X).

With respect to the resulting surface-treated steel sheets, the rust resistance, corrosion resistance, paint adhesion property through T peel test and high-speed weldability were tested according to the following methods. Thread-like rust To the surface of the specimen was applied 60 mg/dm$^2$ of a modified epoxy ester paint (made by Toyo Ink Co., Ltd. F-65DF-102(revised 1)), which was baked under conditions of 160° C.×10 minutes and X-shaped scratch was diagonally formed thereon. The specimen was placed in a dry-wet cycle testing machine and exposed under a condition of repeating a dry state at a temperature of 25° C. and a relative humidity of 50% and a wet state at a temperature of 50° C. and a relative humidity of 98% every 30 minutes. After 2 months, the occurrence of thread-like rust was observed and classified into the following 5 stages in correspondence with the degree of rust.

©: no thread-like corrosion

○: slight thread-like corrosion

Δ: middle thread-like corrosion

X: violent thread-like corrosion

*: considerably violent thread-like corrosion

Corrosion Resistance

To the surface of the specimen was applied 60 mg/dm$^2$ of a modified epoxy ester paint (made by Toyo Ink Co., Ltd. F-65DF-102(revised 1)), which was baked under conditions of 160° C.×10 minutes. 70 ml of tomato juice of 90° C. was hot-packed thereinto.

After this hot pack was left to stand at 55° C. for 10 days and the juice was removed off therefrom, the corroded state was observed and the corrosion resistance was evaluated according to the following standards.

| Number of blisters generated | Corrosion resistance |
|---|---|
| 0~10 blisters | ○ |
| 11–850 blisters | Δ |
| not less than 51 blisters | X |

High-speed Weldability

The painted surface-treated steel sheet was welded by an electric resistant heat-seam welding machine (commercial machine) using a copper wire with a wire diameter of about 1.5 mmϕ at a wire rate of 65 m/min, a welding pressure of 40 kg and a frequency of 600 Hz.

In this case, a difference between an upper current limit causing no scattering (splash) and a lower current limit providing a peel welded strength (sufficient strength was judged when the full length of the weld portion was pulled off by a peel test that the weld portion was peeled from the can body by placing a notch in an end of the weld portion) was evaluated as an adequate welding current range, and a case that the difference was not less than 5 A was judged to be possible to conduct high-speed welding. Furthermore, the judgement was finalized by confirming no occurrence of cracking from the vicinity of the weld portion in the flange-elongated can formation or so-called HAZ (heat affected zone) cracking.

Paint Adhesion Property

To each surface of two specimens was applied 60 mg/dm$^2$ of a modified epoxy ester paint (made by Toyo Ink Co., Ltd. F65DF-102(revised 1)), which was baked under conditions of 160° C.×10 minutes and then adhered under pressure while sandwiching a nylon-12 film of 40 $\mu$m in thickness between the painted surfaces to form a tensile testing specimen.

With respect to such a testing specimen, T-peel test was carried out in a tensile testing machine to measure an adhesion strength as an indication of the paint adhesion property.

Moreover, the convex tin distribution of the convex tin plated steel sheet was measured by an image processing method for an area ratio of convex portion after the SEM image (1000 magnification) through EPMA tin analysis was divided into convex portion and flat portion.

These measured results are shown in Tables 10–12.

TABLE 7

| | Chemical composition (wt %) | | | | | | | | | | | | |
|---|---|---|---|---|---|---|---|---|---|---|---|---|---|
| No. | C | Si | Mn | P | S | Al | N | O | Ca | Cu | Ni | Cr | Mo |
| 1 | 0.051 | 0.01 | 0.13 | 0.010 | 0.014 | 0.053 | 0.0032 | 0.0037 | 0.001 | 0.002 | 0.02 | 0.02 | 0.001 |
| 2 | 0.074 | 0.02 | 0.18 | 0.018 | 0.012 | 0.032 | 0.0019 | 0.0027 | 0.001 | 0.001 | 0.02 | 0.01 | 0.001 |
| 3 | 0.092 | 0.01 | 0.11 | 0.012 | 0.011 | 0.058 | 0.0021 | 0.0018 | 0.001 | 0.001 | 0.01 | 0.03 | 0.001 |

TABLE 7-continued

| | Chemical composition (wt %) | | | | | | | | | | | | |
|---|---|---|---|---|---|---|---|---|---|---|---|---|---|
| No. | C | Si | Mn | P | S | Al | N | O | Ca | Cu | Ni | Cr | Mo |
| 4 | 0.038 | 0.03 | 0.35 | 0.011 | 0.006 | 0.033 | 0.0032 | 0.0022 | 0.002 | 0.010 | 0.03 | 0.13 | 0.010 |
| 5 | 0.051 | 0.02 | 0.15 | 0.006 | 0.014 | 0.110 | 0.0106 | 0.0021 | 0.003 | 0.210 | 0.27 | 0.24 | 0.210 |
| 6 | 0.076 | 0.03 | 0.26 | 0.008 | 0.017 | 0.142 | 0.0091 | 0.0086 | 0.001 | 0.420 | 0.38 | 0.39 | 0.420 |
| 7 | 0.063 | 0.04 | 0.68 | 0.018 | 0.014 | 0.082 | 0.0187 | 0.0012 | 0.008 | 0.650 | 0.76 | 0.72 | 0.611 |
| 8 | 0.080 | 0.05 | 0.77 | 0.016 | 0.015 | 0.084 | 0.0097 | 0.0021 | 0.006 | 0.544 | 0.65 | 0.58 | 0.520 |
| 9 | 0.013 | 0.04 | 0.73 | 0.022 | 0.012 | 0.114 | 0.0060 | 0.0008 | 0.002 | 0.421 | 0.37 | 0.63 | 0.520 |
| 10 | 0.070 | 0.03 | 0.48 | 0.029 | 0.009 | 0.108 | 0.0118 | 0.0005 | 0.008 | 0.520 | 0.59 | 0.56 | 0.520 |
| 11 | 0.090 | 0.03 | 0.70 | 0.024 | 0.005 | 0.108 | 0.0078 | 0.0009 | 0.005 | 0.008 | 0.07 | 0.03 | 0.004 |
| 12 | 0.012 | 0.03 | 0.64 | 0.026 | 0.004 | 0.215 | 0.0123 | 0.0041 | 0.006 | 0.007 | 0.05 | 0.05 | 0.006 |

TABLE 8

| | | Hot rolling conditions | | | | | | | | |
|---|---|---|---|---|---|---|---|---|---|---|
| | | | sheet bar | finish rolling mill | | | | shape of hot rolled steel sheet | | |
| No. | Remarks | rolling system | edge heater | stand using pair-cross | pair-cross angle (°) | FDT (° C.) | CT (° C.) | thickness (mm) | width (mm) | crown (μm) |
| 1 | Inven- | | | 1, 2, 3 | 0.2 | 930 | 580 | 1.8 | 1300 | +32 |
| 2 | tion | | | 1, 2, 3 | 0.4 | 890 | 600 | 1.6 | 1200 | +26 |
| 3 | Example | contin- | used | 1, 2, 3 | 0.8 | 860 | 680 | 1.4 | 1200 | +4 |
| 4 | | uous | | all stands | 1.0 | 940 | 580 | 1.0 | 1100 | −12 |
| 5 | | rolling | | all stands | 1.2 | 880 | 650 | 0.8 | 1100 | −21 |
| 6 | | | | all stands | 1.2 | 880 | 730 | 0.6 | 950 | −33 |
| 7 | Compara- | | | 1, 2, 3 | 0.1 | 930 | 590 | 2.2 | 1100 | +52 |
| 8 | tive | | | 1, 2 | 0.1 | 890 | 600 | 2.2 | 1100 | +58 |
| 9 | Example | single | not | not used | — | 860 | 650 | 2.2 | 1100 | +61 |
| 10 | | rolling | used | not used | — | 940 | 580 | 2.1 | 1100 | +76 |
| 11 | | | | not used | — | 880 | 660 | 2.1 | 1100 | +92 |
| 12 | | | | not used | — | 890 | 720 | 2.1 | 1100 | +110 |

TABLE 9

| | | Continuous cold rolling conditions | | | | | Continuous annealing/ Ni diffusion treatment | | | | Temper rolling | |
|---|---|---|---|---|---|---|---|---|---|---|---|---|
| No. | Remarks | one-side trapezodial work roll · cross angle of cross shift machine (°) | thickness at entry side (mm) | thickness at delivery side (mm) | cold rolling reduction (%) | width (mm) | Ni plating (g/m$^2$) | annealing temperature (° C.) | weight ratio of Ni/(Ni + Fe) | thickness of Fe + Ni alloy (Å) | thickness at delivery side (mm) | rolling reduction (%) |
| 1 | Inven- | 0.2 | 1.8 | 0.182 | 89.9 | 1300 | — | 670 | — | — | 0.180 | 1 |
| 2 | tion | 0.4 | 1.6 | 0.162 | 89.9 | 1200 | — | 680 | — | — | 0.160 | 1 |
| 3 | Example | 0.6 | 1.4 | 0.133 | 90.5 | 1200 | 0.07 | 690 | 0.30 | 1000 | 0.130 | 2 |
| 4 | | 0.8 | 1.0 | 0.125 | 87.5 | 1100 | 0.07 | 660 | 0.05 | 1000 | 0.100 | 20 |
| 5 | | 0.8 | 0.8 | 0.107 | 86.6 | 1100 | 0.07 | 670 | 0.26 | 1000 | 0.080 | 25 |
| 6 | | 0.8 | 0.6 | 0.086 | 85.7 | 990 | — | 680 | — | — | 0.060 | 30 |
| 7 | Compara- | | 2.2 | 0.182 | 91.7 | 1100 | — | 680 | — | — | 0.180 | 1 |
| 8 | tive | | 2.2 | 0.162 | 92.6 | 1100 | — | 660 | — | — | 0.160 | 1 |
| 9 | Example | | 2.2 | 0.133 | 94.0 | 1100 | — | 670 | — | — | 0.130 | 2 |
| 10 | | not used | 2.1 | 0.125 | 94.0 | 1100 | — | 680 | — | — | 0.100 | 20 |
| 11 | | | 2.1 | 0.107 | 94.9 | 1100 | — | 680 | — | — | 0.080 | 25 |
| 12 | | | 2.1 | 0.086 | 95.9 | 1100 | — | 690 | — | — | 0.000 | 30 |

TABLE 10

| | | thickness distribution | | | | | Distribution of hardness (HR30T) of tin mill blackplate | | | | |
|---|---|---|---|---|---|---|---|---|---|---|---|
| | | hot rolled steel strip | | cold rolled steel strip | | | | | position of front end of hot rolled steel strip | | |
| No. | Remarks | middle portion | 25 mm from width-wise end | middle portion | position of 10 mm from widthwise end of hot rolled steel strip | region within ±4% of average thick-ness | temper grade | aver-age hard-ness | of 5 mm from width-wise end | width-wise middle position | region of vari-ation quantity ≦±3 (%) |
| 1 | Inven- | 1.8 | 1.78 | 0.180 | 0.179 | 96 | T4 | 61 | 59 | 61 | 98 |
| 2 | tion | 1.6 | 1.57 | 0.160 | 0.158 | 97 | T5 | 65 | 64 | 65 | 98 |
| 3 | Example | 1.4 | 1.38 | 0.130 | 0.128 | 98 | T6 | 70 | 69 | 70 | 98 |
| 4 | | 1.0 | 0.97 | 0.100 | 0.100 | 99 | DR8 | 73 | 72 | 73 | 98 |
| 5 | | 0.8 | 0.81 | 0.080 | 0.081 | 99 | DR9 | 76 | 74 | 76 | 99 |
| 6 | | 0.6 | 0.62 | 0.060 | 0.062 | 99 | DR10 | 80 | 79 | 80 | 99 |
| 7 | Compara- | 2.2 | 2.11 | 0.180 | 0.162 | 84 | T5 | 65 | 56 | 63 | 85 |
| 8 | tive | 2.2 | 2.08 | 0.160 | 0.151 | 83 | T6 | 70 | 59 | 68 | 80 |
| 9 | Example | 2.2 | 2.06 | 0.130 | 0.123 | 81 | DR8 | 73 | 63 | 73 | 78 |
| 10 | | 2.1 | 1.91 | 0.100 | 0.088 | 79 | DR10 | 80 | 68 | 82 | 83 |
| 11 | | 2.1 | 1.90 | 0.080 | 0.063 | 82 | DR10 | 80 | 76 | 80 | 73 |
| 12 | | 2.1 | 1.86 | 0.060 | 0.041 | 83 | DR10 | 80 | 67 | 84 | 70 |

| | | Distribution of hardness (HR30T) of tin mill blackplate | | | | | |
|---|---|---|---|---|---|---|---|
| | | position of middle portion of hot rolled steel strip | | | position of rear end of hot rolled steel strip | | |
| No. | Remarks | position of 5 mm from width-wise end | width-wise middle position | region of vari-ation quantity ≦±3 (%) | position of 5 mm from width-wise end | width-wise middle position | region of vari-ation quantity ≦±3 (%) |
| 1 | Inven- | 60 | 61 | 99 | 58 | 61 | 99 |
| 2 | tion | 64 | 65 | 99 | 63 | 65 | 98 |
| 3 | Example | 70 | 70 | 99 | 69 | 70 | 98 |
| 4 | | 72 | 73 | 99 | 71 | 73 | 98 |
| 5 | | 75 | 76 | 98 | 74 | 76 | 98 |
| 6 | | 79 | 80 | 99 | 78 | 80 | 98 |
| 7 | Compara- | 58 | 66 | 87 | 56 | 62 | 81 |
| 8 | tive | 61 | 70 | 80 | 59 | 67 | 78 |
| 9 | Example | 66 | 75 | 79 | 60 | 71 | 75 |
| 10 | | 75 | 80 | 84 | 67 | 81 | 81 |
| 11 | | 76 | 84 | 79 | 74 | 80 | 70 |
| 12 | | 76 | 85 | 76 | 66 | 82 | 72 |

TABLE 11

| | | Flatness of cold rolled steel strip as measured on platen (mm) | | Passing property in continuous | Lateral bending of surface-treated steel strip and accuracy of adhesion position of film laminate | |
|---|---|---|---|---|---|---|
| No. | Remarks | height of edge wave | height of center buckle | annealing passing speed and status (mpm) | bending per 1 m of lateral bending (mm) | accuracy of adhesion postion |
| 1 | Inven- | 0 | 0 | 1200 | 0 | Weld cans were produced |
| 2 | tion | 0 | 0 | 1200 | 0 | in a high rate because |
| 3 | Example | 0 | 0 | 1150 | 0 | film was adhered with a |
| 4 | | 0 | 0 | 1000 | 0 | good accuracy |
| 5 | | 0 | 0 | 960 | 0 | |
| 6 | | 0 | 0 | 880 | 0 | |
| 7 | Compara- | 2 | 5 | 400 | 0.2 | Welding could not be |
| 8 | tive | 1 | 4 | 350 | 0.5 | conducted because film |

TABLE 11-continued

| No. | Remarks | Flatness of cold rolled steel strip as measured on platen (mm) height of edge wave | height of center buckle | Passing property in continuous annealing passing speed and status (mpm) | Lateral bending of surface-treated steel strip and accuracy of adhesion position of film laminate bending per 1 m of lateral bending (mm) | accuracy of adhesion postion |
|---|---|---|---|---|---|---|
| 9 | Example | 3 | 2 | 330 | 0.8 | remained in weld can · weld portion |
| 10 | | 5 | 3 | 300 } partly breakage | 0.8 | |
| 11 | | 6 | 2 | 300 | 1 | |
| 12 | | 8 | 1 | 300 | 1 | |

TABLE 12

| No. | Remarks | Can formability fruiting property of 3-piece can | ragging resistance of wall in 2-piece can | Plated quantity kind | total tin quantity (g/m²) | metallic tin quantity g/m²) | quantity of remaining metallic tin after blank baking (g/m²) | area ratio of land-shaped tin (%) | quantity of metallic Cr (mg/m²) | quantity of oxidized Cr (mg/m²) |
|---|---|---|---|---|---|---|---|---|---|---|
| 1 | Invention Example | ○ | ○ | tin plate | 5.60 | 5.00 | 2.71 | — | 1 | 8 |
| 2 | | ○ | ○ | tin plate | 2.80 | 1.54 | 0.71 | — | 1 | 5 |
| 3 | | ○ | ○ | thin tin plate | 1.12 | 0.61 | 0.24 | 60 | 16 | 9 |
| 4 | | ○ | ○ | thin tin plate | 1.87 | 1.47 | 0.86 | 54 | 14 | 9 |
| 5 | | ○ | ○ | thin tin plate | 1.68 | 1.27 | 0.89 | 46 | 7 | 8 |
| 6 | | ○ | ○ | tin-free | — | — | — | — | 110 | 15 |
| 7 | Comparative Example | X | X | tin plate | 2.80 | 2.30 | 0.60 | — | 0 | 3 |
| 8 | | X | X | tin plate | 2.56 | 2.06 | 0.21 | — | 19 | 7 |
| 9 | | X | X | thin tin plate | 1.12 | 0.42 | 0.02 | 0 | 15 | 10 |
| 10 | | X | X | thin tin plate | 1.68 | 1.03 | 0.04 | 0 | 12 | 8 |
| 11 | | X | X | thin tin plate | 2.80 | 2.00 | 1.12 | 0 | 8 | 7 |
| 12 | | X | X | tin-free | — | — | — | — | 21 | 2 |

| No. | Remarks | Corrosion resistance of paint steel sheet threaded rust | corrosion resistance evaluation | corroded state | high-speed weldability | Adhesion strength through T-peel test (kg/10 mm) | Total evaluation |
|---|---|---|---|---|---|---|---|
| 1 | Invention Example | ○ | ○ | uniform | ○ | 2.3 | ○ |
| 2 | | ◎ | ○ | uniform | ○ | 2.2 | ○ |
| 3 | | ◎ | ○ | uniform | ○ | 2.9 | ○ |
| 4 | | ◎ | ○ | uniform | ○ | 2.8 | ○ |
| 5 | | ◎ | ○ | uniform | ○ | 2.9 | ○ |
| 6 | | ◎ | ○ | uniform | ○ | 2.9 | ○ |
| 7 | Comparative Example | X | X | slightly uniform | ○ | 0.9 | X |
| 8 | | X | Δ | | ○ | 1.5 | X |
| 9 | | X | Δ | | X | 1.3 | X |
| 10 | | X | ○ | | X | 1.4 | X |
| 11 | | X | ○ | uniform | ○ | 1.5 | X |
| 12 | | Δ | X | ununiform | X | 2.1 | X |

EXAMPLE 3

Steel having a chemical composition shown in Table 13 was melted in a bottom-blowing converter of 270t and cast by means of a continuous casting machine to obtain a cast slab.

These cast slabs were rough rolled and the resulting sheet bars were joined to a preceding sheet bar and heated at their widthwise end portions by means of an edge heater and continuously rolled by means of a hot finish rolling mill using pair-cross rolls with a changed cross angle at front 3 stands or all 7 stands to form an extremely-thin hot rolled steel strip having a width of 950–1300 mm, which was coiled. Thereafter, it was pickled, descaled and then rolled in a 6 stand tandem continuously cold rolling mill including a cross shift machine using a one-side trapezoidal work roll as a work roll of No. 1 stand to obtain an extremely-thin cold rolled steel strip.

For the comparison, the cast slab was subjected to a hot finish rolling (single rolling) at the conventional cast slab unit and further to a cold rolling not using a pair cross machine and a cross shift machine with a one-side trapezoidal work roll.

Moreover, a part of the cold rolled steel strips was subjected to Ni plating and then continuously annealed likewise the other cold rolled steel strips (Ni plating material corresponded to Ni diffusion treatment). A heat cycle of diffusion treatment annealing was 700–720° C. and 10 seconds. Subsequently, steel sheets having various temper grades were produced by adjusting a rolling reduction of temper rolling.

The above producing conditions are shown in Table 13 and Table 14. Moreover, Ni plating bath used and annealing were the same as in Example 1.

A test specimen was taken out from the thus treated steel sheet to measure hardness (HR30T) distribution and thickness (mm) distribution in the widthwise direction. And also, r-value (Lankford value) and anisotropy value Δr thereof were measured.

Further, Ni plated quantity and Ni/(Ni+Fe) ratio in the surface layer with respect to the Ni diffusion treated specimen were measured in the same manner as in Example 1.

These measured results are shown in Tables 15–18.

TABLE 13

| | | Chemical composition (wt %) | | | | | | | | Hot rolling conditions | |
|---|---|---|---|---|---|---|---|---|---|---|---|
| No. | Remarks | C | Si | Mn | P | S | Al | N | O | rolling system | sheet bar edge heater |
| 1 | Inven- | 0.035 | 0.02 | 0.18 | 0.012 | 0.014 | 0.054 | 0.0032 | 0.0037 | | |
| 2 | tion | 0.035 | 0.02 | 0.18 | 0.012 | 0.014 | 0.054 | 0.0032 | 0.0037 | | |
| 3 | Example | 0.035 | 0.02 | 0.18 | 0.012 | 0.014 | 0.054 | 0.0032 | 0.0037 | contin- | used |
| 4 | | 0.035 | 0.02 | 0.18 | 0.012 | 0.014 | 0.054 | 0.0032 | 0.0037 | uous | |
| 5 | | 0.035 | 0.02 | 0.18 | 0.012 | 0.014 | 0.054 | 0.0032 | 0.0037 | rolling | |
| 6 | | 0.035 | 0.02 | 0.18 | 0.012 | 0.014 | 0.054 | 0.0032 | 0.0037 | | |
| 7 | Inven- | 0.016 | 0.01 | 0.25 | 0.016 | 0.015 | 0.182 | 0.0136 | 0.0021 | | |
| 8 | tion | 0.015 | 0.01 | 0.28 | 0.015 | 0.016 | 0.161 | 0.0110 | 0.0022 | contin- | |
| 9 | | 0.025 | 0.02 | 0.53 | 0.012 | 0.011 | 0.114 | 0.0065 | 0.0008 | uous | used |
| 10 | | 0.028 | 0.01 | 0.31 | 0.017 | 0.009 | 0.108 | 0.0112 | 0.0015 | rolling | |
| 11 | | 0.047 | 0.01 | 0.14 | 0.004 | 0.005 | 0.107 | 0.0073 | 0.0021 | | |
| 12 | Compara- | 0.009 | 0.03 | 0.45 | 0.024 | 0.022 | 0.065 | 0.0074 | 0.0058 | | |
| 13 | tive | 0.010 | 0.03 | 0.72 | 0.008 | 0.022 | 0.065 | 0.0187 | 0.0058 | | |
| 14 | Example | 0.010 | 0.03 | 0.72 | 0.008 | 0.022 | 0.065 | 0.0187 | 0.0058 | single | not |
| 15 | | 0.010 | 0.03 | 0.72 | 0.008 | 0.022 | 0.065 | 0.0187 | 0.0058 | rolling | used |
| 16 | | 0.067 | 0.06 | 0.85 | 0.014 | 0.005 | 0.215 | 0.0169 | 0.0141 | | |
| 17 | | 0.067 | 0.06 | 0.85 | 0.014 | 0.005 | 0.215 | 0.0169 | 0.0141 | | |

| | | Hot rolling conditions | | | | | | |
|---|---|---|---|---|---|---|---|---|
| | | finish rolling mill | | | | | | |
| No. | Remarks | stand using pair-cross | pair-cross angle (°) | FDT (° C.) | CT (° C.) | thick-ness (mm) | width (mm) | crown (μm) |
| 1 | Inven- | 1, 2, 3 | 0.2 | 850 | 560 | 1.8 | 1300 | +36 |
| 2 | tion | 1, 2, 3 | 0.4 | 860 | 600 | 1.6 | 1200 | +22 |
| 3 | Example | 1, 2, 3 | 0.8 | 890 | 650 | 1.4 | 1200 | +5 |
| 4 | | all stands | 1.0 | 910 | 700 | 1.0 | 1100 | −12 |
| 5 | | all stands | 1.2 | 910 | 730 | 0.8 | 1100 | −20 |
| 6 | | all stands | 1.2 | 900 | 650 | 0.6 | 980 | −31 |
| 7 | Inven- | 1, 2, 3 | 0.6 | 890 | 650 | 0.8 | 1100 | −0 |
| 8 | tion | 1, 2, 3 | 0.6 | 890 | 650 | 1.0 | 1100 | +4 |
| 9 | | 1, 2, 3 | 0.8 | 890 | 650 | 1.0 | 1100 | −5 |
| 10 | | 1, 2, 3 | 0.8 | 890 | 650 | 1.0 | 1100 | −0 |
| 11 | | 1, 2, 3 | 0.8 | 920 | 650 | 2.0 | 1100 | −0 |
| 12 | Compara- | 1, 2, 3 | 0.1 | 930 | 650 | 2.2 | 1100 | +55 |
| 13 | tive | 1, 2 | 0.1 | 930 | 650 | 2.2 | 1100 | +58 |
| 14 | Example | not used | — | 930 | 650 | 2.2 | 1100 | +60 |
| 15 | | not nsed | — | 930 | 650 | 2.2 | 1100 | +72 |
| 16 | | not used | — | 930 | 650 | 2.2 | 1100 | +75 |
| 17 | | not used | — | 930 | 650 | 2.2 | 1100 | +96 |

TABLE 14

| | | Cold rolling conditions | | | | | Continuous annealing/ Ni diffusion treatment | | | | Temper rolling | |
|---|---|---|---|---|---|---|---|---|---|---|---|---|
| No. | Remarks | one-side trapezodial work roll · cross angle of cross shift machine (°) | thickness at entry side (mm) | thickness at delivery side (mm) | cold rolling reduction (%) | width (mm) | Ni plating (g/m$^2$) | annealing tempera-ture (° C.) | weight ratio of Ni/(Ni + Fe) | thickness of Fe + Ni alloy (Å) | thick-ness at delivery side (mm) | rolling reduc-tion (%) |
| 1 | Inven- | 0.2 | 1.8 | 0.182 | 89.9 | 1300 | — | 720 | — | — | 0.180 | 1 |
| 2 | tion | 0 4 | 1.6 | 0.168 | 89.5 | 1200 | 0.07 | 710 | 0.19 | 1000 | 0.160 | 5 |

TABLE 14-continued

| | | Cold rolling conditions | | | | | Continuous annealing/ Ni diffusion treatment | | | | Temper rolling | |
|---|---|---|---|---|---|---|---|---|---|---|---|---|
| No. | Remarks | one-side trapezodial work roll · cross angle of cross shift machine (°) | thickness at entry side (mm) | thickness at delivery side (mm) | cold rolling reduction (%) | width (mm) | Ni plating (g/m²) | annealing temperature (° C.) | weight ratio of Ni/(Ni + Fe) | thickness of Fe + Ni alloy (Å) | thickness at delivery side (mm) | rolling reduction (%) |
| 3 | Example | 0.6 | 1.4 | 0.144 | 89.7 | 1200 | 0.07 | 710 | 0.30 | 1000 | 0.130 | 10 |
| 4 | | 0.8 | 1.0 | 0.125 | 87.5 | 1100 | 0.07 | 720 | 0.05 | 1000 | 0.100 | 20 |
| 5 | | 0.8 | 0.8 | 0.123 | 84.6 | 1100 | 0.07 | 715 | 0.26 | 1000 | 0.080 | 25 |
| 6 | | 0.8 | 0.6 | 0.107 | 82.2 | 980 | 0.07 | 715 | 0.09 | 1000 | 0.060 | 30 |
| 7 | Inven- | 0.4 | 0.8 | 0.144 | 82.0 | 1100 | — | 720 | — | — | 0.130 | 10 |
| 8 | tion | 0.4 | 1.0 | 0.144 | 85.6 | 1100 | — | 720 | — | — | 0.130 | 10 |
| 9 | Example | 0.4 | 1.0 | 0.144 | 85.6 | 1100 | — | 710 | — | — | 0.130 | 10 |
| 10 | | 0.4 | 1.0 | 0.144 | 85.6 | 1100 | — | 710 | — | — | 0.130 | 10 |
| 12 | Compara- | not used | 2.2 | 0.184 | 91.6 | 1100 | — | 720 | — | — | 0.180 | 2 |
| 13 | tive | not used | 2.2 | 0.178 | 91.9 | 1100 | 0.6 | 710 | 0.2 | 1000 | 0.160 | 10 |
| 14 | Example | not used | 2.2 | 0.156 | 92.9 | 1100 | — | 710 | — | — | 0.140 | 10 |
| 15 | | not used | 2.2 | 0.144 | 93.5 | 1100 | 6 | 720 | 0.2 | 4000 | 0.130 | 10 |
| 16 | | not used | 2.2 | 0.114 | 93.5 | 1100 | 0.05 | 720 | 0.2 | 3000 | 0.080 | 30 |
| 17 | | not used | 2.2 | 0.114 | 93.5 | 1100 | — | 720 | — | — | 0.060 | 30 |

TABLE 15

| | | Thickness distribution (mm) | | | | | Distribution of hardness (HR30T) of tin mill blackplate | | | | |
|---|---|---|---|---|---|---|---|---|---|---|---|
| | | hot rolled steel strip | | cold rolled steel strip | | | | | position of front end of hot rolled steel strip | | |
| No. | Remarks | middle portion | 25 mm from widthwise end | middle portion | position of 10 mm from widthwise end of hot rolled steel strip | region within ±4% of average thickness | temper grade | average hardness | position of 5 mm from widthwise end | widthwise middle position | region of variation quantity ≦±3 (%) |
| 1 | Inven- | 1.8 | 1.78 | 0.18 | 0.179 | 97 | T3 | 57 | 57 | 57 | 99 |
| 2 | tion | 1.6 | 1.58 | 0.16 | 0.157 | 98 | T4 | 61 | 59 | 61 | 99 |
| 3 | Example | 1.4 | 1.37 | 0.13 | 0.128 | 98 | T5 | 65 | 64 | 65 | 99 |
| 4 | | 1.0 | 1.00 | 0.10 | 0.098 | 99 | DR8 | 73 | 71 | 73 | 18 |
| 5 | | 0.8 | 0.81 | 0.08 | 0.080 | 99 | DR9 | 76 | 74 | 76 | 98 |
| 6 | | 0.6 | 0.62 | 0.06 | 0.061 | 99 | DR10 | 80 | 79 | 80 | 99 |
| 7 | Inven- | 0.8 | 0.78 | 0.13 | 0.131 | 98 | T4 | 61 | 59 | 61 | 99 |
| 8 | tion | 1.0 | 0.97 | 0.13 | 0.130 | 98 | T4 | 61 | 59 | 61 | 99 |
| 9 | Example | 1.0 | 1.00 | 0.13 | 0.131 | 99 | T4 | 61 | 60 | 61 | 99 |
| 10 | | 1.0 | 1.00 | 0.13 | 0.131 | 99 | T4 | 61 | 60 | 61 | 99 |
| 11 | | 2.0 | 1.97 | 0.20 | 0.197 | 98 | T4 | 57 | 57 | 57 | 99 |
| 12 | Compara- | 2.2 | 2.10 | 0.18 | 0.168 | 86 | T5 | 65 | 50 | 63 | 79 |
| 13 | tive | 2.2 | 2.11 | 0.16 | 0.145 | 84 | DR8 | 73 | 55 | 71 | 71 |
| 14 | Example | 2.2 | 2.13 | 0.14 | 0.128 | 82 | DR8 | 73 | 54 | 72 | 78 |
| 15 | | 2.2 | 2.12 | 0.13 | 0.119 | 81 | DR8 | 73 | 56 | 72 | 70 |
| 16 | | 2.2 | 2.12 | 0.08 | 0.060 | 76 | DR10 | 80 | 72 | 81 | 61 |
| 17 | | 2.2 | 2.13 | 0.06 | 0.042 | 74 | DR10 | 80 | 74 | 82 | 53 |

| | | Distribution of hardness (HR30T) of tin mill blackplate | | | | | |
|---|---|---|---|---|---|---|---|
| | | position of middle portion of hot rolled steel strip | | | position of rear end of hot rolled steel strip | | |
| No. | Remarks | position of 5 mm from widthwise end | widthwise middle position | region of variation quantity ≦±3 (%) | position of 5 mm from widthwise end | widthwise middle position | region of variation quantity ≦±3 (%) |
| 1 | Inven- | 57 | 57 | 99 | 57 | 57 | 99 |
| 2 | tion | 60 | 61 | 99 | 58 | 61 | 98 |
| 3 | Example | 64 | 65 | 99 | 63 | 65 | 98 |
| 4 | | 72 | 73 | 98 | 71 | 73 | 98 |

TABLE 15-continued

| | | | | | | | |
|---|---|---|---|---|---|---|---|
| 5 | | 75 | 76 | 98 | 75 | 76 | 98 |
| 6 | | 79 | 80 | 99 | 78 | 80 | 99 |
| 7 | Inven- | 60 | 61 | 99 | 58 | 61 | 98 |
| 8 | tion | 59 | 61 | 99 | 58 | 61 | 98 |
| 9 | Example | 60 | 61 | 99 | 59 | 61 | 99 |
| 10 | | 61 | 61 | 99 | 59 | 61 | 98 |
| 11 | | 57 | 57 | 99 | 57 | 57 | 99 |
| 12 | Compara- | 51 | 64 | 84 | 49 | 62 | 78 |
| 13 | tive | 62 | 71 | 75 | 54 | 70 | 67 |
| 14 | Example | 61 | 72 | 80 | 54 | 70 | 75 |
| 15 | | 62 | 71 | 74 | 55 | 71 | 65 |
| 16 | | 76 | 85 | 65 | 64 | 80 | 56 |
| 17 | | 78 | 86 | 61 | 68 | 81 | 50 |

TABLE 16

| | | Flatness of cold rolled steel strip as measured on platen (mm) | | Passing property in continuous | | Lateral bending of tin plate steel strip and accuracy of adhesion position of film laminate | |
|---|---|---|---|---|---|---|---|
| No. | Remarks | height of edge wave | height of center buckle | annealing passing speed and status (mpm) | | bending per 1 m of lateral bending (mm) | accuracy of adhesion postion |
| 1 | Inven- | 0 | 0 | 1200 | | 0 | Weld cans were produced |
| 2 | tion | 0 | 0 | 1100 | | 0 | in a high rate because |
| 3 | Example | 0 | 0 | 1050 | | 0 | film was adhered with a |
| 4 | | 0 | 0 | 1000 | | 0 | good accuracy |
| 5 | | 0 | 0 | 950 | | 0 | |
| 6 | | 0 | 0 | 850 | | 0 | |
| 7 | Inven- | 0 | 0 | 1000 | | 0 | Weld cans were produced |
| 8 | tion | 0 | 0 | 1000 | | 0 | in a high rate because |
| 9 | Example | 0 | 0 | 1000 | | 0 | film was adhered with a |
| 10 | | 0 | 0 | 1000 | | 0 | good accuracy |
| 11 | | 0 | 0 | 1000 | | 0 | |
| 12 | Compara- | 1 | 4 | 450 | | 0.2 | Welding could not be |
| 13 | tive | 1 | 3 | 400 | | 0.4 | conducted because film |
| 14 | Example | 4 | 2 | 300 | | 0.5 | remained in weld can · |
| 15 | | 4 | 3 | 300 | } | 0.9 | weld portion |
| 16 | | 6 | 1 | 300 | partly | 1 | |
| 17 | | 7 | 1 | 300 | breakage | 1 | |

TABLE 17

| | | Material properties of tin mill blackplate | | | | |
|---|---|---|---|---|---|---|
| No. | Remarks | r-value | Δr-value | temper grade | fruiting property of 3-piece can | ragging resistance of wall in 2-piece can |
| 1 | Inven- | 1.8 | −0.04 | T3 | ○ | ○ |
| 2 | tion | 1.7 | −0.13 | T4 | ○ | ○ |
| 3 | Example | 1.7 | −0.14 | T5 | ○ | ○ |
| 4 | | 1.4 | −0.29 | DR8 | ○ | ○ |
| 5 | | 1.3 | −0.38 | DR9 | ○ | ○ |
| 6 | | 1.2 | −0.45 | DR10 | ○ | ○ |
| 7 | Inven- | 1.4 | −0.02 | T5 | ○ | ○ |
| 8 | tion | 1.5 | −0.11 | T5 | ○ | ○ |
| 9 | Example | 1.5 | −0.12 | T5 | ○ | ○ |

TABLE 17-continued

| | | Material properties of tin mill blackplate | | | | |
|---|---|---|---|---|---|---|
| No. | Remarks | r-value | Δr-value | temper grade | fruiting property of 3-piece can | ragging resistance of wall in 2-piece can |
| 10 | | 1.6 | −0.11 | T5 | ○ | ○ |
| 11 | | 1.7 | −0.10 | T3 | ○ | ○ |
| 12 | Compara- | 1.1 | −0.62 | T3 | X | ○ |
| 13 | tive | 0.8 | −0.64 | T5 | X | X |
| 14 | Example | 1.2 | −0.73 | T5 | X | X |
| 15 | | 1.2 | −0.61 | T5 | X | X |
| 16 | | 0.9 | −0.81 | DR10 | X | X |
| 17 | | 1.1 | −0.63 | DR10 | X | X |

TABLE 18

| | | Corrosion resistance and high-speed weldability of painted steel sheet | | | | |
|---|---|---|---|---|---|---|
| | | | corrosion resistance | | | Total |
| No. | Remarks | kind | evaluation | corroded state | high-speed weldability | evaluation |
| 1 | Invention | tin plate | ○ | uniform | ○ | ○ |
| 2 | Example | thin tin plate | ○ | uniform | ○ | ○ |
| 3 | | thin tin plate | ○ | uniform | ○ | ○ |
| 4 | | thin tin plate | ○ | uniform | ○ | ○ |
| 5 | | tin plate | ○ | uniform | ○ | ○ |
| 6 | | tin plate | ○ | uniform | ○ | ○ |
| 7 | Invention | tin plate | ○ | uniform | ○ | ○ |
| 8 | Example | tin plate | ○ | uniform | ○ | ○ |
| 9 | | thin tin plate | ○ | uniform | ○ | ○ |
| 10 | | TFS | ○ | uniform | ○ | ○ |
| 11 | | TFS | ○ | uniform | ○ | ○ |
| 12 | Comparative | tin plate | X | slightly ununiform | ○ | X |
| 13 | Example | thin tin plate | Δ | slightly ununiform | X | X |
| 14 | | thin tin plate | Δ | slightly ununiform | X | X |
| 15 | | thin tin plate | ○ | slightly ununiform | X | X |
| 16 | | thin tin plate | ○ | uniform | ○ | X |
| 17 | | TFS | X | ununiform | X | X |

EXAMPLE 4

A cold rolled steel sheet was produced by using steel having achemical composition shown in Table 19 likewise Example 3. A surface-treated steel sheet was produced by subjecting the surface of the steel sheet to a plating and if necessary to reflow treatment and then to a chromate treatment.

The above producing conditions are shown in Table 19 and Table 20. Moreover, the conditions of the plating bath in the Ni fusion treatment and the annealing and various surface treating conditions were the same as in Example 2.

A test specimen was taken out from the thus produced surface treated steel sheet to measure hardness (HR30T) distribution and thickness (mm) distribution in the widthwise direction. And also, r-value (Lankford value) and anisotropy property Δr thereof were measured.

Moreover, the test conditions of Ni/(Ni+Fe) in the surface layer of Ni diffusion treated material, flatness of the cold rolled steel strip and passing property in the continuous annealing, hardness (HR30T) distribution and thickness (mm) in the surface-treated steel sheet, can forming property, rust resistance, corrosion resistance, paint adhesion property through T peel test, high-speed weldability and the like were the same as in Example 2.

These measured results are shown in Tables 21–24.

TABLE 19

| | | Chemical composition (wt %) | | | | | | | | Hot rolling conditions | |
|---|---|---|---|---|---|---|---|---|---|---|---|
| No. | Remarks | C | Si | Mn | P | S | Al | N | O | rolling system | sheet bar edge heater |
| 1 | Invention | 0.032 | 0.01 | 0.15 | 0.013 | 0.012 | 0.041 | 0.0022 | 0.0027 | continuous rolling | used |
| 2 | | 0.032 | 0.01 | 0.15 | 0.013 | 0.012 | 0.041 | 0.0022 | 0.0227 | | |
| 3 | Example | 0.032 | 0.01 | 0.15 | 0.013 | 0.012 | 0.041 | 0.0022 | 0.0027 | | |
| 4 | | 0.032 | 0.01 | 0.15 | 0.013 | 0.012 | 0.041 | 0.0022 | 0.0027 | | |
| 5 | | 0.032 | 0.01 | 0.15 | 0.013 | 0.012 | 0.041 | 0.0022 | 0.0027 | | |
| 6 | | 0.032 | 0.01 | 0.15 | 0.013 | 0.012 | 0.041 | 0.0022 | 0.0027 | | |
| 7 | Invention | 0.018 | 0.02 | 0.25 | 0.018 | 0.015 | 0.112 | 0.0146 | 0.0021 | continuous rolling | used |
| 8 | | 0.016 | 0.02 | 0.27 | 0.014 | 0.016 | 0.163 | 0.0106 | 0.0024 | | |
| 9 | | 0.025 | 0.02 | 0.55 | 0.010 | 0.012 | 0.105 | 0.0045 | 0.0009 | | |
| 10 | | 0.027 | 0.01 | 0.31 | 0.011 | 0.000 | 0.118 | 0.0110 | 0.0008 | | |
| 11 | | 0.047 | 0.01 | 0.15 | 0.004 | 0.006 | 0.112 | 0.0075 | 0.0008 | | |
| 12 | Comparative | 0.008 | 0.04 | 0.47 | 0.620 | 0.024 | 0.065 | 0.0070 | 0.0048 | single rolling | not used |
| 13 | | 0.012 | 0.04 | 0.72 | 0.009 | 0.023 | 0.063 | 0.0167 | 0.0028 | | |
| 14 | Example | 0.014 | 0.03 | 0.71 | 0.006 | 0.020 | 0.052 | 0.0155 | 0.0060 | | |
| 15 | | 0.016 | 0.05 | 0.72 | 0.009 | 0.022 | 0.051 | 0.0185 | 0.0032 | | |
| 16 | | 0.067 | 0.06 | 0.80 | 0.016 | 0.005 | 0.215 | 0.0161 | 0.0141 | | |
| 17 | | 0.068 | 0.07 | 0.82 | 0.015 | 0.007 | 0.132 | 0.0158 | 0.0132 | | |

TABLE 19-continued

| | | Hot rolling conditions | | | | | | |
|---|---|---|---|---|---|---|---|---|
| | | finish rolling mill | | | | | | |
| No. | Remarks | stand using pair-cross | pair-cross angle (°) | FDT (° C.) | CT (° C.) | thickness (mm) | width (mm) | crown (μm) |
| 2 | tion | 1, 2, 3 | 0.4 | 860 | 600 | 1.6 | 1200 | +18 |
| 3 | Example | 1, 2, 3 | 0.8 | 896 | 650 | 1.4 | 1200 | +7 |
| 4 | | all stands | 1.0 | 910 | 700 | 1.0 | 1100 | −15 |
| 5 | | all stands | 1.2 | 910 | 700 | 0.8 | 1100 | −18 |
| 6 | | all stands | 1.2 | 900 | 650 | 0.6 | 950 | −22 |
| 7 | Inven- | 1, 2, 3 | 0.6 | 890 | 656 | 0.8 | 1100 | 0 |
| 8 | tion | 1, 2, 3 | 0.6 | 890 | 650 | 1.0 | 1100 | +5 |
| 9 | | 1, 2, 3 | 0.8 | 890 | 650 | 1.0 | 1100 | −4 |
| 10 | | 1, 2, 3 | 0.8 | 890 | 650 | 1.0 | 1100 | 0 |
| 11 | | 1, 2, 3 | 0.8 | 920 | 650 | 2.0 | 1100 | −1 |
| 12 | Compara- | 1, 2, 3 | 0.1 | 930 | 650 | 2.2 | 1100 | +65 |
| 13 | tive | 1, 2 | 0.1 | 930 | 650 | 2.2 | 1100 | +58 |
| 14 | Example | not used | — | 930 | 650 | 2.2 | 1100 | +62 |
| 15 | | not used | — | 930 | 650 | 2.2 | 1100 | +42 |
| 16 | | not used | — | 930 | 650 | 2.2 | 1100 | +71 |
| 17 | | not used | — | 930 | 650 | 2.2 | 1100 | +102 |

TABLE 20

| | | Cold rolling conditions | | | | | Continuous annealing/ Ni diffusion treatment | | | | Temper rolling | |
|---|---|---|---|---|---|---|---|---|---|---|---|---|
| No. | Remarks | one-side trapezodial work roll · cross angle of cross shift machine (°) | thickness at entry side (mm) | thickness at delivery side (mm) | cold rolling reduction (%) | width (mm) | Ni plating (g/m²) | annealing temperature (° C.) | weight ratio of Ni/(Ni + Fe) | thickness of Fe + Ni alloy (Å) | thickness at delivery side (mm) | rolling reduction (%) |
| 1 | Inven- | 0.2 | 1.8 | 0.182 | 89.9 | 1300 | — | 710 | — | — | 0.180 | 1 |
| 2 | tion | 0.4 | 1.6 | 0.168 | 89.5 | 1200 | 0.08 | 720 | 0.19 | 1000 | 0.160 | 5 |
| 3 | Example | 0.6 | 1.4 | 0.144 | 89.7 | 1200 | 0.17 | 720 | 0.30 | 1000 | 0.130 | 10 |
| 4 | | 0.8 | 1.0 | 0.125 | 87.5 | 1100 | 0.08 | 710 | 0.05 | 1000 | 0.100 | 20 |
| 5 | | 0.8 | 0.8 | 0.123 | 84.6 | 1100 | 0.07 | 715 | 0.26 | 1000 | 0.080 | 25 |
| 6 | | 0.8 | 0.6 | 0.107 | 82.2 | 980 | 0.09 | 720 | 0.09 | 1000 | 0.060 | 30 |
| 7 | Inven- | 0.4 | 0.8 | 0.144 | 82.0 | 1100 | — | 720 | — | — | 0.130 | 10 |
| 8 | tion | 0.4 | 1.0 | 0.144 | 85.6 | 1100 | — | 710 | — | — | 0.130 | 10 |
| 9 | Example | 0.4 | 1.0 | 0.144 | 85.6 | 1100 | — | 710 | — | — | 0.130 | 10 |
| 10 | | 0.4 | 1.0 | 0.144 | 85.6 | 1100 | — | 720 | — | — | 0.130 | 10 |
| 11 | | 0.4 | 2.0 | 0.205 | 89.8 | 1100 | — | 720 | — | — | 0.200 | 2 |
| 12 | Compara- | not used | 2.2 | 0.184 | 91.6 | 1100 | — | 710 | — | — | 0.180 | 2 |
| 13 | tive | not used | 2.2 | 0.178 | 91.9 | 1100 | 0.7 | 710 | 0.2 | 1000 | 0;160 | 10 |
| 14 | Example | not used | 2.2 | 0.156 | 92.9 | 1100 | — | 720 | | | 0.140 | 10 |
| 15 | | not used | 2.2 | 0.144 | 93.5 | 1100 | 6 | 720 | 0.2 | 4000 | 0.130 | 10 |
| 16 | | not used | 2.2 | 0.114 | 93.5 | 1100 | 0.04 | 720 | 0.2 | 3000 | 0.080 | 30 |
| 17 | | not used | 2.2 | 0.114 | 93.5 | 1100 | — | 720 | — | — | 0.060 | 30 |

TABLE 21

| | | Thickness distribution (mm) | | | | | Distribution of hardness (HR30T) of tin mill blackplate | | | | |
|---|---|---|---|---|---|---|---|---|---|---|---|
| | | hot rolled steel strip | | cold rolled steel strip | | | | | position of front end of hot rolled steel strip | | |
| No. | Remarks | middle portion | 25 mm from widthwise end | middle portion | position of 10 mm from widthwise end of hot rolled steel strip | region within ±4% of average thickness | temper grade | average hardness | position of 5 mm from widthwise end | widthwise middle position | region of variation quantity ≦±3 (%) |
| 1 | Inven- | 1.8 | 1.77 | 0.18 | 0.178 | 97 | T3 | 57 | 57 | 57 | 99 |
| 2 | tion | 1.6 | 1.58 | 0.16 | 0.157 | 98 | T4 | 61 | 66 | 61 | 99 |
| 3 | Example | 1.4 | 1.38 | 0.13 | 0.128 | 98 | T5 | 65 | 64 | 65 | 99 |

TABLE 21-continued

| | | | | | | | | | | | |
|---|---|---|---|---|---|---|---|---|---|---|---|
| 4 | | 1.0 | 1.01 | 0.10 | 0.098 | 99 | DR8 | 73 | 71 | 73 | 98 |
| 5 | | 0.8 | 0.81 | 0.08 | 6.081 | 99 | DR9 | 76 | 75 | 76 | 98 |
| 6 | | 0.6 | 0.62 | 0.06 | 0.058 | 99 | DR10 | 80 | 78 | 80 | 99 |
| 7 | Inven- | 0.8 | 0.79 | 0.13 | 0.130 | 98 | T4 | 61 | 60 | 61 | 99 |
| 8 | tion | 1.0 | 0.98 | 0.13 | 0.131 | 98 | T4 | 61 | 59 | 61 | 99 |
| 9 | Example | 1.0 | 1.00 | 0.13 | 0.132 | 99 | T4 | 61 | 60 | 61 | 99 |
| 10 | | 1.0 | 1.01 | 0.13 | 0.131 | 99 | T4 | 61 | 60 | 61 | 99 |
| 11 | | 2.0 | 1.97 | 0.20 | 0.197 | 98 | T3 | 57 | 57 | 57 | 99 |
| 12 | Compara- | 2.2 | 2.11 | 0.18 | 0.167 | 84 | T5 | 65 | 51 | 63 | 78 |
| 13 | tive | 2.2 | 2.10 | 0.16 | 0.143 | 83 | DR8 | 73 | 54 | 71 | 70 |
| 14 | Example | 2.2 | 2.12 | 0.14 | 0.127 | 80 | DR8 | 73 | 55 | 72 | 78 |
| 15 | | 2.2 | 2.13 | 0.13 | 0.118 | 81 | DR8 | 73 | 55 | 72 | 69 |
| 16 | | 2.2 | 2.12 | 0.08 | 0.061 | 77 | DR10 | 80 | 72 | 81 | 61 |
| 17 | | 2.2 | 2.15 | 0.06 | 0.042 | 74 | DR10 | 80 | 73 | 82 | 52 |

| | | Distribution of hardness (HR30T) of tin mill blackplate | | | | | |
|---|---|---|---|---|---|---|---|
| | | position of middle portion of hot rolled steel strip | | | position of rear end of hot rolled steel strip | | |
| No. | Remarks | position of 5 mm from width-wise end | width-wise middle position | region of variation quantity ≦±3 (%) | position of 5 mm from width-wise end | width-wise middle position | region of variation quantity ≦±3 (%) |
| 1 | Inven- | 57 | 57 | 99 | 56 | 57 | 98 |
| 2 | tion | 61 | 61 | 99 | 59 | 61 | 99 |
| 3 | Example | 64 | 65 | 99 | 63 | 65 | 98 |
| 4 | | 72 | 73 | 98 | 71 | 73 | 98 |
| 5 | | 75 | 76 | 98 | 75 | 76 | 98 |
| 6 | | 79 | 83 | 99 | 79 | 80 | 99 |
| 7 | Inven- | 61 | 61 | 99 | 59 | 61 | 99 |
| 8 | tion | 59 | 61 | 99 | 58 | 61 | 98 |
| 9 | Example | 60 | 61 | 99 | 60 | 61 | 99 |
| 10 | | 61 | 61 | 99 | 59 | 61 | 98 |
| 11 | | 57 | 57 | 99 | 57 | 57 | 99 |
| 12 | Compara- | 50 | 62 | 84 | 48 | 62 | 76 |
| 13 | tive | 61 | 70 | 75 | 53 | 70 | 67 |
| 14 | Example | 63 | 72 | 80 | 54 | 70 | 73 |
| 15 | | 62 | 71 | 74 | 54 | 71 | 65 |
| 16 | | 77 | 85 | 68 | 70 | 80 | 54 |
| 17 | | 79 | 86 | 64 | 69 | 81 | 51 |

TABLE 22

| | | Flatness of cold rolled steel strip as measured on platen (mm) | | Passing property in continuous | | Lateral bending of tin plate steel strip and accuracy of adhesion position of film laminate | |
|---|---|---|---|---|---|---|---|
| No. | Remarks | height of edge wave | height of center buckle | annealing passing speed and status (mpm) | | bending per 1 m of lateral bending (mm) | accuracy of adhesion postion |
| 1 | Inven- | 0 | 0 | 1200 | | 0 | Weld cans were produced |
| 2 | tion | 0 | 0 | 1150 | | 0 | in a high rate because |
| 3 | Example | 0 | 0 | 1150 | | 0 | film was adhered with a |
| 4 | | 0 | 0 | 1100 | | 0 | good accuracy |
| 5 | | 0 | 0 | 980 | | 0 | |
| 6 | | 0 | 0 | 850 | | 0 | |
| 7 | Inven- | 0 | 0 | 1000 | | 0 | Weld cans were produced |
| 8 | tion | 0 | 0 | 1000 | | 0 | in a high rate because |
| 9 | Example | 0 | 0 | 1000 | | 0 | film was adhered with a |
| 10 | | 0 | 0 | 1000 | | 0 | good accuracy |
| 11 | | 0 | 0 | 1000 | | 0 | |
| 12 | Compara- | 2 | 5 | 430 | | 0.3 | Welding could not be |
| 13 | tive | 1 | 4 | 410 | | 0.6 | conducted because film |
| 14 | Example | 5 | 3 | 300 | | 0.5 | remained in weld can · |
| 15 | | 4 | 3 | 300 | } | 0.1 | weld portion |
| 16 | | 8 | 2 | 300 | } partly | 1 | |
| 17 | | 6 | 1 | 300 | } breakage | 1 | |

TABLE 23

| No. | Remarks | Material properties of tin mill blackplate: r-value | Δr-value | temper grade | fruiting property of 3-piece can | ragging resistance of wall in 2-piece can |
|---|---|---|---|---|---|---|
| 1 | Invention Example | 1.8 | −0.04 | T3 | ○ | ○ |
| 2 | | 1.8 | −0.11 | T4 | ○ | ○ |
| 3 | | 1.7 | −0.15 | T5 | ○ | ○ |
| 4 | | 1.5 | −0.26 | DR8 | ○ | ○ |
| 5 | | 1.2 | −0.35 | DR9 | ○ | ○ |
| 6 | | 1.1 | −0.40 | DR10 | ○ | ○ |
| 7 | | 1.5 | −0.10 | TS | ○ | ○ |
| 8 | | 1.6 | −0.12 | T5 | ○ | ○ |
| 9 | | 1.5 | −0.18 | T5 | ○ | ○ |

TABLE 23-continued

| No. | Remarks | Material properties of tin mill blackplate: r-value | Δr-value | temper grade | fruiting property of 3-piece can | ragging resistance of wall in 2-piece can |
|---|---|---|---|---|---|---|
| 10 | Comparative Example | 1.5 | −0.16 | T5 | ○ | ○ |
| 11 | | 1.8 | −0.12 | T3 | ○ | ○ |
| 12 | | 1.0 | −0.68 | T3 | X | X |
| 13 | | 0.7 | −0.66 | T5 | X | X |
| 14 | | 1.2 | −0.78 | T5 | X | X |
| 15 | | 1.1 | −0.64 | T5 | X | X |
| 16 | | 1.8 | −0.82 | DR10 | X | X |
| 17 | | 1.1 | −0.65 | DR10 | X | X |

TABLE 24

| No. | Remarks | Plated quantity: kind | total tin quantity (g/m$^2$) | metallic tin quantity (g/m$^2$) | quantity of remaining metallic tin after blank baking (g/m$^2$) | area ratio of land-shaped tin (%) | quantity of metallic Cr (mg/m$^2$) | quantity of oxidized Cr (mg/m$^2$) |
|---|---|---|---|---|---|---|---|---|
| 1 | Invention Example | tin plate | 8.40 | 7.9 | 3.10 | — | 1 | 8 |
| 2 | | thin tin plate | 0.56 | 0.44 | 0.11 | 64 | 17 | 5 |
| 3 | | thin tin plate | 1.12 | 0.61 | 0.23 | 55 | 15 | 9 |
| 4 | | thin tin plate | 1.68 | 1.87 | 1.26 | 47 | 11 | 9 |
| 5 | | tin plate | 2.80 | 2.31 | 1.95 | | 7 | 8 |
| 6 | | tin plate | 5.60 | 5.00 | 4.60 | | 6 | 5 |
| 7 | | tin plate | 2.80 | 2.42 | 1.92 | — | 1 | 3 |
| 8 | | tin plate | 5.60 | 5.21 | 4.65 | — | 1 | 5 |
| 9 | | tin plate | 1.12 | 0.68 | 0.18 | — | 1 | 4 |
| 10 | | tin-free | | | | — | 32 | 5 |
| 11 | | tin-free | | | | — | 114 | 19 |
| 12 | Comparative Example | tin plate | 2.80 | 2.30 | 1.60 | — | 0 | 3 |
| 13 | | thin tin plate | 0.56 | 0.06 | 0.01 | 0 | 19 | 7 |
| 14 | | thin tin plate | 1.12 | 0.42 | 0.02 | 0 | 15 | 10 |
| 15 | | thin tin plate | 1.68 | 1.03 | 0.16 | 0 | 12 | 8 |
| 16 | | thin tin plate | 2.80 | 2.00 | 1.12 | 0 | 8 | 7 |
| 17 | | tin-free | | | | — | 21 | 2 |

| No. | Remarks | Corrosion resistance of painted steel sheet: threaded rust | corrosion resistance: evaluation | corrosion resistance: corroded state | high-speed weldability | Adhesion strength: through T-peel test (kg/10 mm) | total evaluation |
|---|---|---|---|---|---|---|---|
| 1 | Invention Example | ○ | ○ | uniform | ○ | 2.1 | ○ |
| 2 | | ○ | ○ | uniform | ○ | 2.8 | ○ |
| 3 | | ○ | ○ | uniform | ○ | 2.9 | ○ |
| 4 | | ○ | ○ | uniform | ○ | 2.4 | ○ |
| 5 | | ○ | ○ | uniform | ○ | 2.5 | ○ |
| 6 | | ○ | ○ | uniform | ○ | 2.0 | ○ |
| 7 | | ○ | ○ | uniform | ○ | 1.9 | ○ |
| 8 | | ○ | ○ | uniform | ○ | 1.7 | ○ |
| 9 | | ○ | ○ | uniform | ○ | 1.9 | ○ |
| 10 | | ○ | ○ | uniform | ○ | 2.6 | ○ |
| 11 | | ○ | ○ | uniform | ○ | 2.9 | ○ |
| 12 | Comparative Example | X | X | slightly ununiform | ○ | 0.9 | X |
| 13 | | X | Δ | slightly ununiform | X | 1.5 | X |
| 14 | | X | Δ | slightly ununiform | X | 1.3 | X |
| 15 | | X | ○ | slightly ununiform | X | 1.4 | X |
| 16 | | X | ○ | uniform | ○ | 1.5 | X |
| 17 | | Δ | X | ununifom | X | 2.1 | X |

EXAMPLE 5

Steel having a chemical composition shown in Table 25 was melted in a bottom-blowing converter of 270t and cast by means of a continuous casting machine to obtain a cast slab.

These cast slabs were rough rolled and the resulting sheet bars were joined to a preceding sheet bar and heated at their widthwise end portions by means of an edge heater and continuously rolled by means of a hot finish rolling mill using pair-cross rolls with a changed cross angle at front 3 stands or all 7 stands to form an extremely-thin hot rolled steel strip having a width of 950–1300 mm, which was coiled, pickled and descaled.

Then, the sheet was subjected to cold rolling, continuous annealing and temper rolling under various conditions. In this case, it was rolled in a 6 stand tandem continuously cold rolling mill including a cross shift machine using a one-side trapezoidal work roll as a work roll of No. 1 stand to an extremely-thin thickness.

For the comparison, experiments were carried out in such a manner that any one of the hot rolling conditions such as the hot finish rolling (single rolling) at the conventional cast slab unit, reverse rewinding treatment of sheet bar, heating of end portion by means of an edge heater, and adoption of pair-cross rolling mill and the like, thickness of the hot rolled steel strip and the cold rolling conditions such as one-side trapezoidal cross angle in the cold rolling mill and the like was outside the range of the invention.

Moreover, a part of the cold rolled steel strips was subjected to Ni plating and then continuously annealed likewise the other cold rolled steel strips (Ni plating material corresponded to Ni diffusion treatment). A heat cycle of diffusion treatment annealing was 730–760° C. and 10 seconds. Subsequently, steel sheets having various temper grades were produced by adjusting a rolling reduction of temper rolling.

The above producing conditions are shown in Table 26 and Table 27. Moreover, Ni plating bath used and annealing were the same as in Example 1.

TABLE 25

| | Chemical composition (wt %) | | | | | | | | | | | | | | | |
|---|---|---|---|---|---|---|---|---|---|---|---|---|---|---|---|---|
| No. | C | Si | Mn | P | S | Al | N | O | Cu | Ni | Cr | Mo | Ca | Nb | Ti | B |
| 1 | 0.003 | 0.02 | 0.14 | 0.012 | 0.014 | 0.065 | 0.0032 | 0.0037 | 0.01 | 0.01 | 0.02 | 0.001 | 0.0001 | 0.004 | 0.0001 | 0.0001 |
| 2 | 0.003 | 0.02 | 0.14 | 0.012 | 0.014 | 0.065 | 0.0032 | 0.0037 | 0.01 | 0.01 | 0.02 | 0.001 | 0.0001 | 0.004 | 0.0001 | 0.0001 |
| 3 | 0.003 | 0.02 | 0.14 | 0.012 | 0.014 | 0.065 | 0.0032 | 0.0037 | 0.01 | 0.01 | 0.02 | 0.001 | 0.0001 | 0.004 | 0.0001 | 0.0001 |
| 4 | 0.003 | 0.02 | 0.14 | 0.012 | 0.014 | 0.065 | 0.0032 | 0.0037 | 0.01 | 0.01 | 0.02 | 0.001 | 0.0001 | 0.004 | 0.0001 | 0.0001 |
| 5 | 0.003 | 0.02 | 0.14 | 0.012 | 0.014 | 0.065 | 0.0032 | 0.0037 | 0.01 | 0.01 | 0.02 | 0.001 | 0.0001 | 0.004 | 0.0001 | 0.0001 |
| 6 | 0.003 | 0.02 | 0.14 | 0.012 | 0.014 | 0.065 | 0.0032 | 0.0037 | 0.01 | 0.01 | 0.02 | 0.001 | 0.0001 | 0.004 | 0.0001 | 0.0001 |
| 7 | 0.003 | 0.02 | 0.14 | 0.012 | 0.014 | 0.065 | 0.0032 | 0.0037 | 0.01 | 0.01 | 0.02 | 0.001 | 0.0001 | 0.004 | 0.0001 | 0.0001 |
| 8 | 0.003 | 0.01 | 0.41 | 0.016 | 0.015 | 0.182 | 0.0096 | 0.0021 | 0.43 | 0.03 | 0.03 | 0.006 | 0.0008 | 0.081 | 0.0003 | 0.0037 |
| 9 | 0.003 | 0.01 | 0.58 | 0.011 | 0.003 | 0.056 | 0.0083 | 0.0015 | 0.02 | 0.46 | 0.06 | 0.006 | 0.0031 | 0.042 | 0.0010 | 0.0008 |
| 10 | 0.003 | 0.02 | 0.30 | 0.012 | 0.011 | 0.114 | 0.0065 | 0.0008 | 0.03 | 0.03 | 0.44 | 0.005 | 0.0011 | 0.001 | 0.0820 | 0.0014 |
| 11 | 0.004 | 0.01 | 0.31 | 0.017 | 0.009 | 0.108 | 0.0053 | 0.0005 | 0.03 | 0.02 | 0.02 | 0.041 | 0.0012 | 0.001 | 0.0311 | 0.0003 |
| 12 | 0.004 | 0.03 | 0.25 | 0.004 | 0.005 | 0.107 | 0.0143 | 0.0009 | 0.06 | 0.06 | 0.01 | 0.001 | 0.0013 | 0.001 | 0.0084 | 0.0006 |
| 13 | 0.005 | 0.03 | 0.70 | 0.008 | 0.022 | 0.065 | 0.0092 | 0.0058 | 0.51 | 0.01 | 0.40 | 0.041 | 0.0065 | 0.007 | 0.2300 | 0.0068 |
| 14 | 0.005 | 0.03 | 0.70 | 0.008 | 0.022 | 0.065 | 0.0092 | 0.0058 | 0.31 | 0.53 | 0.42 | 0.043 | 0.0065 | 0.007 | 0.2300 | 0.0068 |
| 15 | 0.005 | 0.03 | 0.70 | 0.008 | 0.022 | 0.065 | 0.0092 | 0.0058 | 0.32 | 0.42 | 0.61 | 0.043 | 0.0065 | 0.007 | 0.2300 | 0.0068 |
| 16 | 0.005 | 0.03 | 0.70 | 0.008 | 0.022 | 0.065 | 0.0092 | 0.0058 | 0.31 | 0.44 | 0.51 | 0.610 | 0.0065 | 0.007 | 0.2300 | 0.0068 |
| 17 | 0.007 | 0.04 | 0.72 | 0.024 | 0.005 | 0.215 | 0.0169 | 0.0141 | 0.01 | 0.51 | 0.57 | 0.010 | 0.0001 | 0.142 | 0.0015 | 0.0006 |
| 18 | 0.007 | 0.04 | 0.72 | 0.024 | 0.005 | 0.215 | 0.0169 | 0.0141 | 0.01 | 0.51 | 0.57 | 0.010 | 0.0001 | 0.142 | 0.0015 | 0.0006 |
| 19 | 0.002 | 0.02 | 0.15 | 0.013 | 0.012 | 0.055 | 0.0020 | 0.0035 | 0.01 | 0.01 | 0.02 | 0.001 | 0.0001 | 0.024 | 0.0001 | 0.0001 |
| 20 | 0.002 | 0.02 | 0.15 | 0.013 | 0.012 | 0.055 | 0.0020 | 0.0035 | 0.01 | 0.01 | 0.02 | 0.001 | 0.0001 | 0.024 | 0.0001 | 0.0001 |
| 21 | 0.003 | 0.02 | 0.14 | 0.011 | 0.008 | 0.046 | 0.0032 | 0.0021 | 0.01 | 0.01 | 0.02 | 0.001 | 0.0001 | 0.040 | 0.0001 | 0.0001 |
| 22 | 0.003 | 0.02 | 0.14 | 0.011 | 0.008 | 0.046 | 0.0032 | 0.0021 | 0.01 | 0.01 | 0.02 | 0.001 | 0.0001 | 0.040 | 0.0001 | 0.0001 |
| 23 | 0.003 | 0.02 | 0.14 | 0.011 | 0.008 | 0.046 | 0.0032 | 0.0021 | 0.01 | 0.01 | 0.02 | 0.001 | 0.0001 | 0.040 | 0.0001 | 0.0001 |
| 24 | 0.003 | 0.02 | 0.14 | 0.011 | 0.008 | 0.046 | 0.0032 | 0.0021 | 0.01 | 0.01 | 0.02 | 0.001 | 0.0001 | 0.040 | 0.0001 | 0.0001 |

TABLE 26

| | | Hot rolling conditions | | | | | | | | | |
|---|---|---|---|---|---|---|---|---|---|---|---|
| | | | reverse | sheet | finish rolling mill | | | | shape of hot rolled steel sheet | | |
| No. | Remarks | rolling system | rewinding treatment | bar edge heater | stand using pair-cross | pair-cross angle (°) | FDT (° C.) | CT (° C.) | thickness (mm) | width (mm) | crown (μm) |
| 1 | Invention | continuous rolling | used | used | 1, 2, 3 | 0.2 | 860 | 560 | 2.0 | 1300 | +35 |
| 2 | Example | continuous rolling | used | used | 1, 2, 3 | 0.4 | 880 | 560 | 1.8 | 1300 | +26 |
| 3 | | continuous rolling | used | used | 1, 2, 3 | 0.6 | 900 | 600 | 1.6 | 1200 | +8 |
| 4 | | continuous rolling | used | used | 1, 2, 3 | 0.8 | 930 | 650 | 1.4 | 1200 | +2 |
| 5 | | continuous rolling | used | used | all stands | 1.0 | 950 | 700 | 1.0 | 1100 | 0 |
| 6 | | continuous rolling | used | used | all stands | 1.2 | 950 | 730 | 0.8 | 1100 | −5 |
| 7 | | continuous rolling | used | used | all stands | 1.2 | 950 | 650 | 0.6 | 980 | +2 |
| 8 | | continuous rolling | used | used | 1, 2, 3 | 0.6 | 930 | 650 | 0.8 | 1100 | −10 |
| 9 | | continuous rolling | used | used | 1, 2, 3 | 0.6 | 930 | 650 | 1.0 | 1100 | −15 |
| 10 | | continuous rolling | used | used | 1, 2, 3 | 0.8 | 930 | 650 | 1.0 | 1100 | −20 |
| 11 | | continuous rolling | used | used | 1, 2, 3 | 0.8 | 930 | 650 | 1.0 | 1100 | −28 |
| 12 | | continuous rolling | used | used | 1, 2, 3 | 0.8 | 930 | 650 | 1.0 | 1100 | −36 |

TABLE 26-continued

| | | Hot rolling conditions | | | | | | | | | |
|---|---|---|---|---|---|---|---|---|---|---|---|
| | | | reverse | sheet | finish rolling mill | | | | shape of hot rolled steel sheet | | |
| No. | Remarks | rolling system | rewinding treatment | bar edge heater | stand using pair-cross | pair-cross angle (°) | FDT (° C.) | CT (° C.) | thickness (mm) | width (mm) | crown (μm) |
| 13 | Comparative | single rolling | not used | not used | 1, 2, 3 | 0.1 | 930 | 645 | 2.2 | 1100 | +58 |
| 14 | Exampte | single rolling | not used | not used | 1, 2 | 0.1 | 940 | 650 | 2.2 | 1100 | +62 |
| 15 | | single rolling | not used | not used | not used | — | 930 | 615 | 2.2 | 1100 | +64 |
| 16 | | single rolling | not used | not used | not used | — | 950 | 620 | 2.2 | 1100 | +70 |
| 17 | | single rolling | not used | not used | not used | — | 930 | 650 | 2.2 | I100 | +76 |
| 18 | Invention | single rolling | not used | not used | not used | — | 960 | 640 | 2.2 | 1100 | +95 |
| 19 | Example | continuous rolling | not used | used | all stands | 1.2 | 900 | 600 | 1.4 | 1300 | −5 |
| 20 | | continuous rolling | not used | used | all stands | 1.2 | 920 | 605 | 1.4 | 1300 | −6 |
| 21 | Comparative | continuous rolling | used | used | all stands | 1.2 | 900 | 600 | 2.2 | 1300 | −8 |
| 22 | Example | single rolling | used | used | all stands | 1.2 | 930 | 610 | 1.4 | 1300 | −10 |
| 23 | | continuous rolling | used | used | not used | not used | 900 | 620 | 1.4 | 1300 | +70 |
| 24 | | continuous rolling | used | not used | all stands | 1.2 | 915 | 605 | 1.4 | 1300 | −15 |

TABLE 27

| | | Cold rolling conditions | | | | | Continuous annealing/ Ni diffusion treatment | | | | Temper rolling | |
|---|---|---|---|---|---|---|---|---|---|---|---|---|
| No. | Remarks | one-side trapezodial work roll · cross angle of cross shift machine (°) | thickness at entry side (mm) | thickness at delivery side (mm) | cold rolling reduction (%) | width (mm) | Ni plating ($g/m^2$) | annealing temperature (° C.) | weight ratio of Ni/(Ni + Fe) | thickness of Fe + Ni alloy (Å) | thickness at delivery side (mm) | rolling reduction (%) |
| 1 | Invention | 0.2 | 2.0 | 0.204 | 89.8 | 1300 | — | 780 | — | — | 0.200 | 2 |
| 2 | | 0.6 | 1.8 | 0.200 | 88.9 | 1300 | — | 750 | — | — | 0.180 | 10 |
| 3 | Example | 0.6 | 1.6 | 0.188 | 88.3 | 1200 | 0.07 | 750 | 0.19 | 1000 | 0.160 | 15 |
| 4 | | 0.8 | 1.4 | 0.163 | 88.4 | 1200 | 0.08 | 750 | 0.30 | 1000 | 0.130 | 20 |
| 5 | | 0.8 | 1.0 | 0.143 | 85.7 | 1100 | 0.07 | 740 | 0.05 | 1000 | 0.100 | 30 |
| 6 | | 0.8 | 0.8 | 0.123 | 84.6 | 1100 | 0.08 | 740 | 0.26 | 1000 | 0.080 | 35 |
| 7 | | 0.8 | 0.6 | 0.T00 | 83.3 | 980 | 0.07 | 750 | 0.09 | 1000 | 0.060 | 40 |
| 8 | | 0.4 | 0.8 | 0.144 | 82.0 | 1100 | — | 760 | — | — | 0.130 | 10 |
| 9 | | 0.4 | 1.0 | 0.144 | 85.6 | 1100 | — | 760 | — | — | 0.130 | 10 |
| 11 | | 0.4 | 1.0 | 0.153 | 84.7 | 1100 | — | 750 | — | — | 0.130 | 15 |
| 12 | | 0.4 | 1.0 | 0.153 | 84.7 | 1100 | — | 730 | — | — | 0.130 | 15 |
| 13 | Comparative | not used | 2.2 | 0.200 | 90.9 | 1100 | — | 750 | — | — | 0.180 | 10 |
| 14 | | not used | 2.2 | 0.188 | 91.5 | 1100 | 0.6 | 750 | 0.2 | 1000 | 0.160 | 15 |
| 15 | Example | not used | 2.2 | 0.156 | 92.9 | 1100 | — | 760 | — | — | 0.140 | 10 |
| 16 | | not used | 2.2 | 0.144 | 93.5 | 1100 | 6 | 760 | 0.2 | 4000 | 0.130 | 10 |
| 17 | | not used | 2.2 | 0.094 | 95.7 | 1100 | 0.05 | 730 | 0.2 | 3000 | 0.080 | 15 |
| 18 | | not used | 2.2 | 0.071 | 96.8 | 1100 | — | 730 | — | — | 0.060 | 15 |
| 19 | Invention | 0.8 | 1.4 | 0.163 | 88.4 | 1300 | — | 750 | — | — | 0.130 | 20 |
| 20 | Example | 0.8 | 1.4 | 0.163 | 88.4 | 1300 | — | 750 | — | — | 0.130 | 20 |
| 21 | Comparative | 0.8 | 2.2 | 0.163 | 92.6 | 1300 | — | 740 | — | — | 0.130 | 20 |
| 22 | | 0.8 | 1.4 | 0.143 | 89.8 | 1300 | — | 740 | — | — | 0.100 | 30 |
| 23 | Example | 0.8 | 1.4 | 0.123 | 91.2 | 1300 | — | 760 | — | — | 0.080 | 35 |
| 24 | | 0.8 | 1.4 | 0.100 | 92.9 | 1300 | — | 760 | — | — | 0.060 | 40 |

A test specimen was taken out from the thus treated steel sheet to measure hardness (HR30T) distribution and thickness (mm) distribution in the widthwise direction. And also, r-value (Lankford value) and anisotropy value Δr thereof were measured.

Further, Ni plated quantity and Ni/(Ni+Fe) ratio in the surface layer with respect to the Ni diffusion treated specimen were measured in the same manner as in Example 1.

These measured results are shown in Tables 28–31.

TABLE 28

| | | Thickness distribution (mm) | | | | | | | Distribution of hardness (HR30T) of tin mill blackplate | | |
|---|---|---|---|---|---|---|---|---|---|---|---|
| | | hot rolled steel strip | | cold rolled steel strip | | | | | position of front end of hot rolled steel strip | | |
| No. | Remarks | middle portion | 25 mm from width-wise end | middle portion | position of 10 mm from widthwise end of hot rolled steel strip | region within ±4% of average thick-ness | temper grade | aver-age hard-ness | position of 5 mm from width-wise end | width-wise middle position | region of vari-ation quantity ≦±3 (%) |
| 1 | Inven- | 2.0 | 1.97 | 0.20 | 0.197 | 99 | T1 | 49 | 48 | 49 | 99 |
| 2 | tion | 1.8 | 1.78 | 0.18 | 0.179 | 99 | T3 | 57 | 56 | 57 | 99 |
| 3 | Example | 1.6 | 1.58 | 0.16 | 0.157 | 99 | T4 | 61 | 61 | 61 | 99 |
| 4 | | 1.4 | 1.37 | 0.13 | 0.128 | 99 | T5 | 65 | 64 | 65 | 98 |
| 5 | | 1.0 | 1.00 | 0.10 | 0.098 | 98 | DR8 | 73 | 78 | 73 | 99 |
| 6 | | 0.8 | 0.81 | 0.08 | 0.079 | 98 | DR9 | 76 | 75 | 76 | 98 |
| 7 | | 0.6 | 0.61 | 0.06 | 0.058 | 98 | DR10 | 80 | 80 | 80 | 99 |
| 8 | | 0.8 | 0.78 | 0.13 | 0.131 | 99 | T3 | 57 | 57 | 57 | 99 |
| 9 | | 1.0 | 0.97 | 0.13 | 0.130 | 99 | T3 | 57 | 56 | 57 | 98 |
| 10 | | 1.0 | 1.00 | 0.13 | 0.131 | 99 | T4 | 61 | 60 | 61 | 99 |
| 11 | | 1.0 | 1.01 | 0.13 | 0.131 | 99 | T4 | 61 | 61 | 61 | 99 |
| 12 | | 1.0 | 1.03 | 0.13 | 0.132 | 99 | T4 | 61 | 60 | 61 | 98 |
| 13 | Compara- | 2.2 | 2.10 | 0.18 | 0.168 | 81 | T4 | 6f | 51 | 60 | 82 |
| 14 | tive | 2.2 | 2.11 | 0.16 | 0.145 | 79 | T5 | 65 | 52 | 64 | 78 |
| 15 | Example | 2.2 | 2.13 | 0.14 | 0.128 | 76 | T4 | 61 | 47 | 58 | 78 |
| 16 | | 2.2 | 2.12 | 0.13 | 0.119 | 77 | T5 | 65 | 61 | 66 | 75 |
| 17 | | 2.2 | 2.12 | 0.08 | 0.060 | 72 | T5 | 65 | 58 | 68 | 78 |
| 18 | | 2.2 | 2.13 | 0.06 | 0.042 | 70 | T5 | 65 | 56 | 69 | 75 |
| 19 | Invention | 1.4 | 1.38 | 0.13 | 0.128 | 95 | T5 | 65 | 62 | 64 | 95 |
| 20 | Example | 1.4 | 1.36 | 0.13 | 0.128 | 95 | T5 | 65 | 64 | 64 | 96 |
| 21 | Compara- | 2.2 | 2.08 | 0.13 | 0.119 | 75 | T5 | 65 | 53 | 64 | 86 |
| 22 | tive | 1.4 | 1.28 | 0.14 | 0.128 | 78 | DR8 | 73 | 59 | 70 | 72 |
| 23 | Example | 1.4 | 1.24 | 0.12 | 0.107 | 74 | DR9 | 76 | 71 | 78 | 71 |
| 24 | | 1.4 | 1.25 | 0.10 | 0.085 | 71 | DR10 | 80 | 67 | 82 | 65 |

| | | Distribution of hardness (HR30T) of tin mill blackplate | | | | | |
|---|---|---|---|---|---|---|---|
| | | position of middle portion of hot rolled steel strip | | | position of rear end of hot rolled steel strip | | |
| No. | Remarks | position of 5 mm from width-wise end | width-wise middle position | region of vari-ation quantity ≦±3 (%) | position of 5 mm from width-wise end | width-wise middle position | region of vari-ation quantity ≦±3 (%) |
| 1 | Inven- | 49 | 49 | 99 | 47 | 49 | 98 |
| 2 | tion | 56 | 57 | 99 | 55 | 57 | 98 |
| 3 | Example | 61 | 61 | 99 | 60 | 61 | 99 |
| 4 | | 65 | 65 | 99 | 63 | 65 | 98 |
| 5 | | 73 | 73 | 99 | 72 | 73 | 99 |
| 6 | | 76 | 76 | 99 | 74 | 76 | 98 |
| 7 | | 80 | 80 | 99 | 79 | 80 | 98 |
| 8 | | 56 | 57 | 99 | 56 | 57 | 99 |
| 9 | | 57 | 57 | 99 | 55 | 57 | 98 |
| 10 | | 61 | 61 | 99 | 59 | 61 | 99 |
| 11 | | 61 | 61 | 99 | 60 | 61 | 99 |
| 12 | | 61 | 61 | 99 | 59 | 61 | 98 |
| 13 | Compara- | 50 | 61 | 84 | 48 | 59 | 83 |
| 14 | tive | 52 | 65 | 80 | 49 | 63 | 79 |
| 15 | Example | 50 | 59 | 78 | 45 | 58 | 77 |
| 16 | | 62 | 67 | 76 | 60 | 65 | 74 |
| 17 | | 59 | 69 | 82 | 57 | 67 | 80 |
| 18 | | 58 | 71 | 80 | 54 | 68 | 78 |
| 19 | Invention | 62 | 65 | 96 | 62 | 63 | 95 |
| 20 | Example | 62 | 65 | 96 | 62 | 63 | 95 |
| 21 | Compara- | 54 | 65 | 87 | 52 | 63 | 85 |
| 22 | tive | 62 | 71 | 75 | 58 | 70 | 71 |
| 23 | Example | 72 | 79 | 69 | 69 | 78 | 70 |
| 24 | | 68 | 83 | 67 | 66 | 82 | 64 |

TABLE 29

| No. | Remarks | Flatness of cold rolled steel strip as measured on platen (mm) | | Passing property in continuous | Lateral bending of surface-treated steel strip and accuracy of adhesion position of film laminate | |
|---|---|---|---|---|---|---|
| | | height of edge wave | height of center buckle | annealing passing speed and status (mpm) | lateral bending (mm/m) | accuracy of adhesion position*) |
| 1 | Invention | 0 | 0 | 1200 | 0 | ○ |
| 2 | Example | 0 | 0 | 1100 | 0 | ○ |
| 3 | | 0 | 0 | 1000 | 0 | ○ |
| 4 | | 0 | 0 | 1050 | 0 | ○ |
| 5 | | 0 | 0 | 1000 | 0 | ○ |
| 6 | | 0 | 0 | 950 | 0 | ○ |
| 7 | | 0 | 0 | 850 | 0 | ○ |
| 8 | | 0 | 0 | 1000 | 0 | ○ |
| 9 | | 0 | 0 | 1000 | 0 | ○ |
| 10 | | 0 | 0 | 1000 | 0 | ○ |
| 11 | | 0 | 0 | 1000 | 0 | ○ |
| 12 | | 0 | 0 | 1000 | 0 | ○ |
| 13 | Comparative | 1 | 4 | 450 | 0.3 | X |
| 14 | | 1 | 3 | 400 | 0.5 | X |
| 15 | Example | 4 | 2 | 300 | 0.7 | X |
| 16 | | 4 | 3 | 300 partly breakage | 1 | X |
| 17 | | 6 | 1 | 300 partly breakage | 1 | X |
| 18 | | 7 | 1 | 300 partly breakage | 1 | X |
| 19 | Invention | 0 | 0 | 800 | 0.1 | ○ |
| 20 | Example | 0 | 0 | 800 | 0.1 | ○ |
| 21 | Comparative | 4 | 2 | 450 | 1.2 | X |
| 22 | | 4 | 4 | 400 | 1.6 | X |
| 23 | Example | 7 | 4 | 300 partly breakage | 1.5 | X |
| 24 | | 5 | 7 | 300 partly breakage | 1.2 | X |

*)○: Weld cans were produced in a high rate because film was adhered with a good accuracy.
X: Welding could not be conducted because film remained in weld can weld portion.

TABLE 30

| No. | Remarks | Material properties of tin mill blackplate | | | |
|---|---|---|---|---|---|
| | | r-value | Δr-value | fruiting property of 3-piece can | ragging resistance of wall in 2-piece can |
| 1 | Invention | 2.2 | −0.05 | ○ | ○ |
| 2 | Example | 1.9 | −0.02 | ○ | ○ |
| 3 | | 1.8 | −0.11 | ○ | ○ |
| 4 | | 1.7 | −0.13 | ○ | ○ |
| 5 | | 1.5 | −0.23 | ○ | ○ |
| 6 | | 1.5 | −0.36 | ○ | ○ |
| 7 | | 1.5 | −0.41 | ○ | ○ |
| 8 | | 1.6 | −0.09 | ○ | ○ |
| 9 | | 1.5 | −0.05 | ○ | ○ |
| 10 | | 1.5 | −0.12 | ○ | ○ |
| 11 | | 1.6 | −0.11 | ○ | ○ |
| 12 | | 1.5 | −0.14 | ○ | ○ |
| 13 | Comparative | 1.1 | −0.62 | X | X |

TABLE 30-continued

| No. | Remarks | Material properties of tin mill blackplate | | | |
|---|---|---|---|---|---|
| | | r-value | Δr-value | fruiting property of 3-piece can | ragging resistance of wall in 2-piece can |
| 14 | Example | 0.8 | −0.64 | X | X |
| 15 | | 1.2 | −0.73 | X | X |
| 16 | | 1.2 | −0.61 | X | X |
| 17 | | 0.9 | −0.81 | X | X |
| 18 | | 1.1 | −0.63 | X | X |
| 19 | Invention | 1.7 | −0.15 | ○ | ○ |
| 20 | Example | 1.6 | −0.13 | ○ | ○ |
| 21 | Comparative | 1.1 | −0.63 | X | X |
| 22 | Example | 1.4 | −0.33 | ○ | ○ |
| 23 | | 1.3 | −0.42 | ○ | ○ |
| 24 | | 1.2 | −0.55 | ○ | ○ |

TABLE 31

| No. | Remarks | Corrosion resistance and high-speed weldability of painted steel sheet | | | | Total |
|---|---|---|---|---|---|---|
| | | | corrosion resistance | | | |
| | | kind | evaluation | corroded state | high-speed weldability | evaluation |
| 1 | Invention | tin plate | ○ | uniform | ○ | ○ |
| 2 | Example | tin plate | ○ | uniform | ○ | ○ |

TABLE 31-continued

| | | Corrosion resistance and high-speed weldability of painted steel sheet | | | | |
|---|---|---|---|---|---|---|
| | | | corrosion resistance | | | Total |
| No. | Remarks | kind | evaluation | corroded state | high-speed weldability | evaluation |
| 3 | | thin tin plate | ○ | uniform | ○ | ○ |
| 4 | | thin tin plate | ○ | uniform | ○ | ○ |
| 5 | | thin tin plate | ○ | uniform | ○ | ○ |
| 6 | | tin plate | ○ | uniform | ○ | ○ |
| 7 | | tin plate | ○ | uniform | ○ | ○ |
| 8 | | tin plate | ○ | uniform | ○ | ○ |
| 9 | | tin plate | ○ | uniform | ○ | ○ |
| 10 | | thin tin plate | ○ | uniform | ○ | ○ |
| 11 | | TFS | ○ | uniform | ○ | ○ |
| 12 | | TFS | ○ | uniform | ○ | ○ |
| 13 | Comparative | tin plate | X | slightly ununiform | ○ | X |
| 14 | Example | thin tin plate | Δ | slightly ununiform | X | X |
| 15 | | thin tin plate | Δ | slightly ununiform | X | X |
| 16 | | thin tin plate | ○ | slightly ununiform | X | X |
| 17 | | thin tin plate | ○ | uniform | ○ | X |
| 18 | | TFS | X | ununiform | X | X |
| 19 | Invention | tin plate | ○ | uniform | ○ | Δ |
| 20 | Example | thin tin plate | ○ | uniform | ○ | Δ |
| 21 | Comparative | thin tin plate | Δ | slightly ununiform | X | X |
| 22 | Example | thin tin plate | Δ | slightly ununiform | X | X |
| 23 | | thin tin plate | ○ | uniform | ○ | X |
| 24 | | TFS | X | ununiform | X | X |

EXAMPLE 6

A cold rolled steel sheet was produced by using steel having a chemical composition shown in Table 32 likewise Example 5. A surface-treated steel sheet was produced by subjecting the surface of the steel sheet to a plating and if necessary to reflow treatment and then to a chromate treatment.

The above producing conditions are shown in Table 33 and Table 34. Moreover, the conditions of the plating bath in the Ni diffusion treatment and the annealing and various surface treating conditions were the same as in Example 1.

A test specimen was taken out from the thus produced surface-treated steel sheet to measure hardness (HR30T) distribution and thickness (mm) distribution in the widthwise direction. And also, r-value (Lankford value) and anisotropy property Δr thereof were measured.

Moreover, all test conditions of Ni/(Ni+Fe) in the surface layer of Ni diffusion treated material, flatness of the cold rolled steel strip and passing property in the continuous annealing, hardness (HR30T) distribution and thickness (mm) in the surface-treated steel sheet, can forming property, rust resistance, corrosion resistance, paint adhesion property through T peel test, high-speed weldability and the like were the same as in Example 2.

These measured results are shown in Tables 34–38.

TABLE 32

| | Chemical composition (wt %) | | | | | | | | | | | | | | | |
|---|---|---|---|---|---|---|---|---|---|---|---|---|---|---|---|---|
| No. | C | Si | Mn | P | S | Al | N | O | Cu | Ni | Cr | Mo | Ca | Nb | Ti | B |
| 1 | 0.003 | 0.01 | 0.12 | 0.013 | 0.015 | 0.055 | 0.0028 | 0.0035 | 0.02 | 0.01 | 0.03 | 0.001 | 0.0001 | 0.003 | 0.0001 | 0.0001 |
| 2 | 0.003 | 0.01 | 0.12 | 0.013 | 0.015 | 0.055 | 0.0028 | 0.0035 | 0.02 | 0.01 | 0.03 | 0.001 | 0.0001 | 0.003 | 0.0001 | 0.0001 |
| 3 | 0.003 | 0.01 | 0.12 | 0.013 | 0.015 | 0.055 | 0.0028 | 0.0035 | 0.02 | 0.01 | 0.03 | 0.001 | 0.0001 | 0.003 | 0.0001 | 0.0001 |
| 4 | 0.003 | 0.01 | 0.12 | 0.013 | 0.015 | 0.055 | 0.0028 | 0.0035 | 0.02 | 0.01 | 0.03 | 0.001 | 0.0001 | 0.003 | 0.0001 | 0.0001 |
| 5 | 0.003 | 0.01 | 0.12 | 0.013 | 0.015 | 0.055 | 0.0028 | 0.0035 | 0.02 | 0.01 | 0.03 | 0.001 | 0.0001 | 0.003 | 0.0001 | 0.0001 |
| 6 | 0.003 | 0.01 | 0.12 | 0.013 | 0.015 | 0.055 | 0.0028 | 0.0035 | 0.02 | 0.01 | 0.03 | 0.001 | 0.0001 | 0.003 | 0.0001 | 0.0001 |
| 7 | 0.003 | 0.01 | 0.12 | 0.013 | 0.015 | 0.055 | 0.0028 | 0.0035 | 0.02 | 0.01 | 0.03 | 0.001 | 0.0001 | 0.003 | 0.0001 | 0.0001 |
| 8 | 0.003 | 0.02 | 0.32 | 0.016 | 0.016 | 0.183 | 0.0097 | 0.0021 | 0.41 | 0.03 | 0.02 | 0.006 | 0.0008 | 0.081 | 0.0003 | 0.0032 |
| 9 | 0.003 | 0.02 | 0.55 | 0.013 | 0.006 | 0.156 | 0.0081 | 0.0018 | 0.02 | 0.46 | 0.06 | 0.006 | 0.0030 | 0.042 | 0.0010 | 0.0008 |
| 10 | 0.003 | 0.01 | 0.28 | 0.015 | 0.013 | 0.110 | 0.0063 | 0.0008 | 0.03 | 0.03 | 0.44 | 0.005 | 0.0011 | 0.001 | 0.0720 | 0.0014 |
| 11 | 0.004 | 0.02 | 0.35 | 0.018 | 0.007 | 0.103 | 0.0050 | 0.0006 | 0.03 | 0.03 | 0.02 | 0.041 | 0.0013 | 0.001 | 0.0301 | 0.0003 |
| 12 | 0.004 | 0.03 | 0.26 | 0.005 | 0.006 | 0.112 | 0.0122 | 0.0010 | 0.06 | 0.06 | 0.01 | 0.001 | 0.0012 | 0.001 | 0.0082 | 0.0005 |
| 13 | 0.005 | 0.03 | 0.72 | 0.009 | 0.023 | 0.061 | 0.0099 | 0.0050 | 0.53 | 0.01 | 0.43 | 0.041 | 0.0061 | 0.008 | 0.2200 | 0.0066 |
| 14 | 0.005 | 0.03 | 0.72 | 0.009 | 0.023 | 0.061 | 0.0099 | 0.0050 | 0.32 | 0.53 | 0.43 | 0.043 | 0.0061 | 0.008 | 0.2200 | 0.0066 |
| 15 | 0.005 | 0.03 | 0.72 | 0.009 | 0.023 | 0.061 | 0.0099 | 0.0050 | 0.30 | 0.42 | 0.63 | 0.043 | 0.0061 | 0.008 | 0.2200 | 0.0066 |
| 16 | 0.005 | 0.03 | 0.72 | 0.009 | 0.023 | 0.061 | 0.0099 | 0.0050 | 0.31 | 0.44 | 0.53 | 0.610 | 0.0061 | 0.008 | 0.2200 | 0.0066 |
| 17 | 0.007 | 0.02 | 0.75 | 0.026 | 0.009 | 0.221 | 0.0173 | 0.0132 | 0.03 | 0.52 | 0.58 | 0.010 | 0.0001 | 0.133 | 0.0015 | 0.0006 |
| 18 | 0.007 | 0.02 | 0.75 | 0.022 | 0.009 | 0.221 | 0.0173 | 0.0132 | 0.03 | 0.52 | 0.58 | 0.010 | 0.0001 | 0.133 | 0.0015 | 0.0006 |
| 19 | 0.002 | 0.02 | 0.14 | 0.012 | 0.016 | 0.050 | 0.0028 | 0.0037 | 0.01 | 0.01 | 0.02 | 0.001 | 0.0001 | 0.022 | 0.0001 | 0.0001 |
| 20 | 0.002 | 0.02 | 0.14 | 0.012 | 0.016 | 0.050 | 0.0028 | 0.0037 | 0.01 | 0.01 | 0.02 | 0.001 | 0.0001 | 0.022 | 0.0001 | 0.0001 |

TABLE 32-continued

| No. | Chemical composition (wt %) | | | | | | | | | | | | | | | |
|---|---|---|---|---|---|---|---|---|---|---|---|---|---|---|---|---|
| | C | Si | Mn | P | S | Al | N | O | Cu | Ni | Cr | Mo | Ca | Nb | Ti | B |
| 21 | 0.003 | 0.03 | 0.18 | 0.014 | 0.011 | 0.063 | 0.0025 | 0.0030 | 0.01 | 0.01 | 0.02 | 0.001 | 0.0001 | 0.021 | 0.0001 | 0.0001 |
| 22 | 0.003 | 0.03 | 0.18 | 0.014 | 0.011 | 0.063 | 0.0025 | 0.0030 | 0.01 | 0.01 | 0.02 | 0.001 | 0.0001 | 0.021 | 0.0001 | 0.0001 |
| 23 | 0.003 | 0.03 | 0.18 | 0.014 | 0.011 | 0.063 | 0.0025 | 0.0030 | 0.01 | 0.01 | 0.02 | 0.001 | 0.0001 | 0.021 | 0.0001 | 0.0001 |
| 24 | 0.003 | 0.03 | 0.18 | 0.014 | 0.011 | 0.063 | 0.0025 | 0.0030 | 0.01 | 0.01 | 0.02 | 0.001 | 0.0001 | 0.021 | 0.0001 | 0.0001 |

TABLE 33

| | | Hot rolling conditions | | | | | | | | | |
|---|---|---|---|---|---|---|---|---|---|---|---|
| | | | reverse | sheet | finish rolling mill | | | | shape of hot rolled steel sheet | | |
| No. | Remarks | rolling system | rewinding treatment | bar edge heater | stand using pair-cross | pair-cross angle (°) | FDT (° C.) | CT (° C.) | thickness (mm) | width (mm) | crown (μm) |
| 1 | Invention | continuous rolling | used | used | 1, 2, 3 | 0.2 | 870 | 550 | 2.0 | 1300 | +32 |
| 2 | Example | continuous rolling | used | used | 1, 2, 3 | 0.4 | 880 | 560 | 1.8 | 1300 | +24 |
| 3 | | continuous rolling | used | used | 1, 2, 3 | 0.6 | 910 | 620 | 1.6 | 1200 | +12 |
| 4 | | continuous rolling | used | used | 1, 2, 3 | 0.8 | 940 | 650 | 1.4 | 1200 | +6 |
| 5 | | continuous rolling | used | used | all stands | 1.0 | 950 | 710 | 1.0 | 1100 | +1 |
| 6 | | continuous rolling | used | used | all stands | 1.2 | 960 | 700 | 0.8 | 1100 | +2 |
| 7 | | continuous rolling | used | used | all stands | 1.2 | 950 | 650 | 0.6 | 990 | −5 |
| 8 | | continuous rolling | used | used | 1, 2, 3 | 0.6 | 930 | 640 | 0.8 | 1100 | −8 |
| 9 | | continuous rolling | used | used | 1, 2, 3 | 0.6 | 940 | 650 | 1.0 | 1100 | −15 |
| 10 | | continuous rolling | used | used | 1, 2, 3 | 0.8 | 930 | 660 | 1.0 | 1100 | −16 |
| 11 | | continuous rolling | used | used | 1, 2, 3 | 0.8 | 930 | 650 | 1.0 | 1100 | −21 |
| 12 | | continuous rolling | used | used | 1, 2, 3 | 0.8 | 920 | 640 | 1.0 | 1100 | −30 |
| 13 | Compara- | single rolling | not used | not used | 1, 2, 3 | 0.1 | 930 | 655 | 2.2 | 1100 | +56 |
| 14 | tive | single rolling | not used | not used | 1, 2 | 0.1 | 920 | 660 | 2.2 | 1100 | +66 |
| 15 | Example | single rolling | not used | not used | not used | — | 930 | 650 | 2.2 | 1100 | +68 |
| 16 | | single rolling | not used | not used | not used | — | 940 | 655 | 2.2 | 1100 | +72 |
| 17 | | single rolling | not used | not used | not used | — | 930 | 650 | 2.2 | 1100 | +76 |
| 18 | | single rolling | not used | not used | not used | — | 950 | 630 | 2.2 | 1100 | +90 |
| 19 | Invention | continuous rolling | not used | used | all stands | 1.2 | 910 | 600 | 1.4 | 1300 | −5 |
| 20 | Example | continuous rolling | used | used | all stands | 1.2 | 900 | 620 | 1.4 | 1300 | −7 |
| 21 | Compara- | continuous rolling | used | used | all stands | 1.2 | 920 | 600 | 2.2 | 1300 | −9 |
| 22 | tive | single rolling | used | used | all stands | 1.2 | 900 | 640 | 1.4 | 1300 | −12 |
| 23 | Example | continuous rolling | used | used | not used | not used | 940 | 605 | 1.4 | 1300 | +82 |
| 24 | | continuous rolling | used | not used | all stands | 1.2 | 900 | 650 | 1.4 | 1300 | −15 |

TABLE 34

| | | Cold rolling conditions | | | | | Continuous annealing/ Ni diffusion treatment | | | | Temper rolling | |
|---|---|---|---|---|---|---|---|---|---|---|---|---|
| No. | Remarks | one-side trapezodial work roll · cross angle of cross shift machine (°) | thickness at entry side (mm) | thickness at delivery side (mm) | cold rolling reduction (%) | width (mm) | Ni plating (g/m²) | annealing temperature (° C.) | weight ratio of Ni/(Ni + Fe) | thickness of Fe + Ni alloy (Å) | thickness at delivery side (mm) | rolling reduction (%) |
| 1 | Invention | 0.2 | 2.0 | 0.204 | 89.8 | 1300 | — | 750 | — | — | 0.200 | 2 |
| 2 | Example | 0.6 | 1.8 | 0.200 | 88.9 | 1300 | — | 750 | — | — | 0.180 | 10 |
| 3 | | 0.6 | 1.6 | 0.188 | 88.3 | 1200 | 0.07 | 740 | 0.19 | 1000 | 0.160 | 15 |
| 4 | | 0.8 | 1.4 | 0.163 | 88.4 | 1200 | 0.09 | 740 | 0.32 | 1000 | 0.130 | 20 |
| 5 | | 0.8 | 1.0 | 0.143 | 85.7 | 1100 | 0.07 | 760 | 0.05 | 1000 | 0.100 | 30 |
| 6 | | 0.8 | 0.8 | 0.123 | 84.6 | 1100 | 0.10 | 760 | 0.33 | 1000 | 0.080 | 35 |
| 7 | | 0.8 | 0.6 | 0.100 | 83.3 | 980 | 0.07 | 780 | 0.09 | 1000 | 0.060 | 40 |
| 8 | | 0.4 | 0.8 | 0.144 | 82.0 | 1100 | — | 760 | — | — | 0.130 | 10 |
| 9 | | 0.4 | 1.0 | 0.144 | 85.6 | 1100 | — | 760 | — | — | 0.130 | 10 |
| 10 | | 0.4 | 1.0 | 0.153 | 84.7 | 1100 | — | 790 | — | — | 0.130 | 15 |
| 12 | | 0.4 | 1.0 | 0.153 | 84.7 | 1100 | — | 750 | — | — | 0.130 | 15 |
| 13 | Compara- | not used | 2.2 | 0.200 | 90.9 | 1100 | — | 760 | — | — | 0.180 | 10 |
| 14 | tive | not used | 2.2 | 0.188 | 91.5 | 1100 | 0.5 | 760 | 0.22 | 1000 | 0.160 | 15 |
| 15 | Example | not used | 2.2 | 0.156 | 92.9 | 1100 | — | 750 | — | — | 0.140 | 10 |
| 16 | | not used | 2.2 | 0.144 | 93.5 | 1100 | 0.7 | 750 | 0.32 | 4000 | 0.130 | 10 |
| 17 | | not used | 2.2 | 0.094 | 95.7 | 1100 | 0.06 | 770 | 0.05 | 3000 | 0.080 | 15 |
| 18 | | not used | 2.2 | 0.071 | 96.8 | 1100 | — | 770 | — | — | 0.060 | 15 |
| 19 | Invention | 0.8 | 1.4 | 0.163 | 88.4 | 1300 | — | 760 | — | — | 0.130 | 20 |

TABLE 34-continued

| | | Cold rolling conditions | | | | | Continuous annealing/ Ni diffusion treatment | | | | Temper rolling | |
|---|---|---|---|---|---|---|---|---|---|---|---|---|
| No. | Remarks | one-side trapezodial work roll · cross angle of cross shift machine (°) | thickness at entry side (mm) | thickness at delivery side (mm) | cold rolling reduction (%) | width (mm) | Ni plating (g/m²) | annealing temperature (° C.) | weight ratio of Ni/(Ni + Fe) | thickness of Fe + Ni alloy (Å) | thickness at delivery side (mm) | rolling reduction (%) |
| 20 | Example | not used | 1.4 | 0.163 | 88.4 | 1300 | — | 750 | — | — | 0.130 | 20 |
| 21 | Comparative Example | 0.8 | 2.2 | 0.163 | 92.6 | 1300 | — | 750 | — | — | 0.130 | 20 |
| 22 | | 0.8 | 1.4 | 0.143 | 89.8 | 1300 | — | 720 | — | — | 0.100 | 30 |
| 23 | | 0.8 | 1.4 | 0.123 | 91.2 | 1300 | — | 730 | — | — | 0.080 | 35 |
| 24 | | 0.8 | 1.4 | 0.100 | 92.9 | 1300 | — | 740 | — | — | 0.060 | 40 |

TABLE 35

| | | Thickness distribution (mm) | | | | | Distribution of hardness (HR30T) of tin mill blackplate | | | | |
|---|---|---|---|---|---|---|---|---|---|---|---|
| | | hot rolled steel strip | | cold rolled steel strip | | | | | position of front end of hot rolled steel strip | | |
| No. | Remarks | middle portion | 25 mm from widthwise end | middle portion | position of 10 mm from widthwise end of hot rolled steel strip | region within ±4% of average thickness | temper grade | average hardness | position of 5 mm from widthwise end | widthwise middle position | region of variation quantity ≦±3 (%) |
| 1 | Invention Example | 2.0 | 1.98 | 0.20 | 0.198 | 98 | T1 | 49 | 48 | 49 | 98 |
| 2 | | 1.8 | 1.78 | 0.18 | 0.178 | 98 | T3 | 57 | 56 | 57 | 99 |
| 3 | | 1.6 | 1.59 | 0.16 | 0.157 | 99 | T4 | 61 | 61 | 61 | 99 |
| 4 | | 1.4 | 1.37 | 0.13 | 0.127 | 99 | T5 | 65 | 64 | 65 | 98 |
| 5 | | 1.0 | 1.00 | 0.10 | 0.098 | 99 | DR8 | 73 | 73 | 73 | 99 |
| 6 | | 0.8 | 0.82 | 0.08 | 0.079 | 98 | DR9 | 76 | 75 | 76 | 98 |
| 7 | | 0.6 | 0.62 | 0.06 | 0.059 | 98 | DR10 | 80 | 80 | 80 | 99 |
| 8 | | 0.8 | 0.78 | 0.13 | 0.131 | 99 | T3 | 57 | 56 | 57 | 99 |
| 9 | | 1.0 | 0.97 | 0.13 | 0.130 | 99 | T3 | 57 | 56 | 57 | 99 |
| 10 | | 1.0 | 1.00 | 0.13 | 0.131 | 98 | T4 | 61 | 60 | 61 | 99 |
| 11 | | 1.0 | 1.02 | 0.13 | 0.132 | 99 | T4 | 61 | 60 | 61 | 98 |
| 12 | | 1.0 | 1.03 | 0.13 | 0.133 | 99 | T4 | 61 | 59 | 61 | 98 |
| 13 | Comparative Example | 2.2 | 2.11 | 0.18 | 0.167 | 80 | T4 | 61 | 51 | 60 | 83 |
| 14 | | 2.2 | 2.12 | 0.16 | 0.146 | 78 | T5 | 65 | 52 | 64 | 79 |
| 15 | | 2.2 | 2.14 | 0.14 | 0.129 | 76 | T4 | 61 | 47 | 58 | 78 |
| 16 | | 2.2 | 2.12 | 0.13 | 0.119 | 77 | T5 | 65 | 58 | 66 | 76 |
| 17 | | 2.2 | 2.13 | 0.08 | 0.064 | 74 | T5 | 65 | 58 | 68 | 78 |
| 18 | | 2.2 | 2.14 | 0.06 | 0.042 | 70 | T5 | 65 | 54 | 69 | 73 |
| 19 | Invention Example | 1.4 | 1.27 | 0.13 | 0.128 | 95 | T5 | 65 | 62 | 64 | 95 |
| 20 | | 1.4 | 1.36 | 0.13 | 0.128 | 95 | T5 | 65 | 62 | 65 | 96 |
| 21 | Comparative Example | 2.2 | 2.15 | 0.13 | 0.118 | 74 | T5 | 65 | 53 | 64 | 83 |
| 22 | | 1.4 | 1.28 | 0.14 | 0.128 | 78 | DR8 | 73 | 59 | 70 | 72 |
| 23 | | 1.4 | 1.27 | 0.12 | 0.108 | 76 | DR9 | 76 | 70 | 78 | 70 |
| 24 | | 1.4 | 1.26 | 0.10 | 0.084 | 70 | DR10 | 80 | 66 | 82 | 64 |

| | | Distribution of hardness (HR30T) of tin mill blackplate | | | | | |
|---|---|---|---|---|---|---|---|
| | | position of middle portion of hot rolled steel strip | | | position of rear end of hot rolled steel strip | | |
| No. | Remarks | position of 5 mm from widthwise end | widthwise middle position | region of variation quantity ≦±3 (%) | position of 5 mm from widthwise end | widthwise middle position | region of variation quantity ≦±3 (%) |
| 1 | Invention Example | 49 | 49 | 99 | 47 | 49 | 99 |
| 2 | | 56 | 57 | 98 | 56 | 57 | 99 |
| 3 | | 61 | 61 | 99 | 60 | 61 | 99 |
| 4 | | 65 | 65 | 99 | 63 | 65 | 98 |
| 5 | | 73 | 73 | 99 | 72 | 73 | 99 |
| 6 | | 76 | 76 | 99 | 74 | 76 | 98 |

TABLE 35-continued

| | | | | | | | |
|---|---|---|---|---|---|---|---|
| 7 | | 80 | 80 | 99 | 80 | 80 | 99 |
| 8 | | 56 | 57 | 99 | 55 | 57 | 98 |
| 9 | | 57 | 57 | 99 | 55 | 57 | 98 |
| 10 | | 60 | 61 | 99 | 60 | 61 | 99 |
| 11 | | 61 | 61 | 99 | 60 | 61 | 98 |
| 12 | | 59 | 61 | 99 | 58 | 61 | 98 |
| 13 | Compara- | 51 | 61 | 85 | 47 | 59 | 81 |
| 14 | tive | 53 | 65 | 82 | 50 | 63 | 80 |
| 15 | Example | 50 | 59 | 78 | 45 | 58 | 77 |
| 16 | | 61 | 67 | 76 | 57 | 65 | 76 |
| 17 | | 59 | 69 | 81 | 57 | 67 | 80 |
| 18 | | 56 | 71 | 78 | 54 | 68 | 79 |
| 19 | Invention | 62 | 65 | 96 | 62 | 63 | 95 |
| 20 | Example | 62 | 65 | 96 | 62 | 63 | 95 |
| 21 | Compara- | 55 | 65 | 88 | 50 | 63 | 83 |
| 22 | tive | 60 | 71 | 72 | 58 | 70 | 71 |
| 23 | Example | 71 | 79 | 67 | 68 | 78 | 69 |
| 24 | | 67 | 83 | 66 | 65 | 82 | 65 |

TABLE 36

| | | Flatness of cold rolled steel strip as measured on platen (mm) | | Passing property in continuous | | Lateral bending of surface-treated steel strip and accuracy of adhesion position of film laminate | |
|---|---|---|---|---|---|---|---|
| No. | Remarks | height of edge wave | height of center buckle | annealing passing speed and status (mpm) | | lateral bending (mm/m) | accuracy of adhesion position*) |
| 1 | Invention | 0 | 0 | 1200 | | 0 | ○ |
| 2 | Example | 0 | 0 | 1100 | | 0 | ○ |
| 3 | | 0 | 0 | 1000 | | 0 | ○ |
| 4 | | 0 | 0 | 1050 | | 0 | ○ |
| 5 | | 0 | 0 | 1000 | | 0 | ○ |
| 6 | | 0 | 0 | 950 | | 0 | ○ |
| 7 | | 0 | 0 | 850 | | 0 | ○ |
| 8 | | 0 | 0 | 1000 | | 0 | ○ |
| 9 | | 0 | 0 | 1000 | | 0 | ○ |
| 10 | | 0 | 0 | 1000 | | 0 | ○ |
| 11 | | 0 | 0 | 1000 | | 0 | ○ |
| 12 | | 0 | 0 | 1000 | | 0 | ○ |
| 13 | Compara- | 1 | 4 | 450 | | 0.3 | X |
| 14 | tive | 1 | 3 | 400 | | 0.5 | X |
| 15 | Example | 4 | 2 | 300 | | 0.7 | X |
| 16 | | 4 | 3 | 300 | } partly breakage | 1 | X |
| 17 | | 6 | 1 | 300 | | 1 | X |
| 18 | | 7 | 1 | 300 | | 1 | X |
| 19 | Invention | 0 | 0 | 800 | | 0.1 | ○ |
| 20 | Example | 0 | 0 | 800 | | 0.1 | ○ |
| 21 | Compara- | 5 | 3 | 450 | | 1.4 | X |
| 22 | tive | 4 | 4 | 420 | | 1.6 | X |
| 23 | Example | 8 | 5 | 300 | } partly breakage | 1.6 | X |
| 24 | | 5 | 8 | 300 | | 1.2 | X |

*)○: Weld cans were produced in a high rate because film was adhered with a good accuracy.
X: Welding could not be conducted because film remained in weld can weld portion.

TABLE 37

| | | Material properties surface-treated steel sheet | | | |
|---|---|---|---|---|---|
| No. | Remarks | r-value | Δr-value | fruiting property of 3-piece can | ragging resistance of wall in 2-piece can |
| 1 | Invention | 2.1 | −0.04 | ○ | ○ |
| 2 | Example | 1.9 | −0.01 | ○ | ○ |
| 3 | | 1.9 | −0.11 | ○ | ○ |
| 4 | | 1.7 | −0.14 | ○ | ○ |
| 5 | | 1.6 | −0.21 | ○ | ○ |
| 6 | | 1.2 | −0.34 | ○ | ○ |
| 7 | | 1.1 | −0.40 | ○ | ○ |

TABLE 37-continued

| | | Material properties surface-treated steel sheet | | | |
|---|---|---|---|---|---|
| No. | Remarks | r-value | Δr-value | fruiting property of 3-piece can | ragging resistance of wall in 2-piece can |
| 8 | | 1.7 | −0.09 | ○ | ○ |
| 9 | | 1.5 | −0.04 | ○ | ○ |
| 10 | | 1.5 | −0.12 | ○ | ○ |
| 11 | | 1.7 | −0.11 | ○ | ○ |
| 12 | | 1.4 | −0.16 | ○ | ○ |
| 13 | Comparative | 1.0 | −0.51 | X | X |
| 14 | Example | 0.7 | −0.52 | X | X |

TABLE 37-continued

| No. | Remarks | Material properties surface-treated steel sheet: r-value | Δr-value | fruiting property of 3-piece can | ragging resistance of wall in 2-piece can |
|---|---|---|---|---|---|
| 15 | | 1.2 | −0.78 | X | X |
| 16 | | 1.1 | −0.61 | X | X |
| 17 | | 0.8 | −0.82 | X | X |
| 18 | | 1.1 | −0.66 | X | X |
| 19 | Invention | 1.8 | −0.14 | ○ | ○ |
| 20 | Example | 1.7 | −0.11 | ○ | ○ |
| 21 | Comparative | 1.1 | −0.65 | X | X |
| 22 | Example | 1.6 | −0.18 | ○ | ○ |
| 23 | | 1.5 | −0.19 | ○ | ○ |
| 24 | | 1.6 | −0.20 | ○ | ○ |

TABLE 38

| No. | Remarks | Plated quantity: kind | total tin quantity ($g/m^2$) | metallic tin quantity ($g/m^2$) | quantity of remaining metallic tin after blank baking ($g/m^2$) | area ratio of land-shaped tin (%) | quantity of metallic Cr ($mg/m^2$) | quantity of oxidized Cr ($mg/m^2$) |
|---|---|---|---|---|---|---|---|---|
| 1 | Invention | tin plate | 1.20 | 10.7 | 5.60 | — | 2 | 7 |
| 2 | Example | tin plate | 8.40 | 8.0 | 3.20 | — | 1 | 8 |
| 3 | | thin tin plate | 0.56 | 0.41 | 0.11 | 51 | 18 | 6 |
| 4 | | thin tin plate | 1.12 | 0.62 | 0.23 | 45 | 15 | 9 |
| 5 | | thin tin plate | 1.68 | 1.68 | 1.06 | 37 | 10 | 10 |
| 6 | | tin plate | 2.80 | 2.31 | 1.91 | 68 | 8 | 7 |
| 7 | | tin plate | 5.60 | 5.00 | 4.50 | 26 | 7 | 6 |
| 8 | | tin plate | 2.80 | 2.32 | 1.82 | — | 0 | 4 |
| 9 | | tin plate | 5.60 | 5.10 | 4.53 | — | 0 | 3 |
| 10 | | thin tin plate | 1.12 | 0.66 | 0.16 | — | 0 | s |
| 11 | | tin-free | — | — | — | — | 32 | 5 |
| 12 | | tin-free | — | — | — | — | 104 | 15 |
| 13 | Compara- | tin plate | 2.80 | 2.30 | 1.60 | — | 0 | 4 |
| 14 | tive | thin tin plate | 0.56 | 0.06 | 0.01 | 0 | 18 | 6 |
| 15 | Example | thin tin plate | 1.12 | 0.42 | 0.02 | 0 | 15 | 9 |
| 16 | | thin tin plate | 1.68 | 1.03 | 0.16 | 0 | 10 | 10 |
| 17 | | thin tin plate | 2.80 | 2.00 | 1.12 | 0 | 8 | 7 |
| 18 | | tin-free | — | — | — | — | 20 | 1 |
| 19 | Invention | tin plate | 2.80 | 2.30 | 1.60 | — | 1 | 6 |
| 20 | Example | tin plate | 0.56 | 0.06 | 0.01 | — | 18 | 6 |
| 21 | Compara- | thin tin plate | 1.12 | 0.42 | 0.02 | 0 | 15 | 9 |
| 22 | tive | thin tin plate | 1.68 | 1.03 | 0.16 | 0 | 10 | 10 |
| 23 | Example | thin tin plate | 2.80 | 2.00 | 1.12 | 0 | 8 | 3 |
| 24 | | tin-free | — | — | — | — | 20 | 1 |

| No. | Remarks | Corrosion resistance of painted steel sheet: threaded rust | corrosion resistance: evaluation | corrosion resistance: corroded state | high-speed weldability | Adhesion strength: through T-peel test (kg/10 mm) | total evaluation |
|---|---|---|---|---|---|---|---|
| 1 | Invention | ○ | ○ | uniform | ○ | 2.5 | ○ |
| 2 | Example | ○ | ○ | uniform | ○ | 2.2 | ○ |
| 3 | | ◎ | ○ | uniform | ○ | 2.9 | ○ |
| 4 | | ◎ | ○ | uniform | ○ | 2.8 | ○ |
| 5 | | ◎ | ○ | uniform | ○ | 2.6 | ○ |
| 6 | | ◎ | ○ | uniform | ○ | 2.5 | ○ |
| 7 | | ◎ | ○ | uniform | ○ | 2.1 | ○ |
| 8 | | ○ | ○ | uniform | ○ | 1.8 | ○ |
| 9 | | ○ | ○ | uniform | ○ | 1.6 | ○ |
| 10 | | ○ | ○ | uniform | ○ | 1.9 | ○ |
| 11 | | ◎ | ○ | uniform | ○ | 2.7 | ○ |
| 12 | | ◎ | ○ | uniform | ○ | 2.6 | ○ |

TABLE 38-continued

| | | | | | | | |
|---|---|---|---|---|---|---|---|
| 13 | Compara- | X | X | slightly ununiform | ○ | 0.8 | X |
| 14 | tive | X | Δ | slightly ununiform | X | 1.1 | X |
| 15 | Example | X | Δ | slightly ununiform | X | 0.9 | X |
| 16 | | X | ○ | slightly ununiform | X | 0.6 | X |
| 17 | | X | ○ | uniform | ○ | 1.0 | X |
| 18 | | Δ | X | ununiform | X | 2.1 | X |
| 19 | Invention | ○ | X | uniform | ○ | 2.2 | Δ |
| 20 | Example | ○ | Δ | uniform | ○ | 2.6 | Δ |
| 21 | Compara- | X | Δ | slightly ununiform | X | 1.2 | X |
| 22 | tive | X | ○ | slightly ununiform | X | 0.7 | X |
| 23 | Example | Δ | ○ | uniform | ○ | 0.6 | X |
| 24 | | ○ | X | ununiform | X | 2.3 | X |

EXAMPLE 7

Steel having a chemical composition shown in Table 39 was melted in a bottom-blowing converter of 270t and cast by means of a continuous casting machine to obtain a cast slab.

These cast slabs were rough rolled and the resulting sheet bars were joined to a preceding sheet bar and heated at their widthwise end portions by means of an edge heater and continuously rolled by means of a hot finish rolling mill using pair-cross rolls with a changed cross angle at front 3 stands or all 7 stands to form an extremely-thin hot rolled steel strip having a width of 950–1300 mm, which was reheated and annealed at a state of coiled hot rolled steel strip in a self-annealing or continuous annealing line. Moreover, descaling was conducted by pickling after the self-annealing or before reheating annealing.

Then, cold rolling and recovery heat treatment were carried out under various conditions. In this case, it was rolled in a 6 stand tandem continuously cold rolling mill including a cross shift machine using a one-side trapezoidal work roll as a work roll of No. 1 stand to an extremely-thin thickness.

For the comparison, the cast slab was subjected to a hot finish rolling at the conventional cast slab unit and further to a rolling not using a pair cross machine and a cold rolling not using a cross shift machine with a one-side trapezoidal work roll.

Subsequently, after the recovery heat treatment, cold rolled steel sheets having various temper grades were provided by adjusting a rolling reduction of temper rolling.

The above producing conditions are shown in Table 39 and Table 40.

A test specimen was taken out from the thus treated steel sheet to measure hardness (HR30T) distribution and thickness (mm) distribution in the widthwise direction.

Further, Ni plated quantity and Ni/(Ni+Fe) ratio in the surfacw layer with respect to the Ni diffusion treated specimen were measured in the same manner as in Example 1.

These measured results are shown in Tables 41–43.

TABLE 39

| | Chemical composition (wt %) | | | | | | | |
|---|---|---|---|---|---|---|---|---|
| No. | C | Si | Mn | P | S | Al | N | O |
| 1 | 0.0015 | 0.02 | 0.14 | 0.008 | 0.011 | 0.065 | 0.0028 | 0.0036 |
| 2 | 0.0015 | 0.02 | 0.14 | 0.008 | 0.011 | 0.065 | 0.0028 | 0.0036 |
| 3 | 0.0015 | 0.02 | 0.14 | 0.008 | 0.011 | 0.065 | 0.0028 | 0.0636 |
| 4 | 0.0009 | 0.02 | 0.35 | 0.009 | 0.014 | 0.045 | 0.0032 | 0.0042 |
| 5 | 0.0011 | 0.02 | 0.25 | 0.012 | 0.014 | 0.085 | 0.0062 | 0.0027 |
| 6 | 0.0011 | 0.02 | 0.25 | 0.012 | 0.014 | 0.085 | 0.0062 | 0.0027 |
| 7 | 0.0028 | 0.03 | 0.31 | 0.016 | 0.015 | 0.180 | 0.0092 | 0.0032 |
| 8 | 0.0032 | 0.04 | 0.41 | 0.016 | 0.015 | 0.180 | 0.0096 | 0.0021 |

TABLE 40

| | | Hot rolling conditions | | | | | | | | | |
|---|---|---|---|---|---|---|---|---|---|---|---|
| | | | | finish rolling mill | | | | | | | |
| No. | Remarks | rolling system | sheet bar edge heater | stand using pair-cross | pair-cross angle (°) | FDT (° C.) | CT (° C.) | re-heating ° C. × sec | thick-ness (mm) | width (mm) | crown (μm) |
| 1 | Invention | | used | 1, 2, 3 | 0.2 | 860 | 620 | 580 × 10 | 0.65 | 1250 | +30 |
| 2 | Example | | used | 1, 2, 3 | 0.4 | 880 | 660 | — | 0.81 | 1200 | +22 |
| 3 | | contin- | nsed | 1, 2, 3 | 0.6 | 900 | 720 | — | 1.30 | 1200 | +10 |
| 4 | | uous | used | 1, 2, 3 | 0.8 | 910 | 650 | — | 0.50 | 1200 | +2 |
| 5 | | rolling | used | all stands | 1.0 | 950 | 700 | — | 0.50 | 1100 | −5 |
| 6 | | | used | all stands | 1.2 | 950 | 730 | — | 0.60 | 1100 | −15 |
| 7 | Compara- | | not used | not used | — | 930 | 650 | — | 1.80 | 1100 | +70 |
| 8 | tive Example | single rolling | not used | not used | — | 930 | 650 | — | 1.80 | 1100 | +82 |

TABLE 40-continued

| | | Cold rolling conditions | | | | | |
|---|---|---|---|---|---|---|---|
| No. | Remarks | one-side trapezoidal work roll-cross angle of cross shift machine (°) | thickness at entry side (mm) | thickness at derivery side (mm) | cold rolling reduction (%) | width (mm) | Recovery heat treating conditions ° C. × sec |
| 1 | Invention | 0.2 | 0.65 | 0.130 | 80.0 | 1200 | 400 × 10 |
| 2 | Example | 0.6 | 0.81 | 0.130 | 84.0 | 1300 | 350 × 10 |
| 3 | | 0.6 | 1.30 | 0.130 | 90.0 | 1200 | 350 × 10 |
| 4 | | 0.8 | 0.50 | 0.100 | 80.0 | 1200 | 400 × 10 |
| 5 | | 0.8 | 0.50 | 0.080 | 84.0 | 1000 | 400 × 10 |
| 6 | | 0.8 | 0.60 | 0.060 | 90.0 | 1000 | unpractied |
| 7 | Comparative Example | conventional method | 1.80 | 0.100 | 94.4 | 1200 | — |
| 8 | | | 1.80 | 0.060 | 96.7 | 1000 | — |

TABLE 41

| | | Thickness distribution (mm) | | | | | Distribution of hardness (HR30T) of tin mill blackplate | | | | |
|---|---|---|---|---|---|---|---|---|---|---|---|
| | | hot rolled steel strip | | cold rolled steel strip | | | | | position of front end of hot rolled steel strip | | |
| No. | Remarks | middle portion | 25 mm from widthwise end | middle portion | position of 10 mm from widthwise end of hot rolled steel strip | region within ±4% of average thickness | temper grade | average hardness | position of 5 mm from widthwise end | widthwise middle position | region of variation quantity ≦±3 (%) |
| 1 | Invention | 0.65 | 0.62 | 0.13 | 0.128 | 97 | DR8 | 73 | 71 | 73 | 97 |
| 2 | Example | 0.81 | 0.79 | 0.13 | 0.127 | 97 | DR9 | 76 | 74 | 76 | 98 |
| 3 | | 1.30 | 1.27 | 0.13 | 0.128 | 98 | DR10 | 80 | 78 | 80 | 98 |
| 4 | | 0.50 | 0.47 | 0.10 | 0.097 | 98 | DR8 | 73 | 70 | 73 | 98 |
| 5 | | 0.50 | 0.48 | 0.08 | 0.079 | 99 | DR9 | 76 | 75 | 76 | 99 |
| 6 | | 0.61 | 0.57 | 0.06 | 0.057 | 99 | DR10 | 80 | 79 | 80 | 99 |
| 7 | Comparative | 1.80 | 1.70 | 0.10 | 0.089 | 54 | DR9 | 76 | 63 | 76 | 61 |
| 8 | | 1.80 | 1.73 | 0.66 | 0.048 | 63 | DR10 | 80 | 73 | 85 | 58 |

| | | Distribution of hardness (HR30T) of tin mill blackplate | | | | | |
|---|---|---|---|---|---|---|---|
| | | position of middle portion of hot rolled steel strip | | | position of rear end of hot rolled steel strip | | |
| No. | Remarks | position of 5 mm from widthwise end | widthwise middle position | region of variation quantity ≦±3 (%) | position of 5 mm from widthwise end | widthwise middle position | region of variation quantity ≦±3 (%) |
| 1 | Invention | 71 | 73 | 97 | 70 | 73 | 97 |
| 2 | Example | 75 | 76 | 99 | 73 | 76 | 97 |
| 3 | | 76 | 80 | 99 | 77 | 86 | 98 |
| 4 | | 72 | 73 | 99 | 70 | 73 | 68 |
| 5 | | 76 | 76 | 99 | 74 | 76 | 98 |
| 6 | | 80 | 80 | 99 | 78 | 80 | 98 |
| 7 | Comparative | 61 | 76 | 65 | 60 | 76 | 58 |
| 8 | Example | 73 | 85 | 62 | 71 | 84 | 53 |

TABLE 42

| No. | Remarks | Flatness of cold rolled steel strip as measured on platen (mm) | | Lateral bending of tin plated steel strip and accuracy of adhesion position of film laminate | |
|---|---|---|---|---|---|
| | | height of edge wave | height of center buckle | bending per 1 m of lateral bending (mm) | accuracy of adhesion position |
| 1 | Invention | 0 | 0 | 0 | Weld cans were produced |
| 2 | Example | 0 | 0 | 0 | in a high rate because |
| 3 | | 0 | 0 | 0 | film was adhered with a |
| 4 | | 0 | 0 | 0 | good accuracy |
| 5 | | 0 | 0 | 0 | |
| 6 | | 0 | 0 | 0 | |
| 7 | Comparative | 4 | 5 | 1 | Welding could not be |
| 8 | Example | 6 | 3 | 0.8 | conducted because film remained in weld can · weld portion |

TABLE 43

| No. | Remarks | Material properties of tin mill blackplate | | | Corrosion resistance and high-speed weldability of painted steel sheet | | | | Total |
|---|---|---|---|---|---|---|---|---|---|
| | | temper grade | fruiting property of 3-piece can | ragging resistance of wall in 2-piece can | kind | corrosion resistance evaluation | corrosion resistance corroded state | high-speed weldability | evaluation |
| 1 | Invention | DR8 | ○ | ○ | tin plate | ○ | uniform | ○ | ○ |
| 2 | Example | DR9 | ○ | ○ | tin plate | ○ | uniform | ○ | ○ |
| 3 | | DR10 | ○ | ○ | thin tin plate | ○ | uniform | ○ | ○ |
| 4 | | DR8 | ○ | ○ | thin tin plate | ○ | uniform | ○ | ○ |
| 5 | | DR9 | ○ | ○ | thin tin plate | ○ | uniform | ○ | ○ |
| 6 | | DR10 | ○ | ○ | TFS | ○ | uniform | ○ | ○ |
| 7 | Compara- | DR8 | X | X | tin plate | X | ununiform | ○ | X |
| 8 | tive Example | DR10 | X | X | tin plate | X | ununiform | ○ | X |

EXAMPLE 8

A cold rolled steel sheet was produced by using steel having a chemical composition shown in Table 44 likewise Example 7. A surface-treated steel sheet was produced by subjecting the surface of the above steel sheet to plating and chromate treatment.

The above producing conditions are shown in Table 44 and Table 45.

Test specimens were taken out from the cold rolled steel sheets and surface-treated steel sheets produced by the above methods to conduct examination tests. In this case, all test conditions of flatness of the cold rolled steel strip and passing property in the continuous annealing, hardness (HR30T) distribution and thickness (mm) in the surface-treated steel sheet, can forming property, rust resistance, corrosion resistence, paint adhesion property through T peel test, high-speed weldability and the like were the same as in Example 2.

These measured results are shown in Tables 46–48.

TABLE 44

| No. | Chemical composition (wt %) | | | | | | | |
|---|---|---|---|---|---|---|---|---|
| | C | Si | Mn | P | S | Al | N | O |
| 1 | 0.0013 | 0.01 | 0.11 | 0.007 | 0.010 | 0.036 | 0.0021 | 0.0032 |
| 2 | 0.0013 | 0.01 | 0.11 | 0.007 | 0.010 | 0.036 | 0.0021 | 0.0032 |
| 3 | 0.0013 | 0.01 | 0.11 | 0.007 | 0.010 | 0 036 | 0.0021 | 0.0032 |
| 4 | 0.0008 | 0.02 | 0.35 | 0.009 | 0.014 | 0.045 | 0.0032 | 0.0042 |
| 5 | 0.0010 | 0.02 | 0.25 | 0.010 | 0.012 | 0.080 | 0.0051 | 0.0016 |
| 6 | 0.0010 | 0.02 | 0.20 | 0.010 | 0.012 | 0.080 | 0.0051 | 0.0015 |
| 7 | 0.0031 | 0.04 | 0.36 | 0.016 | 0.016 | 0.192 | 0.0091 | 0.0015 |
| 8 | 0.0038 | 0.04 | 0.45 | 0.018 | 0.015 | 0.180 | 0.0096 | 0.0014 |

TABLE 45

| | | Hot rolling conditions | | | | | | | | | |
|---|---|---|---|---|---|---|---|---|---|---|---|
| | | | | finish rolling mill | | | | | | | |
| No. | Remarks | rolling system | sheet bar edge heater | stand using pair-cross | pair-cross angle (°) | FDT (° C.) | CT (° C.) | re-heating ° C. × sec | thick-ness (mm) | width (mm) | crown (μm) |
| 1 | Invention | continuous rolling | used | 1, 2, 3 | 0.2 | 860 | 620 | 580 × 10 | 0.65 | 1250 | +30 |
| 2 | Example | | | 1, 2, 3 | 0.4 | 880 | 660 | — | 0.81 | 1200 | +26 |
| 3 | | | | 1, 2, 3 | 0.6 | 920 | 720 | — | 1.30 | 1200 | −8 |
| 4 | | | | 1, 2, 3 | 0.8 | 930 | 650 | — | 0.50 | 1200 | −1 |
| 5 | | | | all stands | 1.0 | 960 | 720 | — | 0.50 | 1100 | −6 |
| 6 | | | | all stands | 1.2 | 950 | 730 | — | 0.60 | 1100 | −16 |
| 7 | Comparative Example | single rolling | not used | not used | — | 930 | 650 | — | 1.80 | 1100 | +75 |
| 8 | | | | not used | — | 930 | 670 | — | 1.80 | 1100 | +87 |

| | | Cold rolling conditions | | | | | |
|---|---|---|---|---|---|---|---|
| No. | Remarks | one-side trapezoidal work roll-cross angle of cross shift machine (°) | thickness at entry side (mm) | thickness at derivery side (mm) | cold rolling reduc-tion (%) | width (mm) | Recovery heat treating condi-tions ° C. × sec |
| 1 | Invention | 0.2 | 0.65 | 0.130 | 80.0 | 1300 | 350 × 10 |
| 2 | Example | 0.6 | 0.81 | 0.130 | 84.0 | 1300 | 400 × 10 |
| 3 | | 0.6 | 1.30 | 0.130 | 90.0 | 1200 | 350 × 10 |
| 4 | | 0.8 | 0.50 | 0.100 | 80.0 | 1200 | 350 × 10 |
| 5 | | 0.8 | 0.50 | 0.080 | 84.0 | 1000 | 400 × 10 |
| 6 | | 0.8 | 0.60 | 0.060 | 90.0 | 1000 | unpracticed |
| 7 | Comparative Example | conventional method | 1.80 | 0.100 | 94.4 | 1200 | — |
| 8 | | | 1.80 | 0.060 | 96.7 | 1000 | — |

TABLE 46

| | | Thickness distribution (mm) | | | | | Distribution of hardness (HR30T) of tin mill blackplate | | | | |
|---|---|---|---|---|---|---|---|---|---|---|---|
| | | hot rolled steel strip | | cold rolled steel strip | | | | | position of front end of hot rolled steel strip | | |
| No. | Remarks | middle portion | 25 mm from width-wise end | middle portion | position of 10 mm from widthwise end of hot rolled steel strip | region within ±4% of average thick-ness | temper grade | aver-age hard-ness | position of 5 mm from width-wise end | width-wise middle position | region of vari-ation quantity ≦±3 (%) |
| 1 | Invention | 0.65 | 0.63 | 0.13 | 0.129 | 98 | DR8 | 73 | 72 | 73 | 98 |
| 2 | Example | 0.81 | 0.79 | 0.13 | 0.127 | 97 | DR9 | 76 | 73 | 76 | 97 |
| 3 | | 1.30 | 1.27 | 0.13 | 0.126 | 98 | DR10 | 80 | 78 | 80 | 98 |
| 4 | | 0.50 | 0.48 | 0.10 | 0.099 | 99 | DR8 | 73 | 71 | 73 | 99 |
| 5 | | 0.50 | 0.47 | 0.08 | 0.077 | 98 | DR9 | 76 | 75 | 76 | 99 |
| 6 | | 0.60 | 0.57 | 0.06 | 0.057 | 99 | DR10 | 80 | 79 | 80 | 99 |
| 7 | Comparative Example | 1.80 | 1.69 | 0.10 | 0.087 | 52 | DR9 | 76 | 61 | 76 | 61 |
| 8 | | 1.80 | 1.70 | 0.06 | 0.048 | 60 | DR10 | 80 | 72 | 85 | 59 |

TABLE 46-continued

| | | Distribution of hardness (HR30T) of tin mill blackplate | | | | | |
|---|---|---|---|---|---|---|---|
| | | position of middle portion of hot rolled steel strip | | | position of rear end of hot rolled steel strip | | |
| No. | Remarks | position of 5 mm from width-wise end | width-wise middle position | region of variation quantity ≦±3 (%) | position of 5 mm from width-wise end | width-wise middle position | region of variation quantity ≦±3 (%) |
| 1 | Invention | 72 | 73 | 98 | 71 | 73 | 98 |
| 2 | Example | 75 | 76 | 98 | 73 | 76 | 97 |
| 3 | | 79 | 80 | 99 | 77 | 80 | 98 |
| 4 | | 72 | 73 | 99 | 70 | 73 | 98 |
| 5 | | 76 | 76 | 99 | 75 | 76 | 98 |
| 6 | | 80 | 80 | 99 | 78 | 80 | 98 |
| 7 | Comparative | 63 | 76 | 65 | 61 | 76 | 59 |
| 8 | Example | 73 | 85 | 62 | 71 | 84 | 53 |

TABLE 47

| | | Flatness of cold rolled steel strip as measured on platen (mm) | | Lateral bending of surface-treated steel strip and accuracy of adhesion position of film laminate | |
|---|---|---|---|---|---|
| No. | Remarks | height of edge wave | height of center buckle | bending per 1 m of lateral bending (mm) | accuracy of adhesion position |
| 1 | Invention | 0 | 0 | 0 | Weld cans were produced in a high rate because film was adhered with a good accuracy |
| 2 | Example | 0 | 0 | 0 | |
| 3 | | 0 | 0 | 0 | |
| 4 | | 0 | 0 | 0 | |
| 5 | | 0 | 0 | 0 | |
| 6 | | 0 | 0 | 0 | |
| 7 | Comparative | 5 | 8 | 2 | Welding could not be conducted because film remained in weld can · weld portion |
| 8 | Example | 7 | 8 | 1.2 | |

TABLE 48

| | | Material properties of surface-treated steel sheet | | | Plated quantity | | | | |
|---|---|---|---|---|---|---|---|---|---|
| No. | Remarks | temper grade | fruiting property of 3-piece can | ragging resistance of wall in 2-piece can | kind | total tin quantity ($g/m^2$) | metallic tin quantity ($g/m^2$) | quantity of metallic Cr ($mg/m^2$) | quantity of oxidized Cr ($mg/g^2$) |
| 1 | Invention | DR8 | ○ | ○ | tin plate | 11.20 | 10.7 | 4 | 7 |
| 2 | Example | DR9 | ○ | ○ | tin plate | 2.80 | 2.31 | 3 | 8 |
| 3 | | DR10 | ○ | ○ | thin tin plate | 0.56 | 0.41 | 18 | 6 |
| 4 | | DR8 | ○ | ○ | thin tin plate | 1.12 | 0.62 | 15 | 9 |
| 5 | | DR9 | ○ | ○ | thin tin plate | 1.68 | 1.68 | 10 | 10 |
| 6 | | DR10 | ○ | ○ | tin-free | | | 32 | 7 |
| 7 | Comparative | DR8 | X | X | tin plate | 2.80 | 2.32 | 0 | 4 |
| 8 | Example | DR10 | X | X | tin plate | 5.60 | 5.10 | 0 | 3 |

TABLE 48-continued

| No. | Remarks | Corrosion resistance of painted steel sheet: threaded rust | corrosion resistance: evaluation | corrosion resistance: corroded state | high-speed weldability | Adhesion strength through T-peel test (kg/10 mm) | Total evaluation |
|---|---|---|---|---|---|---|---|
| 1 | Invention Example | ○ | ○ | uniform | ○ | 2.5 | ○ |
| 2 | | ○ | ○ | uniform | ○ | 2.2 | ○ |
| 3 | | ○ | ○ | uniform | ○ | 2.9 | ○ |
| 4 | | ○ | ○ | uniform | ○ | 2.8 | ○ |
| 5 | | ○ | ○ | uniform | ○ | 2.6 | ○ |
| 6 | | ○ | ○ | uniform | ○ | 2.6 | ○ |
| 7 | Comparative Example | X | X | ununiform | ○ | 1.8 | X |
| 8 | | X | X | ununiform | ○ | 1.6 | X |

From the above Examples 1–8, it has been confirmed that extremely-thin and wide-width steel sheets for can having uniform thickness and hardness in the widthwise direction could be produced according to the invention. Furthermore, it has been confirmed that it is possible to produce extremely-thin steel sheets for the can capable of corresponding to the high-speed can formation in various 2-piece can methods and 3-piece can methods and having material properties suitable for the working to light weight cans and developing performances suitable for new can formation using a coil laminated with a film.

And also, it is clear that extremely-thin and wide-width steel sheets having uniformity in widthwise direction can be produced by adopting rationalization of chemical composition of steel, continuation of hot rolling, heating of widthwise end portion, rolling through pair-cross rolls in a hot finish rolling mill and through cross rolls in a cold rolling mill and the like without unreasonable demand.

INDUSTRIAL APPLICABILITY

As mentioned above, according to the invention, extremely-thin and wide-width steel sheets for can having excellent material properties, particularly uniformity of hardness and uniformity of thickness can rationally be produced by conducting continuity through sheet bar joining, flattening crown through pair-cross rolls and raising temperature of end portion in hot rolled steel strip through an edge heater in the hot rolling and further conducting cross shift rolling through one-side trapezoidal work roll in the cold rolling on occasions.

Furthermore, extremely-thin and wide-width steel sheets for can having excellent uniformities of material properties and thickness and containing convex tin layer and having excellent high-speed seam weldability can be produced by subjecting the surface of the steel sheet after the cold rolling to Ni plating and diffusing through annealing to form Fe—Ni alloy layer.

Moreover, according to the method of the invention, it is possible to efficiently manufacture products by casting a continuously cast slab at a width corresponding to a plurality of product widths and dividing it into product widths after hot rolling or cold rolling or surface treatment.

We claim:

1. An extremely-thin steel sheet, comprising a steel sheet having an average thickness of not more than 0.20 mm and a width of not less than 950 mm, a thickness variation quantity in a widthwise direction within ±4% of the average thickness in a region corresponding to not less than 95% of the width of the steel sheet and a hardness (HR30T) variation in the widthwise direction within ±3 of an average hardness.

2. An extremely-thin steel sheet according to claim 1, wherein the steel has a chemical composition containing C: not more than 0.1 wt %, Si: not more than 0.03 wt %, Mn: 0.05–0.60 wt %, P: not more than 0.02 wt %, S: not more than 0.02 wt %, Al: 0.02–0.20 wt %, N: not more than 0.015 wt %, O: not more than 0.01 wt %, and the balance being Fe and inevitable impurities.

3. An extremely-thin steel sheet according to claim 1, wherein the steel comprises C: not more than 0.1 wt %, Si: not more than 0.03 wt %, Mn: 0.05–0.60 wt %, P: not more than 0.02 wt %, S: not more than 0.02 wt %, Al: 0.02–0.20 wt %, N: not more than 0.015 wt %, O: not more than 0.01 wt %, one or more elements selected from the group consisting of Cu: 0.001–0.5 wt %, Ni: 0.01–0.5 wt %, Cr: 0.01–0.5 wt %, Mo: 0.001–0.5 wt %, Ca: not more than 0.005 wt %, Nb: not more than 0.10 wt %, Ti: not more than 0.20 wt % and B: not more than 0.005 wt %, and the balance being Fe and inevitable impurities.

4. An extremely-thin steel sheet according to claim 1, further comprising a surface treated layer on at least one side surface of the steel sheet.

5. An extremely-thin steel sheet according to claim 4, wherein the surface treated layer has been formed by tin plating or chromium plating.

6. A method for producing an extremely-thin steel sheet having an average thickness of not more than 0.20 mm and a width of not less than 950 mm, wherein a thickness variation quantity in a widthwise direction is within ±4% of the average thickness in a region corresponding to not less than 95% of the width of the steel sheet and a hardness (HR30T) variation in the widthwise direction is within ±3 of an average hardness, the method comprising:

rendering a steel slab into a sheet bar having a width of not less than 950 mm through rolling;

butt-joining the sheet bar onto another sheet bar;

raising a temperature of a widthwise end portion of the sheet bar using an edge heater;

then subjecting to a continuous finish rolling including rolling with pair-cross rolls on at least three stands to obtain a hot rolled steel sheet having a width of not less than 950 mm, a thickness of 0.5–2 mm and a crown within ±40 μm; and further cold rolling the hot rolled steel sheet.

7. A method according to claim 6, further comprising continuous annealing and temper rolling after the cold rolling.

8. A method of producing a extremely-thin steel sheet according to claim 6, wherein the cold rolling is cross shift rolling on one or more stands at a front stage side.

* * * * *